US011241100B2

(12) United States Patent
Chapin et al.

(10) Patent No.: US 11,241,100 B2
(45) Date of Patent: Feb. 8, 2022

(54) TEMPERATURE-REGULATING MATTRESS

(71) Applicant: Casper Sleep Inc., New York, NY (US)

(72) Inventors: Jeff Chapin, San Francisco, CA (US); Chris Glaister, Oakland, CA (US); Ara Acle, Oakland, CA (US); Defne Civelekoglu, San Francisco, CA (US); Caroline Cockerham, Brooklyn, NY (US); John Cohen, San Francisco, CA (US); Russell Jelinek, Almeda, CA (US); Martin Kay, San Francisco, CA (US); Colin Kelly, Brooklyn, NY (US); Carly Kim, San Francisco, CA (US); Eric Konzelmann, Mountain View, CA (US); Jordan Lay, San Francisco, CA (US); Eric Lewis, Boulder Creek, CA (US); Jeff Mekler, San Francisco, CA (US); Tyler Moore, San Francisco, CA (US); Josef Norgan, San Francisco, CA (US); Elliot Sather, San Francisco, CA (US); Shail Shah, Oakland, CA (US); Shyam Srinivasan, Oakland, CA (US); Ryan Young, San Francisco, CA (US)

(73) Assignee: Casper Sleep Inc., New York, NY (US)

( * ) Notice: Subject to any disclaimer, the term of this patent is extended or adjusted under 35 U.S.C. 154(b) by 0 days.

(21) Appl. No.: 16/390,194

(22) Filed: Apr. 22, 2019

(65) Prior Publication Data

US 2019/0320808 A1 Oct. 24, 2019

Related U.S. Application Data

(60) Provisional application No. 62/808,299, filed on Feb. 21, 2019, provisional application No. 62/753,032, (Continued)

(51) Int. Cl.

| | |
|---|---|
| ***A47C 21/04*** | (2006.01) |
| ***A47C 31/00*** | (2006.01) |
| ***A47C 21/00*** | (2006.01) |

(52) U.S. Cl.

CPC ..... *A47C 21/044* (2013.01); *A47C 21/003* (2013.01); *A47C 31/008* (2013.01); *A47C 21/048* (2013.01)

(58) Field of Classification Search

CPC ..... A47C 21/04; A47C 21/042; A47C 21/044; A47C 21/046; A47C 21/048; A47C 21/06;

(Continued)

(56) References Cited

U.S. PATENT DOCUMENTS

| | | | |
|---|---|---|---|
| 1,893,548 | A | 1/1933 | Hardy |
| 2,032,248 | A | 2/1936 | Bins |

(Continued)

FOREIGN PATENT DOCUMENTS

| | | | |
|---|---|---|---|
| CA | 2044355 | C | 1/1995 |
| CA | 2054349 | C | 3/1995 |

(Continued)

OTHER PUBLICATIONS

International Search Report and Written Opinion for Application No. PCT/US19/28543, dated Aug. 22, 2019, 16 pages.

(Continued)

*Primary Examiner* — David R Hare
*Assistant Examiner* — George Sun
(74) *Attorney, Agent, or Firm* — Koffsky Schwalb LLC

(57) ABSTRACT

A temperature-regulating mattress system provides dynamic adjustment of temperature and other parameters throughout a user's sleep cycle to maximize the quality of the user's sleep, Features of the system may include: (a) heating and cooling temperature regulation (with dynamic custom pro- (Continued)

files that control humidity and are dual-zone); (b) smart controls (with remotes and apps that learn from users to optimize settings and work with smart home products such as Alexa and interactive lighting systems); (c) comfort (with a mattress that provide the necessary support for its users); and (d) sensors used for temperature and humidity estimation algorithms, control mechanism, and additional inferences from those sensors (pose, enrichment of biometric sensing data, etc.).

11 Claims, 55 Drawing Sheets

Related U.S. Application Data filed on Oct. 30, 2018, provisional application No. 62/738,782, filed on Sep. 28, 2018, provisional application No. 62/686,653, filed on Jun. 18, 2018, provisional application No. 62/661,623, filed on Apr. 23, 2018.

(58) Field of Classification Search
CPC ..... A47C 21/00; A47C 27/14; A47C 27/142; A47C 27/144; A47C 27/15; A61G 7/05784
See application file for complete search history.

(56) References Cited

U.S. PATENT DOCUMENTS

D107,880 S 1/1938 Marsack
2,399,235 A 4/1946 Leslie
2,399,625 A 4/1946 Leslie
3,400,413 A 9/1968 La Grossa
D256,734 S 9/1980 Riley
4,407,031 A 10/1983 Michiels
4,536,906 A 8/1985 Varndfii
4,542,547 A 9/1985 Sato
4,628,557 A 12/1986 Murphy
4,768,251 A 9/1988 Baskent
4,788,730 A 12/1988 Bexton
D301,412 S 6/1989 Duvivier
4,964,184 A 10/1990 Lewis
5,010,843 A 4/1991 Henry
5,023,967 A 6/1991 Ferrand
5,023,970 A 6/1991 Tesch
5,107,558 A 4/1992 Werner
5,170,522 A 12/1992 Walker
5,189,747 A 3/1993 Mundy
5,219,307 A 6/1993 Morrison
5,291,625 A 3/1994 Leslie
5,294,181 A 3/1994 Rose
5,448,788 A 9/1995 Wu
D368,475 S 4/1996 Scott
5,509,154 A 4/1996 Shafer
5,561,876 A 10/1996 Petruzella
5,564,140 A 10/1996 Shoenhair
5,642,546 A 7/1997 Shoenhair
5,652,484 A 7/1997 Shafer
D383,028 S 9/1997 Pierce
5,730,120 A 3/1998 Yonkers, Jr.
5,765,246 A 6/1998 Shoenhair
5,903,941 A 5/1999 Shafer
5,904,172 A 5/1999 Gifft
D411,057 S 6/1999 Johnson
6,037,723 A 3/2000 Shafer
6,061,856 A 5/2000 Hoffmann
6,108,843 A 8/2000 Suzuki
6,115,861 A 9/2000 Reeder
D431,730 S 10/2000 Zorzetto
6,175,890 B1 1/2001 Yamaura
6,175,980 B1 1/2001 Gaither
6,192,538 B1 2/2001 Fogel
6,196,157 B1 3/2001 Northrop
6,202,239 B1 3/2001 Ward
6,212,718 B1 * 4/2001 Stolpmann ..... A61G 7/05776 285/914
6,286,167 B1 9/2001 Stolpmann
6,301,730 B1 10/2001 Delfs
6,305,317 B1 10/2001 Spiegel
6,336,237 B1 1/2002 Schmid
6,397,419 B1 6/2002 Mechache
6,421,859 B1 7/2002 Hicks
6,483,264 B1 11/2002 Shafer
6,546,576 B1 4/2003 Lin
6,557,198 B1 5/2003 Gladney
6,658,683 B2 12/2003 Parvin
D486,665 S 2/2004 Weaver
D486,877 S 2/2004 Peterson
D486,969 S 2/2004 Weaver
6,686,711 B2 2/2004 Rose
D487,207 S 3/2004 Manuel
6,708,357 B2 3/2004 Gaboury
6,763,541 B2 7/2004 Mahoney
6,804,848 B1 10/2004 Rose
6,807,698 B2 10/2004 Torbet
6,832,397 B2 12/2004 Gaboury
6,854,143 B2 2/2005 Sharples
D502,929 S 3/2005 Copeland
6,883,191 B2 4/2005 Gaboury
6,895,620 B1 5/2005 Rensink
6,931,685 B2 8/2005 Kuchel
6,952,850 B2 10/2005 Visser
6,971,128 B1 12/2005 McGrath
6,983,500 B2 1/2006 Wootten
7,036,172 B2 5/2006 Torbet
7,036,173 B2 5/2006 Gladney
D525,740 S 7/2006 Parker
D526,140 S 8/2006 Cook
7,103,933 B2 9/2006 Gladney
7,147,538 B2 12/2006 Cano
7,155,766 B1 1/2007 Gilchrest, Jr.
7,165,281 B2 1/2007 Larssson
D551,704 S 9/2007 Nakamura
D564,239 S 3/2008 Mecchi
D581,713 S 12/2008 Berke
7,530,127 B2 5/2009 Leifermann
D593,349 S 6/2009 Pittman
7,614,362 B2 11/2009 Dunn
D605,337 S 12/2009 Zhang
D608,560 S 1/2010 Chen
D608,561 S 1/2010 Chen
D608,562 S 1/2010 Chen
7,788,750 B2 9/2010 Norstrem
D629,150 S 12/2010 Douloubakas
D634,148 S 3/2011 Morrison
7,908,687 B2 3/2011 Ward
7,914,611 B2 3/2011 Vrzalik
7,921,807 B2 4/2011 Arvanites
7,937,789 B2 5/2011 Feher
7,950,084 B1 5/2011 McKay
D639,492 S 6/2011 Lee
8,051,514 B2 11/2011 Yarmer
8,065,763 B2 11/2011 Brykalski
8,118,920 B2 2/2012 Vrzalik
D657,150 S 4/2012 Hughes
D658,412 S 5/2012 Hoyord
8,181,290 B2 5/2012 Brykalski
D663,077 S 7/2012 Pohl
D664,303 S 7/2012 Chauncey
8,245,339 B2 8/2012 Murray
8,256,236 B2 9/2012 Lofy
8,307,482 B2 11/2012 Gladney
8,336,369 B2 12/2012 Mahoney
D674,644 S 1/2013 Stewart
D675,855 S 2/2013 Reeves
8,372,182 B2 2/2013 Vrzalik
8,402,578 B2 3/2013 Ko
D679,870 S 4/2013 Williams
8,448,315 B2 5/2013 Rensink
8,490,233 B2 7/2013 Essers
8,512,854 B2 8/2013 Fox

(56) References Cited

U.S. PATENT DOCUMENTS

D691,118 S 10/2013 Ingham
D694,746 S 12/2013 Akana
D696,044 S 12/2013 Lotto
D697,874 S 1/2014 Stusynski
D698,338 S 1/2014 Ingham
8,621,687 B2 1/2014 Brykalski
D699,983 S 2/2014 Polesuk
D701,536 S 3/2014 Shakal
8,672,842 B2 3/2014 Kenalty
D702,971 S 4/2014 Mitchell
D702,972 S 4/2014 Busch
8,739,339 B1 6/2014 McKay
8,745,784 B2 6/2014 Cole
8,745,795 B2 6/2014 Klancnik
8,769,747 B2 7/2014 Mahoney
8,789,224 B2 7/2014 Wyatt
8,800,979 B2 8/2014 Defranks
D713,165 S 9/2014 Robinson
8,832,888 B2 9/2014 Chunglo
8,863,336 B2 10/2014 Theosabrata
8,881,328 B2 11/2014 Mikkelsen
8,893,339 B2 11/2014 Fleury
D720,157 S 12/2014 Villena
8,918,930 B2 12/2014 Stroh
8,931,329 B2 1/2015 Mahoney
8,933,140 B2 1/2015 Peterson
D722,239 S 2/2015 Russell
8,959,683 B2 2/2015 Rochlin
D723,304 S 3/2015 Chang
D724,254 S 3/2015 Sun
D725,832 S 3/2015 Coulter
8,966,689 B2 3/2015 McGuire
8,973,183 B1 3/2015 Palashewski
8,984,687 B2 3/2015 Stusynski
8,984,690 B2 3/2015 Chunglo
8,997,279 B1 4/2015 McKay
9,009,898 B2 4/2015 Morimura
D728,254 S 5/2015 Karnes-Toth
D728,271 S 5/2015 Cohen
D731,209 S 6/2015 Fux
9,085,125 B2 7/2015 Gesquière
D736,537 S 8/2015 Grossman
D737,250 S 8/2015 Ingham
9,095,224 B2 8/2015 Tanaka
9,119,478 B2 9/2015 Defranks
9,125,497 B2 9/2015 Brykalski
9,138,064 B2 9/2015 Tursi, Jr.
9,186,479 B1 11/2015 Franceschetti
9,192,245 B2 11/2015 Chunglo
9,204,731 B2 12/2015 Corodemus
9,204,732 B2 12/2015 Wyatt
9,211,017 B2 12/2015 Tyree
D747,899 S 1/2016 Klein
9,259,099 B1 * 2/2016 Larsen ..... A47C 21/046
9,265,352 B2 2/2016 Oakhill
9,271,579 B2 3/2016 Riley
9,326,903 B2 5/2016 Locke
9,326,904 B2 5/2016 Nomura
9,370,457 B2 6/2016 Nunn
9,386,862 B1 7/2016 Limer
9,392,875 B2 7/2016 Weyl
9,392,879 B2 7/2016 Nunn
D766,017 S 9/2016 Jensen
9,445,751 B2 9/2016 Young
9,474,384 B2 10/2016 Rawls-Meehan
D770,672 S 11/2016 Ju
9,504,332 B2 11/2016 Gladney
D773,209 S 12/2016 Jaigobin
9,510,688 B2 12/2016 Nunn
9,510,698 B1 12/2016 Krotova
D776,960 S 1/2017 Suzuki
9,538,853 B2 1/2017 Vrzalik
9,538,855 B2 1/2017 Gross
D778,637 S 2/2017 Barry
D779,856 S 2/2017 Rich
9,578,941 B2 2/2017 Maclachlan
D781,078 S 3/2017 Goenka
9,597,244 B2 3/2017 Ishibashi
9,609,951 B2 4/2017 Chan
9,622,589 B2 4/2017 Nomura
D785,370 S 5/2017 Randall
D785,968 S 5/2017 Burden
9,635,953 B2 5/2017 Nunn
9,642,472 B2 5/2017 Gladney
9,657,800 B2 5/2017 Defranks
D790,257 S 6/2017 Holbrook
D791,494 S 7/2017 Bosch
9,694,156 B2 7/2017 Franceschetti
9,730,524 B2 8/2017 Chen
9,737,150 B2 * 8/2017 Rawls-Meehan ..... A61H 23/0263
9,737,154 B2 8/2017 Mahoney
D796,725 S 9/2017 Recker
D798,077 S 9/2017 Schmitt
9,770,114 B2 9/2017 Brosnan
9,770,117 B1 9/2017 Torbet
D799,858 S 10/2017 Pearce
9,782,311 B2 10/2017 Lafleche
9,788,661 B1 10/2017 Alletto
D802,324 S 11/2017 Bucove
D804,856 S 12/2017 Desodt
9,844,275 B2 12/2017 Nunn
9,861,208 B2 1/2018 Carlitz
D809,321 S 2/2018 Bell
D809,843 S 2/2018 Natalie
D810,458 S 2/2018 Cartier
9,888,782 B1 2/2018 Jannke
D812,393 S 3/2018 Karschnik
D812,643 S 3/2018 Akana
9,907,408 B2 3/2018 Vrzalik
9,918,558 B2 3/2018 Limer
D815,335 S 4/2018 Lin
9,930,971 B2 4/2018 Dóczi
9,931,085 B2 4/2018 Young
9,949,573 B1 4/2018 Huang
9,962,902 B2 5/2018 Losio
9,981,107 B2 5/2018 Franceschetti
D822,911 S 7/2018 Menayan
10,016,064 B2 7/2018 Corodemus
D824,698 S 8/2018 Pennington
10,051,973 B2 8/2018 Morgan
10,058,467 B2 8/2018 Stusynski
10,092,242 B2 10/2018 Nunn
10,105,092 B2 10/2018 Franceschetti
10,136,735 B2 11/2018 Ocegueda
D836,849 S 12/2018 Romaya
10,143,312 B2 12/2018 Brosnan
10,149,549 B2 12/2018 Erko
10,154,932 B2 12/2018 Franceschetti
10,179,526 B2 1/2019 Marquette
10,182,661 B2 1/2019 Nunn
D840,732 S 2/2019 Karschnik
10,194,752 B2 2/2019 Zaiss
10,194,753 B2 2/2019 Fleury
10,201,234 B2 2/2019 Nunn
10,202,499 B2 2/2019 Crawford
D843,418 S 3/2019 Demin
10,251,490 B2 4/2019 Nunn
D848,051 S 5/2019 Huang
10,285,508 B2 5/2019 Rose
D850,161 S 6/2019 Ping
D850,682 S 6/2019 DeBrunner
10,314,407 B1 * 6/2019 Main ..... A47C 27/083
10,342,358 B1 7/2019 Palashewski
10,357,113 B2 7/2019 Gladney
10,357,115 B2 7/2019 Oh
D857,433 S 8/2019 Negus
D860,257 S 9/2019 Akana
D861,227 S 9/2019 Sonneman
D861,964 S 10/2019 Lin
D862,104 S 10/2019 Suzuki
D862,105 S 10/2019 Liu
D863,356 S 10/2019 Akana
D864,615 S 10/2019 Morrison

(56) References Cited

U.S. PATENT DOCUMENTS 10,441,086 B2 10/2019 Nunn
10,441,087 B2 10/2019 Karschnik
10,448,749 B2 10/2019 Palashewski
D865,402 S 11/2019 Morrison
10,463,165 B2 11/2019 Ishibashi
10,470,583 B2 11/2019 Gross
10,477,975 B2 11/2019 Tursi, Jr.
10,492,969 B2 12/2019 Stusynski
10,531,745 B2 1/2020 Chen
10,539,170 B2 1/2020 Griffith
D885,077 S 5/2020 Kamler
2001/0027334 A1* 10/2001 White ..... A47G 9/1036 607/108
2001/0029628 A1 10/2001 Ferrand
2002/0069462 A1 6/2002 Gaboury
2003/0181538 A1 9/2003 Martel
2003/0233706 A1 12/2003 Birch
2004/0134433 A1 7/2004 Holder
2004/0154101 A1 8/2004 Digirolamo
2005/0087142 A1 4/2005 Dalal
2005/0210595 A1 9/2005 Di Stasio
2005/0224000 A1 10/2005 Holte
2006/0042008 A1 3/2006 Baker
2006/0046024 A1 3/2006 Huntley
2006/0053560 A1 3/2006 Metzger
2006/0053561 A1 3/2006 Metzger
2006/0085919 A1 4/2006 Kramer
2006/0254526 A1 11/2006 Andriola
2006/0272582 A1 12/2006 Dunn
2007/0040424 A1 2/2007 Neustat
2007/0101496 A1 5/2007 Ho
2007/0107133 A1 5/2007 Schwaiger
2007/0226911 A1 10/2007 Gladney
2007/0256241 A1 11/2007 Harmon
2007/0273539 A1 11/2007 Gananathan
2008/0010746 A1 1/2008 Ho
2008/0010751 A1 1/2008 Kemper
2008/0028536 A1 2/2008 Hadden-Cook
2008/0052830 A1 3/2008 Koughan
2008/0116403 A1 5/2008 Shelbourn
2008/0127897 A1 6/2008 Flannery
2008/0127898 A1 6/2008 Morse
2008/0127899 A1 6/2008 Angus
2008/0155755 A1 7/2008 Crousore
2008/0173627 A1 7/2008 Martin
2008/0201856 A1* 8/2008 Howard ..... A47C 31/123 5/690
2008/0313815 A1 12/2008 Guesquiere
2009/0000031 A1 1/2009 Feher
2009/0089933 A1 4/2009 Letton
2009/0106894 A1 4/2009 Yeo
2009/0127912 A1 5/2009 Galbreath
2009/0151072 A1 6/2009 Jones, III
2009/0172881 A1 7/2009 Peterson
2009/0217459 A1* 9/2009 Rudolph ..... A47C 21/042 5/706
2010/0011502 A1* 1/2010 Brykalski ..... A47C 21/04 5/423
2010/0038882 A1 2/2010 Chimento
2010/0050341 A1 3/2010 Tepper
2010/0058541 A1 3/2010 Kemper
2010/0087561 A1 4/2010 Abraham
2010/0160473 A1 6/2010 Neff
2010/0205738 A1 8/2010 Pollack
2010/0237082 A1 9/2010 Fernandez
2010/0269262 A1 10/2010 Warren
2010/0313356 A1 12/2010 Morter
2011/0035879 A1 2/2011 Grinstead
2011/0061168 A1 3/2011 Farley
2011/0067183 A1 3/2011 Hawkins
2011/0099722 A1 5/2011 Moret
2011/0107514 A1* 5/2011 Brykalski ..... A61G 7/057 5/421
2011/0115635 A1* 5/2011 Petrovski ..... A61G 7/05 340/584
2011/0154576 A1 6/2011 Warren
2011/0173757 A1 7/2011 Rensink
2011/0252572 A1 10/2011 Morrison
2011/0290834 A1 12/2011 Pelz
2011/0314605 A1 12/2011 Deguchi
2012/0001548 A1 1/2012 Recker
2012/0053423 A1 3/2012 Kenalty
2012/0060284 A1 3/2012 Caines
2012/0110734 A1 5/2012 An
2012/0159715 A1 6/2012 Jung
2012/0180225 A1 7/2012 Gladney
2012/0324646 A1 12/2012 Briganti
2013/0025050 A1 1/2013 Syrowitz
2013/0025070 A1 1/2013 Ruehlmann
2013/0042411 A1 2/2013 Vitale
2013/0146211 A1 6/2013 Mason
2013/0152305 A1 6/2013 Lall
2013/0174344 A1 7/2013 Klancnik
2013/0175057 A1 7/2013 Klancnik
2013/0180050 A1 7/2013 Koci
2013/0247828 A1 9/2013 Tedaldi
2013/0263377 A1 10/2013 Wootten, Jr.
2013/0263386 A1 10/2013 Romero
2013/0284099 A1 10/2013 Oakes, Jr.
2014/0033440 A1 2/2014 Tyree
2014/0033441 A1 2/2014 Morgan
2014/0039082 A1 2/2014 Peterson
2014/0059765 A1 3/2014 Harris
2014/0068868 A1 3/2014 Morzano
2014/0082843 A1 3/2014 Papadakos
2014/0082846 A1 3/2014 Blazar
2014/0099468 A1 4/2014 Cai
2014/0109314 A1 4/2014 Boersma
2014/0109320 A1 4/2014 Chunglo
2014/0130255 A1 5/2014 Montano, Jr.
2014/0141233 A1 5/2014 Crawford
2014/0182061 A1* 7/2014 Zaiss ..... A61G 7/05792 5/423
2014/0189955 A1 7/2014 Alletto, Jr.
2014/0190417 A1 7/2014 Lipscomb
2014/0201925 A1* 7/2014 Tursi, Jr ..... A47C 17/86 5/722
2014/0208517 A1 7/2014 Gross
2014/0227552 A1 8/2014 Lau
2014/0230735 A1 8/2014 Coulter
2014/0250596 A1 9/2014 De La Place
2014/0259433 A1 9/2014 Nunn
2014/0277822 A1 9/2014 Nunn
2014/0283303 A1 9/2014 Rochlin
2014/0283308 A1 9/2014 Chen
2015/0000042 A1 1/2015 Randall
2015/0007393 A1 1/2015 Palashewski
2015/0026896 A1 1/2015 Fleury
2015/0067967 A1* 3/2015 Tyree ..... A47C 27/144 5/691
2015/0074911 A1 3/2015 Dungan
2015/0082545 A1 3/2015 Holbrook
2015/0135435 A1 5/2015 Ueda
2015/0182032 A1 7/2015 Jensen
2015/0182397 A1 7/2015 Palashewski
2015/0182399 A1 7/2015 Rose
2015/0208819 A1 7/2015 McKay
2015/0237824 A1 8/2015 Cantwell
2015/0289667 A1* 10/2015 Oakhill ..... A47C 21/044 5/423
2015/0290059 A1 10/2015 Brosnan
2015/0296995 A1 10/2015 Krim
2015/0351556 A1 12/2015 Franceschetti
2015/0351700 A1 12/2015 Franceschetti
2015/0351982 A1* 12/2015 Krenik ..... A47C 23/002 5/616
2015/0355612 A1 12/2015 Franceschetti
2015/0366366 A1 12/2015 Zaiss
2016/0015184 A1 1/2016 Nunn
2016/0037938 A1 2/2016 Tyree
2016/0073788 A1 3/2016 Franceschetti
2016/0073950 A1 3/2016 Franceschetti

(56) References Cited

U.S. PATENT DOCUMENTS

| | | | | |
|---|---|---|---|---|
| 2016/0081487 | A1 | 3/2016 | Corodemus | |
| 2016/0100696 | A1 | 4/2016 | Palashewski | |
| 2016/0106061 | A1 | 4/2016 | Nelson | |
| 2016/0128487 | A1* | 5/2016 | Eskridge, III | A47C 21/048 5/423 |
| 2016/0128488 | A1 | 5/2016 | Franceschetti | |
| 2016/0135623 | A1 | 5/2016 | Montzka | |
| 2016/0157625 | A1 | 6/2016 | Schneider | |
| 2016/0169490 | A1 | 6/2016 | Kijima | |
| 2016/0183691 | A1 | 6/2016 | Mason | |
| 2016/0192617 | A1 | 7/2016 | Murphy | |
| 2016/0192786 | A1 | 7/2016 | Holbrook | |
| 2016/0224750 | A1 | 8/2016 | Kethman | |
| 2016/0242562 | A1 | 8/2016 | Karschnik | |
| 2016/0262557 | A1 | 9/2016 | Williams | |
| 2016/0296031 | A1* | 10/2016 | Sramek | A47C 27/15 |
| 2016/0309678 | A1 | 10/2016 | Garnet | |
| 2016/0338871 | A1 | 11/2016 | Nunn | |
| 2016/0360905 | A1 | 12/2016 | Feldman | |
| 2017/0003666 | A1 | 1/2017 | Nunn | |
| 2017/0028165 | A1 | 2/2017 | Franceschetti | |
| 2017/0035212 | A1 | 2/2017 | Erko | |
| 2017/0049243 | A1 | 2/2017 | Nunn | |
| 2017/0112292 | A1 | 4/2017 | Sopher | |
| 2017/0135632 | A1 | 5/2017 | Franceschetti | |
| 2017/0135881 | A1 | 5/2017 | Franceschetti | |
| 2017/0135882 | A1 | 5/2017 | Franceschetti | |
| 2017/0135883 | A1 | 5/2017 | Franceschetti | |
| 2017/0172240 | A1 | 6/2017 | Massey | |
| 2017/0191516 | A1 | 7/2017 | Griffith | |
| 2017/0196369 | A1 | 7/2017 | Nunn | |
| 2017/0208955 | A1 | 7/2017 | Lee | |
| 2017/0231401 | A1 | 8/2017 | McGuire | |
| 2017/0238715 | A1 | 8/2017 | Choi | |
| 2017/0251839 | A1 | 9/2017 | Mcleod | |
| 2017/0259028 | A1 | 9/2017 | Franceschetti | |
| 2017/0273470 | A1 | 9/2017 | Brykalski | |
| 2017/0295945 | A1 | 10/2017 | Stickler | |
| 2017/0296412 | A1 | 10/2017 | Hung | |
| 2017/0296773 | A1 | 10/2017 | Franceschetti | |
| 2017/0318980 | A1 | 11/2017 | Mahoney | |
| 2017/0318981 | A1 | 11/2017 | Duwell | |
| 2017/0348182 | A1 | 12/2017 | Yoo | |
| 2017/0354268 | A1 | 12/2017 | Brosnan | |
| 2018/0027981 | A1* | 2/2018 | Sherman | A47C 27/18 |
| 2018/0042393 | A1* | 2/2018 | Alletto | A47C 21/042 |
| 2018/0042400 | A1 | 2/2018 | Lin | |
| 2018/0100254 | A1 | 4/2018 | Brunton | |
| 2018/0116415 | A1 | 5/2018 | Karschnik | |
| 2018/0116420 | A1 | 5/2018 | Shakal | |
| 2018/0125259 | A1 | 5/2018 | Peterson | |
| 2018/0125260 | A1 | 5/2018 | Peterson | |
| 2018/0153766 | A1 | 6/2018 | Chen | |
| 2018/0271300 | A1* | 9/2018 | Wang | A61G 7/05784 |
| 2018/0289171 | A1* | 10/2018 | Alletto, Jr. | A47C 21/044 |
| 2018/0344041 | A1 | 12/2018 | Liu | |
| 2019/0021513 | A1 | 1/2019 | Nunn | |
| 2019/0029597 | A1 | 1/2019 | Nunn | |
| 2019/0082855 | A1 | 3/2019 | Brosnan | |
| 2019/0099017 | A1 | 4/2019 | Goldberg | |
| 2019/0104858 | A1 | 4/2019 | Erko | |
| 2019/0125097 | A1 | 5/2019 | Nunn | |
| 2019/0133332 | A1 | 5/2019 | Zaiss | |
| 2019/0174930 | A1* | 6/2019 | DeFranks | A47C 21/006 |
| 2019/0186704 | A1 | 6/2019 | Qiu | |
| 2019/0223630 | A1 | 7/2019 | Phan | |
| 2019/0230434 | A1 | 7/2019 | Stanley | |
| 2019/0231084 | A1 | 8/2019 | Nunn | |
| 2019/0254438 | A1 | 8/2019 | Rose | |
| 2019/0254593 | A1 | 8/2019 | Franceschetti | |
| 2019/0269878 | A1 | 9/2019 | Franceschetti | |
| 2019/0320809 | A1 | 10/2019 | Ishibashi | |
| 2019/0321581 | A1 | 10/2019 | Franceschetti | |
| 2019/0328147 | A1 | 10/2019 | Palashewski | |
| 2019/0343306 | A1 | 11/2019 | Muthanandam | |
| 2019/0357696 | A1 | 11/2019 | Palashewski | |
| 2019/0376945 | A1* | 12/2019 | Yao | F24F 11/62 |
| 2020/0029704 | A1 | 1/2020 | Karschnik | |
| 2020/0113343 | A1* | 4/2020 | Staels | B60N 2/64 |

FOREIGN PATENT DOCUMENTS

| | | | |
|---|---|---|---|
| CA | 2112895 | C | 8/1998 |
| CA | 2305522 | A1 | 4/1999 |
| CA | 2416861 | A1 | 8/2003 |
| CA | 2502697 | A1 | 4/2004 |
| CA | 2525570 | C | 11/2006 |
| CA | 2650218 | A1 | 11/2007 |
| CA | 2922187 | A1 | 11/2007 |
| CA | 2989606 | A1 | 3/2010 |
| CA | 2754914 | A1 | 9/2010 |
| CA | 2618630 | C | 10/2011 |
| CA | 2799927 | A1 | 12/2011 |
| CA | 2801789 | A1 | 12/2011 |
| CA | 2823387 | A1 | 7/2012 |
| CA | 2783753 | A1 | 1/2013 |
| CA | 2783982 | A1 | 1/2013 |
| CA | 2843370 | A1 | 1/2013 |
| CA | 2848770 | A1 | 3/2013 |
| CA | 2855227 | A1 | 4/2013 |
| CA | 2651960 | C | 7/2013 |
| CA | 2800552 | A1 | 7/2013 |
| CA | 2878994 | A1 | 3/2014 |
| CA | 2888119 | A1 | 5/2014 |
| CA | 2894194 | A1 | 6/2014 |
| CA | 2839603 | A1 | 7/2014 |
| CA | 2648272 | C | 1/2015 |
| CA | 2863889 | A1 | 3/2015 |
| CA | 2922738 | A1 | 3/2015 |
| CA | 2937238 | A1 | 7/2015 |
| CA | 2963626 | A1 | 4/2016 |
| CA | 2744772 | C | 5/2016 |
| CA | 2876788 | A1 | 7/2016 |
| CA | 2978341 | A1 | 10/2016 |
| CA | 2956830 | A1 | 8/2017 |
| CA | 2958348 | A1 | 8/2017 |
| CA | 2940763 | C | 10/2017 |
| CA | 2740802 | C | 1/2018 |
| CA | 2770105 | C | 1/2018 |
| CA | 2737749 | C | 2/2018 |
| CN | 2071915 | U | 2/1991 |
| CN | 2633118 | Y | 8/2004 |
| CN | 2636734 | Y | 9/2004 |
| CN | 2840811 | Y | 11/2006 |
| CN | 101138457 | A | 3/2008 |
| CN | 201341650 | Y | 11/2009 |
| CN | 201379320 | | 1/2010 |
| CN | 201452382 | U | 5/2010 |
| CN | 201727183 | U | 2/2011 |
| CN | 201996026 | U | 10/2011 |
| CN | 202014890 | U | 10/2011 |
| CN | 202136017 | U | 2/2012 |
| CN | 102822224 | | 12/2012 |
| CN | 202604242 | U | 12/2012 |
| CN | 203016383 | U | 6/2013 |
| CN | 203328338 | | 12/2013 |
| CN | 105640152 | | 6/2016 |
| CN | 205548120 | U | 9/2016 |
| CN | 106617913 | A | 5/2017 |
| CN | 107307672 | A | 11/2017 |
| CN | 107432611 | A | 12/2017 |
| CN | 107455989 | A | 12/2017 |
| DE | 7037476 | U | 5/1971 |
| DE | 2708068 | A1 | 9/1978 |
| DE | 10238457 | A1 | 3/2004 |
| DE | 10300169 | A1 | 7/2004 |
| DE | 10311434 | | 9/2004 |
| DE | 202005016938 | U1 | 3/2007 |
| DE | 102007021312 | A1 | 11/2008 |
| DE | 102009044308 | A1 | 4/2011 |
| DE | 202010017223 | U1 | 8/2011 |
| DE | 10200805554964 | | 7/2014 |
| DE | 102010048357 | B4 | 2/2017 |
| DE | 112015005896 | T5 | 9/2017 |

(56) References Cited

FOREIGN PATENT DOCUMENTS

| | | | |
|---|---|---|---|
| EP | 1011391 | B1 | 10/2002 |
| EP | 1457139 | A1 | 9/2004 |
| EP | 1670338 | A1 | 6/2006 |
| EP | 1951089 | A2 | 8/2008 |
| EP | 1793707 | B1 | 10/2008 |
| EP | 1339369 | B1 | 1/2010 |
| EP | 2140847 | A2 | 1/2010 |
| EP | 1648269 | B1 | 11/2010 |
| EP | 2263498 | A2 | 12/2010 |
| EP | 2280627 | B1 | 10/2011 |
| EP | 2341800 | B1 | 11/2012 |
| EP | 2532278 | A1 | 12/2012 |
| EP | 2532281 | A1 | 12/2012 |
| EP | 2393399 | B1 | 3/2013 |
| EP | 2764799 | A2 | 8/2014 |
| EP | 1261265 | B1 | 7/2015 |
| EP | 2957191 | A1 | 12/2015 |
| EP | 2369959 | B1 | 8/2016 |
| EP | 3175739 | A1 | 6/2017 |
| ES | 2201183 | T3 | 3/2004 |
| ES | 2534286 | T3 | 4/2015 |
| ES | 2535762 | R1 | 6/2015 |
| ES | 2535762 | B1 | 4/2016 |
| FR | 2462931 | A1 | 2/1981 |
| FR | 2473291 | | 7/1981 |
| FR | 2475837 | A1 | 8/1981 |
| FR | 2622683 | A1 | 5/1989 |
| FR | 2641455 | A1 | 7/1990 |
| FR | 2671003 | A1 | 7/1992 |
| FR | 2715550 | A1 | 8/1995 |
| FR | 2759304 | A1 | 8/1998 |
| FR | 2835164 | A3 | 8/2003 |
| GB | 1572763 | | 8/1980 |
| GB | 1589567 | A | 5/1981 |
| GB | 1589568 | A | 5/1981 |
| GB | 2183471 | A | 6/1987 |
| GB | 2221387 | A | 2/1990 |
| GB | 2369569 | | 6/2002 |
| GB | 2489118 | A | 9/2012 |
| GB | 2458892 | B | 11/2012 |
| GB | 2500938 | A | 10/2013 |
| JP | H05123231 | A | 5/1993 |
| JP | H05146345 | A | 6/1993 |
| JP | H06190191 | A | 7/1994 |
| JP | 2002253388 | A | 9/2002 |
| JP | 2004329706 | | 11/2004 |
| JP | 2005000192 | | 1/2005 |
| JP | 2005160794 | A | 6/2005 |
| JP | 2014023967 | A | 2/2014 |
| JP | 6383771 | | 8/2018 |
| KR | 20110132025 | A | 12/2011 |
| KR | 101465852 | B1 | 11/2014 |
| KR | 101581722 | B1 | 1/2016 |
| KR | 20180031449 | A | 3/2018 |
| RU | 2268633 | C2 | 1/2006 |
| RU | 2607426 | C1 | 1/2017 |
| WO | 2000002516 | A1 | 1/2000 |
| WO | 2005032310 | | 4/2005 |
| WO | 2007060371 | A2 | 5/2007 |
| WO | 2013157534 | | 10/2013 |
| WO | 2014105687 | | 7/2014 |
| WO | 2016182795 | A1 | 11/2016 |
| WO | 2016182858 | A1 | 11/2016 |
| WO | 2017213732 | A1 | 12/2017 |
| WO | 2018089464 | A1 | 5/2018 |
| WO | 2019089830 | A1 | 5/2019 |

OTHER PUBLICATIONS

Notice of Allowance dated Jul. 12, 2019 for U.S. Appl. No. 29/641,393 (pp. 1-10).

The Casper Mattress, casper.com/mattresses/casper/, retrieved Aug. 27, 2019, 29 pages.

The Essential Mattress, casper.com/mattresses/casper-essential/, retrieved Aug. 27, 2019, 15 pages.

The Wave Mattress, casper.com/mattresses/casper-wave/, retrieved Aug. 27, 2019, 30 pages.

International Search Report, Written Opinion of ISA and Search History, PCT/US2015/026564, dated Aug. 31, 2015. (19 pages).

Communication from Thomas Petr received in PCT/US2015/026564, dated Feb. 27, 2016. (1 page).

Supplementary Partial European Search Report for EP 15 78 3835 (dated Nov. 14, 2017) (14 pages).

Dormia Website Existing at Least as Early as Jun. 14, 2008. (2 pages).

Specification and Build Sheet for Dormia Radiance Mattress dated Jun. 14, 2007. (2 pages).

Correspondence Regarding Distribution of Dormia Radiance Mattress, Authored by Classic Brands, LLC, dated Nov. 1, 2007. (1 pg).

Casper Pillow review. Sleepopolis. Published on Jan. 22, 2016. Website found at: https://www.youtube.com/watch?v=h4AhiXbEO3U. (15 pages).

Third-Party Submission Under 37 CFR 1.290 dated Jun. 14, 2016 in U.S. Appl. No. 14/689,945. (15 pages).

Third-Party Submission Under 37 CFR 1.290 dated Jun. 27, 2016 in U.S. Appl. No. 14/689,945. (11 pages).

Third-Party Submission under 37 CFR 1.290 mailed on Jun. 10, 2016 in U.S. Appl. No. 14/689,945. (9 pages).

Chewy Casper Memory Foam Dog Bed Aug. 28, 2017 [site visited Jan. 23, 2018] Available from Internet URL: <https://www.chewy.com/casper-memory-foam-dog-bed-medium/dp/155149>—(7 pages).

Groupon Water-Resistant Orthopedic Foam Pet Crate Mats, announced 2018 [online], [site visited Jan. 22, 2018] Available from Internet URL: <https://www.groupon.com/latest-deals/gg-waterresistant-orthopedic-fo- am-pet-crate-mats>. (2 pages).

Unboxing and Setting Up a Casper Dog Bed, announced Sep. 14, 2016 [online], [site visited Jan. 23, 2018] Available from Internet URL: <https://www.youtube.com/watch?v=fAEKTatzCTA> at approximately 0:48. (1 page).

The Casper Dog Mattress In-depth Review Demo, announced Feb. 15, 2017 [online], [site visited Jan. 23, 2018] Available from Internet URL: <https://www.youtube.com/watch?v=jRqVxs_M35g> at approximately 2:39. (1 page).

EZ Wash Fleece Lounger Poly-Filled Dog Bed, [site visited Jan. 23, 2018] Available from Internet URL: <https://www.wayfair.com/pet/pdp/3-dog-pet-supply-ez-wash-fleeceloung-er-poly-filled-dog-bed-dpsp1004.html?piid=18825537>. (3 pages).

Luca Crate Cuddler, announced Jul. 15, 2016 [online], [site visited Jan. 23, 2018] Available from Internet URL: <https://www.youtube.com/watch?v=4HeVQP2Z86E> at approximately 0:05. (1 page).

AmazonBasics Padded Pet Bolster Bed, accessed Sep. 16, 2016. (https://www.amazon.com/AmazonBasics-Padded-Pet-Bolster-Bed/dp/B00QHC06UO- ?ie=UTF8&keywords=dog%20bed&qid=1459134598&ref_=sr_1_11&refinements=p_n_fe- ature_keywords_two_browse-bin%3A8002501011%7C8002502011%7C8002503011&s=pet- -supplies&sr=1-11) (6 pages).

PetCo Sweet Dreams Rectangular Bolster Dog Bed , accessed Sep. 16, 2016 (http://www.petco.com/shop/en/petcostore/dog/dog-beds-and-bedding/dog-bed- s/sweet-dreams-rectangular-bolster-dog-bed) (2 pages).

Round Orvis Dog's Nest, accessed Sep. 16, 2016, (http://www.orvis.eom/p/round-orvis-dogs-nest/1h0I) (2 pages).

Frontgate Huggy Nest Pet Bed, accessed Sep. 16, 2016 (http://www.frontgate.com/huggy-nest-pet-bed/pet-products/pet-bedsblankets-throws/bolster-pet-beds/802099), (2 pages).

Petsmart K&H Classy Lounger Pet Bed , accessed Sep. 16, 2016. (http://www.petsmart.com/dog/beds/k-h-classy-lounger-petbed-zid36-26968/- cat-36-catid-100063?var_id=36-26968), (1 page).

Bowsers Super Loft Rectangle Avalon, accessed Sep. 16, 2016 (http://www.bowsers.com/pet-beds/super-loft-rectangle/superloft-rectangle-avalon.html) (1 page).

Petco K&H Deluxe Ortho Bolster Sleeper Dog Bed , accessed Sep. 16, 2016 (http://www.petco.com/shop/en/petcostore/dog/dog-beds-and-bedding/dog-bed- s/kandh-deluxe-ortho-bolster-sleeper-dog-bed-in-eggplant-withpaw-prints# (2 pages).

(56) References Cited

OTHER PUBLICATIONS

L.L.Bean Premium Denim Dog Bed Set, Rectangular, accessed Sep. 16, 2016 (http://www.llbean.com/llb/shop/44560?feat=507408-GN2&page=premium-denim-dog-bed-set-rectangular) (3 pages).
Amazon STAINMASTER Comfy Couch Pet Bed, accessed Sep. 16, 2016 (https://www.amazon.com/STAINMASTER-Comfy-Couch-Large-Olive/dp/B00LQZ18XQ?ie=UTF8&keywords=dog%20bed&qid=1459135646&ref =sr1 426&refinements=p n feature keywords two browse-bin%3A8002501011%7C8002502011%7C8002503011&s=pet-supplies&sr=126) (8 pages).
Jax & Bones Donut Bed, accessed Sep. 16, 2016 (https://www.jaxandbones.com/products/bedding/donut/licorice-donut-bed) (3 pages).
Petsmart Carolina Pet Orthopedic Comfort Couch, accessed Sep. 16, 2016. http://www.petsmart.com/dog/beds/carolina-petorthopedic-comfort-couch-personalized-pet-bed-zid36-5591/cat-36-catid-100063?var_id=36-5591) (2 pages).
Lux Premium Dog Bed, accessed Sep. 16, 2016 (http://godogbeds.com/product/sample-product-2/) (1 page).
Frontgate Urban Denim Lounger Pet Bed , accessed Sep. 16, 2016 (http://www.frontgate.(X)m/urban-denim-lounger-pet-bed/pet-products/pet-beds-blankets-throws/bolster beds/451775) (3 pages).
Bowsers Donut Bed, accessed Sep. 16, 2016 (http://www.bowsers.com/pet-beds/donut-beds/donut-bed-nickel-weave.html) (1 page).
L.L.Bean Premium Dog Couch, accessed Sep. 16, 2016 (http://www.llbean.com/llb/shop/66388?feat=507408-GN2&page=premium-dog-couch) (3 pages).
Jax & Bones Sleeper Bed, accessed Sep. 16, 2016 (https://www.jaxandbones.com/products/bedding/sleeper/tweed-cremesleeper-bed), (2 pages).
Orvis ToughChew Dog Bed with Polyester Fill, accessed Sep. 16, 2016 (http://www.orvis.eom/p/toughchew-rectangle-dogbed/0h4c) (2 pages).
Orvis Wraparound Fleece Dog Bed with Memory Foam, accessed Sep. 16, 2016 (http://www.orvis.com/p/wraparound-fleecedog-bed/2es4) (2 pages).
Orvis Deep Dish Dog Bed with Memory Foam, accessed Sep. 16, 2016 (http://www.orvis.com/p/deep-dish-dog-bed/2c9b) (2 pages).
Bowsers Urban Lounger, accessed Sep. 16, 2016 (http://www.bowsers.com/pet-beds/urban-lounger/urban-loungereverest.html- ) (1 page).
Doca pet Zz Bed, accessed Sep. 16, 2016 (https://www.docapet.com/product/zz-bed/) (2 pages).
Jax & Bones Memory Foam Bed, accessed Sep. 16, 2016 (https://www.jaxandbones.com/products/bedding/memory-foam/juniper-memory-foam-pillow) (2 pages).
Orvis Tempur-Pedic.RTM. Deep Dish Dog Bed, accessed Sep. 16, 2016. (http://www.orvis.com/p/orvis-tempur-pedic-deepdish-dog-bed/2gr6) (2 pages).
World of Angus Dog Bed, accessed Sep. 16, 2016, (http://worldofangus.com/collections/the-dog-bed-collection/products/thedog-bed) (4 pages).
Howlpot My Territory, accessed Sep. 16, 2016. (http://www.howlpot.com/product/detail.html?product_no=30&cate_no=1&displ- ay_group=2) (9 pages).
Love Thy Beast Flip Stitch Bed, accessed Sep. 16, 2016 (http://www.lovethybeast.com/collections/sleep/products/flip-stitchbed-grey-blacblack) (7 pages).
Shinola Dolostone Dog Bed, accessed Sep. 16, 2016 (http://www.shinola.com/shop/pet-accessories/dolostone-dogbed.html#color=Ashen%220Gray) (2 pages).
Ruffler Urban Sprawl, accessed Sep. 16, 2016 (http://www.ruffwearcom/Urban-Sprawl-Plush-Dog-Bed?sc=2&category=17) (2 pages).
Marlon Pilvi Cushion http://en.marlonshop.com/product/Pilvi-Cushion/50/?cate_no=1&display_group=2), accessed Sep. 16, 2016 (13 pages).
Japanese Office Action (with English language translation) for Application No. 2017-507687, dated Apr. 2, 2019, 9 pages.
DOWNLITE Downlite Dream Naturally 300 Thread Count Wool Down Comforter, accessed Jul. 13, 2017 (www.sears.com/downlite-dream-naturally-300-thread-countwool/)-0000000000000000205710000000000000362141 P?plpSellerId=Overstock.com&prdNo=12&blockNo=12&blockType=G 12) (4 pages).
Organic Wool Toddler Pillow, All Natural &100% GOTS Certified Pure Organic, Wool 'Pearls' accessed Jul. 13, 2017 (https://www.amazon.com/Organic-Certified-Antibacterial-Hypoallergenic-Toddlers/dp/B00P6SKT7K) (2 pages).
700 Fill Power Temperature Regulating Down Comforter accessed Jul. 13, 2017 (https://www.cuddledown.com/itemdy00.aspx?ID=70,3276&T1=Z1087+100+10+01) (12 pages).
Hobbs WL90 Count Batting Heirloom Wool, 90" x 108" accessed Jul. 13, 2017 (https://www.amazon.com/Hobbs-WL90-Count-Batting-Heirloom/dp/B0063G013G/ref=sr_1_9?e=UTF8&qid=1497374885&sr=8-9&keywords=wool+batting) (1 page).
10" Sewn-Thru Boxstitch PrimaSera Down Alternative Duvet Insert, Tc 230 accessed Jul. 13, 2017 (http://hotelsuppliesdepot.com/10-Sewn-Thm-Boxstitch-PrimaSera-Down-Alternative-DUVET-INSERTTc-230-j 409. html) (1 page).
Badenia 3649730149 Bettcomfort Steppbett, 4-Jahreszeiten, Micro Thermo, 155 x 220 cm, weiB accessed Jul. 13, 2017 (https://www.amazon.de/Badenia-Bettcomfort-03649730149-Jahreszeiten-Steppbett-Thermo/dp/B0026IBFN0/ ef=sr_1_5?=kitchen&ie=UTF8&qid=1460493398&sr=1-5) (1 page).
Ruffler Urban Sprawl http://www.rufrwear.com/Urban-Sprawl-Plush-Dog-Bed?sc=2&category=17), accessed Sep. 16, 2016 (2 pages).
Office Action and Search Report for China Patent Application No. 201580019495.5 (dated May 3, 2018) (12 pages).
Design Within Reach, Min Bed, http://www.dwr.com/bedroom-beds/min-bed/6348.html?lang=en_US) (accessed May 23, 2018) (19 pages).
Extended European Search Report issued in EP18192998.5, dated Nov. 20, 2018, 8 pages.
Howto set up your dog mattress, no date available (1 page).
Amazon Basics Padded Pet Bolster Bed (https://www.amazon.ram/AmazonBasi20bed&qid=1459134598&ref =sr 1 11&refinements=p n feature keywords two browse-bin%3A8002501011% 7C8002502011 %7C8002503011 &s=pet-supplies&sr=1 -11), accessed Sep. 16, 2016 (6 pages).
PetCo Sweet Dreams Rectangular Bolster Dog Bed http://www.petco.com/shop/en/pet(X)store/dog/dog-beds-an log-bed), accessed Sep. 16, 2016 (2 pages).
Bowsers Urban Lounger (http://www.bowsers.com/pet-beds/urban-lounger/urban-lounger-everest.html), accessed Sep. 16, 2016 (1 page).
Howlpot My Territory (http://www.howlpot.com/product/detail.html?product_no=30&cate_no=1&display_group=2), accessed Sep. 16, 2016 (9 pages).
Office Action dated Mar. 20, 2019 for U.S. Appl. No. 15/611,902 (pp. 1-16).
International Search Report and Written Opinion for PCT/US18/46573 dated Oct. 22, 2018, 23 pages.
International Search Report and Written Opinion for PCT/US19/12582, dated Apr. 25, 2019, 14 pages.
Canadian Patent Application No. 2,909,804, Office Action dated Oct. 18, 2019, 4 pages.
Office Action dated Apr. 9, 2020, for U.S. Appl. No. 29/610,852 (pp. 1-6).
Office Action dated Dec. 2, 2019 for U.S. Appl. No. 29/610,852 (pp. 1-7).
Office Action dated Mar. 16, 2020, for U.S. Appl. No. 15/677,387 (pp. 1-20).
Office Action dated May 6, 2020 for U.S. Appl. No. 15/872,737 (pp. 1-10).
Office Action dated Nov. 15, 2019 for U.S. Appl. No. 29/610,695 (pp. 1-7).
Office Action dated Nov. 15, 2019 for U.S. Appl. No. 29/610,820 (pp. 1-6).
Office Action dated Nov. 18, 2019 for U.S. Appl. No. 29/610,826 (pp. 1-7).
Corrected Notice of Allowability dated Aug. 26, 2020 for U.S. Appl. No. 29/610,852 (pp. 1-4).
DODOW "Product Guide" purchased 2018 (13 pages).
Fivefive S.A.S. "HOLI the Little Book to Sleep and Wake Up Bright" purchased in 2018 (6 pages).

(56) References Cited

OTHER PUBLICATIONS

Fivefive S.A.S. "Manual MULTILANGUAGE v2.1" Copyright 2013 (7 pages).
General Electric Company "C-Sleep" product packaging Purchase date unknown (2 pages).
General Electric Company Product Guide for GE Sol Lamp purchased 2018 (9 pages).
International Search Report and Written Opinion for App. No. PCT/US2020/043712, dated Oct. 14, 2020, 17 pages.
International Search Report, Written Opinion of ISA, PCT/US2019/12582 (dated Apr. 25, 2019) (14 pages).
Koninklijke Philips N.V. "Philips HealWell White paper" 2014 (12 pages).
Koninklijke Philips N.V. "Philips Lighting University—Connecting LEDs a Quick Reference Guide" 2014 (77 pages).
Lighting Science "Awake & Alert Biological lights" LED-product packaging Purchase date unknown (3 pages).
Notice of Allowance dated Apr. 2, 2020, for U.S. Appl. No. 29/667,664 (pp. 1-5).
Notice of Allowance dated Apr. 30, 2020 for U.S. Appl. No. 29/667,664 (pp. 1-4).
Notice of Allowance dated Jul. 2, 2020 for U.S. Appl. No. 15/677,387 (pp. 1-9).
Notice of Allowance dated Jul. 29, 2020 for U.S. Appl. No. 29/610,852 (pp. 1-7).
NOX "User Manual for Smart Sleep Light Sleepace" (12 pages).
Office Action dated Feb. 10, 2020, for U.S. Appl. No. 16/241,665 (pp. 1-10).
Office Action dated Nov. 29, 2019 for U.S. Appl. No. 29/667,664 (pp. 1-7).
Office Action dated Oct. 5, 2020 for U.S. Appl. No. 16/241,665 (pp. 1-13).
Pablo Design "UMA Setup Guide & Owners Manual" purchased 2017 (8 pages).
Philips "Hue Personal Wireless Lighting Get started with Philips Hue" brochure purchased 2017 (6 pages).
Philips "Hue Personal Wireless Lighting" pamphlet Purchased 2017 (2 pages).
Philips "Wake-up Light" product packaging Purchase date unknown (1 page).
Philips Lighting Holding B.V. "Hue Personal Wireless Lighting" product packaging 2016 (2 pages).
Philips Lighting Holding B.V. "User manual" Jan. 30, 2017 (2 pages).
Twist Product Guide purchased 2017 (2 pages).
UP Light Corp. "Smart Wake UP Light" product packaging Purchase date unknown (2 pages).
Wout van Bommel, at al., Koninklijke Philips Electronics N.V. "Lighting Hardware" Copyright 2011 (107 pages).
Notice of Allowability dated Dec. 9, 2020 for U.S. Appl. No. 29/703,367 (pp. 1-3).
Office Action dated Dec. 15, 2020 for U.S. Appl. No. 16/102,649 (pp. 1-17).
Notice of Allowance dated Nov. 9, 2020 for U.S. Appl. No. 29/700,264 (pp. 1-8).

* cited by examiner

Side view

Top view

TEMPERATURE-REGULATING MATTRESS

REFERENCE TO PRIOR APPLICATIONS

This application claims the benefit of the following five applications, each of which is hereby incorporated by reference in its entirety:

1) U.S. Provisional Application Ser. No. 62/661,623 filed on Apr. 23, 2018;
2) U.S. Provisional Application Ser. No. 62/686,653 filed on Jun. 18, 2018;
3) U.S. Provisional Application Ser. No. 62/738,782 filed on Sep. 28, 2018;
4) U.S. Provisional Application Ser. No. 62/753,032 filed on Oct. 30, 2018; and
5) U.S. Provisional Application Ser. No. 62/808,299 filed on Feb. 21, 2019.

FIELD OF THE DISCLOSURE

The present disclosure relates generally to an improved mattress system with an ability to provide a dynamic responsive environment for its user or users.

BACKGROUND

The majority of people experience disruptions to their sleep due to temperature problems at least a few nights a month. Existing solutions (such as air conditioning, ceiling fans, room heaters, open windows and the like) are not effective for temperature regulation during sleep. There is therefore a need for an improved method to provide a comfortable sleeping experience by dynamically maintaining the proper temperature during the sleep cycle.

SUMMARY

A temperature-regulating mattress system provides dynamic adjustment of temperature throughout a user's sleep cycle to maximize the quality of the user's sleep, Features of the system may include: (a) heating and cooling temperature regulation (with dynamic custom profiles that control humidity and are dual-zone); (b) smart controls (with remotes and apps that learn from users to optimize settings and work with smart home products such as Alexa and interactive lighting systems); (c) comfort (with a mattress that provide the necessary support for its users); and (d) sensors used for temperature and humidity estimation algorithms, control mechanism, and additional inferences from those sensors (pose, enrichment of biometric sensing data, etc.).

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention and explain various principles and advantages of those embodiments.

Figure 1A:
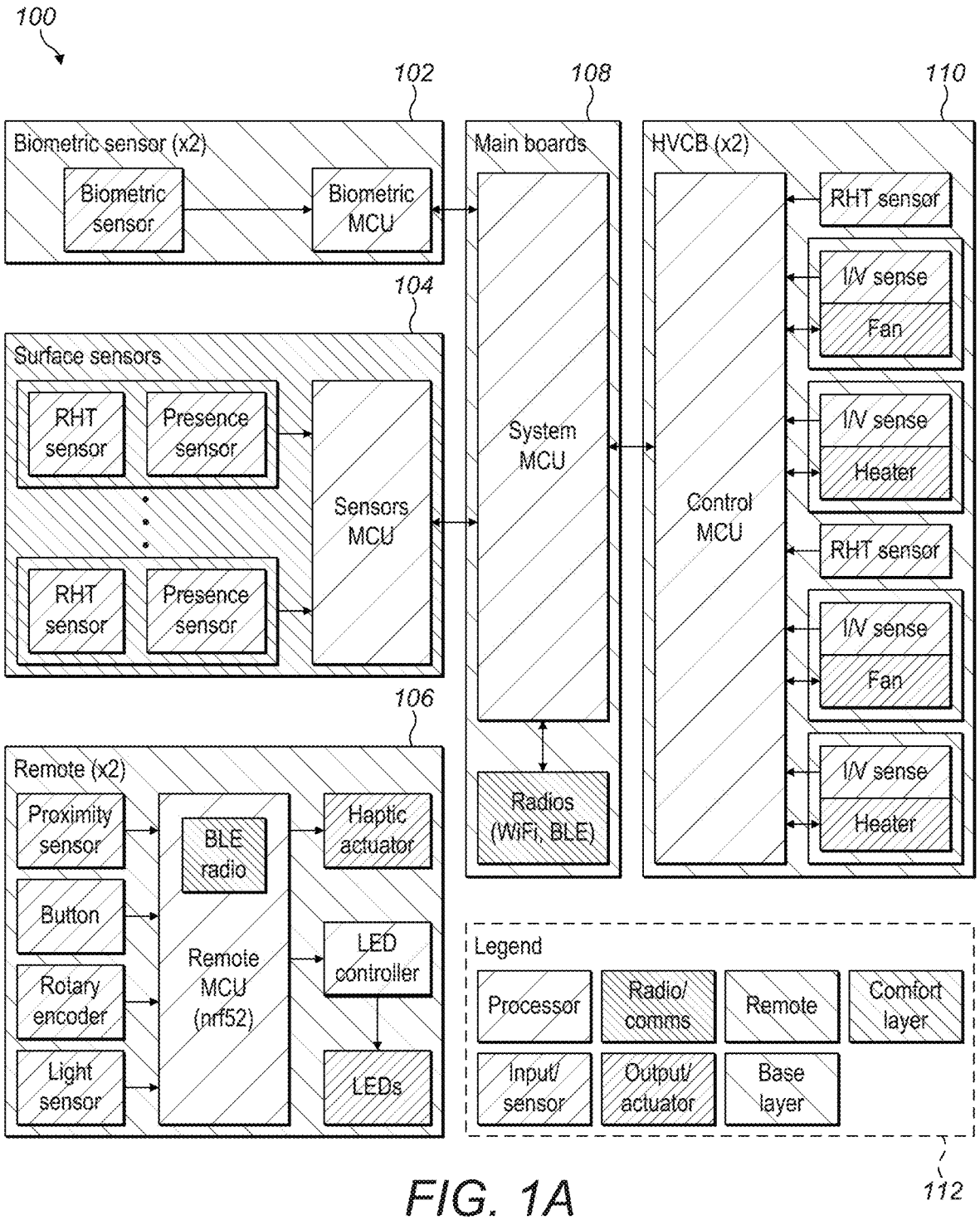
FIG. 1A shows a functional diagram of the temperature-regulating mattress system.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be clear to those of ordinary skill in the art having the benefit of the description herein.

DETAILED DESCRIPTION

I. Introduction

Devices and algorithm for determining and controlling temperature experienced by users under blankets in bedding may be deployed. Sensors positioned at the mattress surface are used in conjunction with a controls model for bedding to estimate and control user experienced temperature, humidity, and position on the bed. This includes devices being used for temperature and humidity estimation algorithms, control mechanism, and additional inferences from those sensors (pose, enrichment of biometric sensing data).

A variety of approaches may be used to sense temperature, humidity, and body pose at the surface of a mattress. Considered here are wireless surface sensors, as well as wired sensors and smart fabrics. A wireless surface sensor consists of a battery, antenna, temperature and humidity sensors, and a capacitive sensor. The surface sensor measures temperature and humidity using sensor mounted under metal grill. It uses the metal of the grill for capacitive sensing of human presence above the sensor, as well as for improved thermal contact to the sensed environment. It broadcasts temperature, humidity, capacitive presence (sensor payload) to controller at regular interval.

Surface sensors may be placed on a mattress or in holes on surface of mattress under mattress cover and fitted sheet.

Surface temperature, humidity, or presence sensors may also be implemented as a wired solution, or with smart fabrics.

A temperature control unit receives data (wired or wirelessly) from surface sensors, as well as from sensors measuring ambient air temperature and humidity. Based on this data received, the temperature control unit can control the amount and temperature of air added to the user's experienced temperature (blanket microclimate). The technology could apply to other methods of heating user's experienced temperature, including heated fabrics or foam.

Temperature and humidity directly measured from the surface sensor devices is not the same as what the user in the blanket microclimate is experiencing. Depending on blanket types, how well the blanket covers the mattress, how much heat or humidity the user is generating, and ambient conditions, temperature measured at the mattress surface may vary as much as 5-7° C. from the user-experienced temperature.

To estimate the user-experienced temperature, a temperature control unit estimates various thermal parameters of the bed. The device maintains a model of the bedding environment and continuously calibrates itself to best estimate the value of these various thermal resistances and capacitances. By estimating the value of these thermal parameters, the model can maintain an estimate of the user's experienced temperature. The device maintains a state-space model of the mattress and uses parameter identification techniques to estimate bedding parameters.

Mattresses that accommodate two users can incorporate airflow or heat flow across two zones of the mattress into their models for control to control two separate zones of user experienced temperatures.

Processing on data from surface sensors that allows system to estimate user's poses on the bed, which can be used to inform other algorithms and enrich other sensing data. The sensor knows when a body is in direct contact and can reject or adjust temperature readings as needed based on this information.

Smart bed, heating and cooling bed, use with algorithms that can incorporate temperature user experiences in bed, user pose on bed to improve readings of other signals from users, and for controlling temperature precisely enough to improve sleep.

The key physics being taking advantage of is that dynamics of the bed thermal system are governed by a set of differential equations with parameters corresponding to the amount of heat added by the user, the thermal resistance of the blanket (such as, is it thick or thin). Since it is known what heat is being input to the system from our temperature control unit, it is possible to use the shape of the heating or cooling curves measured at the surface sensors to estimate the parameters of the differential equations. The differential equation-based model of the system may be used to control its temperature.

Based on the model's prediction of the microclimate temperature, the control algorithm adjusts heat and blower parameters to achieve a tight degree of temperature control (within a degree or so), which is required to provide precise comfort profiles through the night that might improve a user's sleep.

The control algorithm is also able to consistently update the parameters it's measuring about the state of the bed through the night to account for user's disruption of blankets, introduction of ambient air into the microclimate, or other changes to the environment that might occur overnight. In this way, the control algorithm is robust to the way the user sleeps.

The surface sensors also measure humidity. The control algorithm estimates offset between surface measured humidity and user experienced humidity, and uses that information to help control humidity to within a comfortable band for the user.

The surface sensors also measure capacitive presence above them. If a sleeper is above the surface sensor, the capacitive presence may be used to reject the temperature measured by this sensor (offset by the user's body temperature in this case).

The surface sensor capacitive presence measurements may be used to estimate the pose of the user on the bed. This pose may be used to inform other algorithms in the device. For example, if there is a contactless heart monitoring system operating concurrently with the temperature and humidity control algorithm, pose sensing on the bed might help separate two user's heartbeats by assessing what relative strength of signal to expect from each user at various locations.

Further, devices and algorithm are described herein for introducing temperature interventions to improve sleep onset, depth, and wake inertia by measuring biometric signals, including heart rate, breathing rate, brain activity, motion, and/or temperature. Various temperature interventions are controlled, in part, by biometric sensors and algorithms estimating the user's state (for instance core body temperature, sleep stage) to provide the optimal temperature at the optimal time (comfort profile). Over time, the algorithm can learn what comfort profiles improve sleep onset, sleep depth, and wake inertia for a particular user.

Smart mattress control user experienced temperature in blanket microclimate (possibly with independent control of chest and feet), and measures motion, heart rate and respiration rate, amongst other biometric signals. Measurements of these various biometric signals can be through ballistocardiography performed from under-mattress, in-mattress, or in-mattress-cover, or through smart fabrics, wearables, radar, camera, or other sensing mechanisms.

Core body temperature reduction has been shown to be important to the onset and depth of sleep. Sleep stage has been shown to be important to the body's thermal regulation ability. For instance, during REM sleep, the body isn't able to thermoregulate. Various thermal interventions (changes to user's experienced temperature under the blankets) can be used to manipulate core body temperature and enhance sleep.

The algorithms use biometric sensing data (motion, heart rate, and respiration rate) to estimate core body temperature and sleep stage. Temperature interventions are adjusted real-time based on the sensor and algorithm outputs.

By manipulating user's experienced temperature (through foot warming, skin warming, and other temperature profiles), the device can use the sensor and algorithm output to confirm that its temperature therapy is helping the user drop and maintain a low core body temperature through the night. Temperature therapy can be adjusted based on biometric feedback to do this. Wakes might be predicted by observing motion, heart rate, or sleep stage. Temperature profiles can be adjusted during the night to prevent those wakes or lull the user back to sleep once they awake.

Algorithms may control temperature experienced by a user in order to reduce sleep latency (fall asleep faster), stay asleep longer (fewer wakeups), sleep more deeply (more REM+ Slow Wave Sleep), and nudge users into a shallower phase of sleep in time for their desired wakeup time.

The algorithm may run on an ecosystem of products that provide lighting, temperature, sound, and other therapies to improve sleep dynamically—they respond to sensors that are also distributed in the ecosystem. Sensors in the ecosystem measure experienced temperature and humidity, light exposure, heart rate, respiration rate, and other signals.

Algorithms can tune lighting, temperature, sound, and other therapies based on sleep quality observed from sensed data.

Smart bed, heating and cooling bed, use with algorithms that can incorporate temperature user experiences in bed, Helping normal users with thermoregulation to help them sleep, helping users with circulation problems (obesity, diabetes, etc.) and other sleep issues with thermoregulation to help them sleep, use of other ecosystem products (temperature, light, sound control before, during, and after sleep) to improve sleep with biometric sensing in the mattress as a feedback mechanism to tailor therapies.

The present devices may use independent temperature control at the torso and feet through the night to try to improve sleep. A naive temperature profile delivered by a control device might provide warmth as the user is falling asleep, cool the user while they're asleep to prevent night-time wakes, and warm the user up before wakeup.

The algorithm uses biometrics data to improve on this naive temperature control profile. Application of a temperature profile (heating feet, for instance) is intended to aid the body's normal thermoregulatory process during the night. This includes cooling down core body temperature during sleep onset, maintaining lowered core body temperature through the night, and increasing core body temperature before wake.

There is evidence that poor thermoregulation is implicated in poor sleep for diabetics, the obese, patients who suffer from Raynaud's disorder, and other circulatory and sleep issues. There is evidence that normal sleepers thermoregulatory process can be impacted by food and alcohol consumption before bed, or by hormonal cycles. Users whose thermoregulatory function is changed may need a temperature intervention to assist in falling asleep, staying asleep and waking up.

This thermoregulatory process can be tracked by watching a user's heart rate. As core body temperature decreases at the beginning of the night and increases at the end of the night (corresponding to metabolism rate decrease and increase), heart rate also increases and decreases. Heart rate data can be used to measure the impact of the temperature intervention and to adjust the temperature accordingly in real time.

Sleep staging data teased out from heart rate, respiration rate, motion, EEG, or eye movement detection can be used to assess quality or depth of sleep night for night, and use machine learning to optimize sleeping temperatures per user.

To help users fall asleep, foot warming or other temperature profiles may be used. In real time, the profiles watch their heart rate to make sure it is dropping as expected (corresponding to core body temperature decline).

Once the heart rate, respiration rate, and motion tracker detect that the user has fallen asleep, the next phase of temperature therapy begins.

While the user is asleep, the heart rate, respiration rate, and motion are used to predict when a user may wake up during the night. The same foot warming or other falling-asleep therapy applied to the user to help lull them back to sleep can be used.

Temperature profiles during the night that increase slow wave and REM sleep may be used. The algorithm measures how much slow wave and REM sleep was experienced per night and optimize sleep temperature profile night for night to increase this deeper sleep.

Finally, the heart rate may be used to track increasing core body temperature through full body warming in the time before the user has to wake up. The sleep stage is monitored to ensure the user is nudged out of deep or slow wave sleep.

This same concept of tracking heart rate, respiration rate, and motion through the night, tying them to core body temperature and sleep stage through the night, and tuning interventions like temperature during the night, can be applied to all products intended to help sleep. This includes light therapy, sound masking, and various mattress and blanket product choices (firmness, ergonomics, thermal and humidity performance of bedding). All of these products can be adjusted to improve sleep depth and quality, with biometric sensing as a feedback mechanism.

Biometric and other data that might be relevant as a marker for sleep quality (phone use, light exposure, diet, alcohol consumption) can be collected from an ecosystem of sleep sensors, as well. Interventions from a sleep ecosystem could include (in additional to temperature, light, and sound interventions) sleep coaching, diet recommendations, bedding recommendations. In this way a platform for sleep might be created amongst a wide variety of devices and data sources.

While various embodiments discussed herein show wireless and wired functionality in specific areas, any wired connection may function via a wireless connection and vice versa. In addition, any discussion of Bluetooth may include any other wireless protocol (including Wi-Fi), whether existing now or in the future. Further, any Bluetooth (or other wireless) node shown herein may operate as either a master or slave as appropriate.

In addition, the mattresses discussed herein may be of any size, including without limitation: twin, full, queen, king, California king and extra-long (of any size).

In addition, for a 2-user mattress, the features described herein may be independently adjusted to provide different experiences for each user.

Turning to a more detailed description, the various features of this temperature-regulating mattress may be classified into seven overall categories: System, Sensor, Cover, Base, Airbox, Airflow and Remote. Each will be discussed in turn.

II. System

The scope and functionality of the temperature-regulating mattress system taken in the aggregate is described herein.

Turning to FIG. 1A, shown us a functional diagram of the temperature-regulating mattress system 100. A legend 112 shows the various parts of this system: processor, radio/comms, input/sensor, output/actuator, remote, comfort layer and base layer.

A main board 108 comprises a system microcontroller unit (MCU) that provides overall governance of the system and communicates with other components through a Wi-Fi or Bluetooth radio. Two high voltage control boards 110 (HVCBs) comprise a control MCU that provides governance of the control boards and connects to the system MCU. The control MCU also interfaces with a plurality of relative humidity (RHT) sensors and current and voltage (I/V) sensing systems associated with either a heater or a fan. Two biometric sensors 102 comprise a biometric sensor and a biometric MCU that provides governance of the biometric sensor and connects to the system MCU. A plurality of surface sensors 104 comprise a sensors MCU that provides governance of a plurality of RHT sensors and presence sensors. Two remote systems 106 comprise a remote MCU that provides governance of the remote and communicates with the rest of the system via a Bluetooth radio. The remote MCU has inputs comprising a proximity sensor, button, rotary encoder and light sensor. The remote MCU outputs to a haptic actuator and a LED controller that drives LEDs.

Figure 1B:
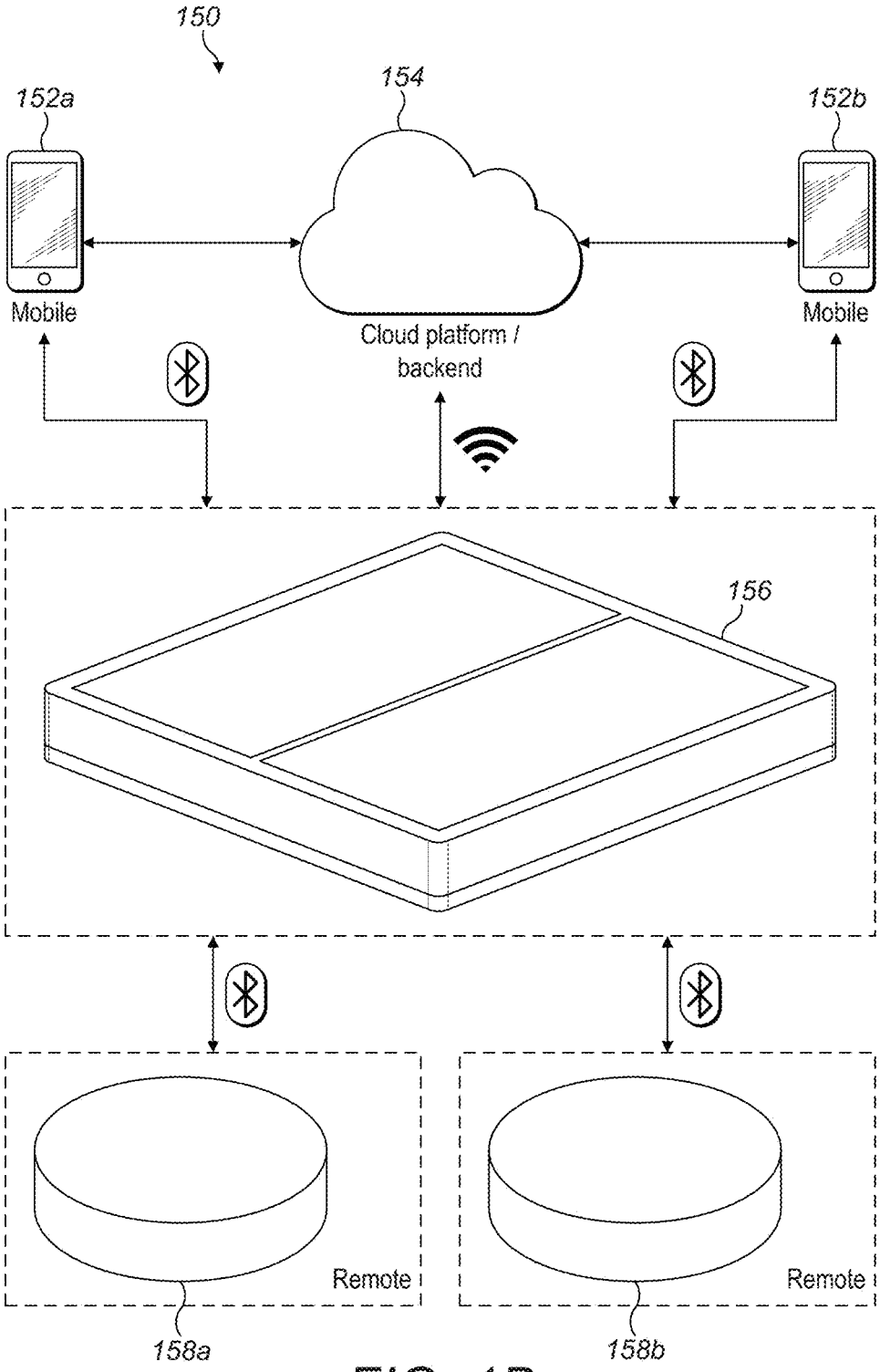
FIG. 1B shows a block diagram of the temperature-regulating mattress system.

Turning to FIG. 1B, shown is a block diagram of the temperature-regulating mattress system 150. A mattress 156 coordinates via Bluetooth with two mobile devices 152*a*, 152*b*, a cloud platform/backed 154 and two remotes 158*a*, 158*b*.

Although these figures show specific numbers of devices and specific types of radio communication, any number of devices and radio communication types may be used.

Figure 2:
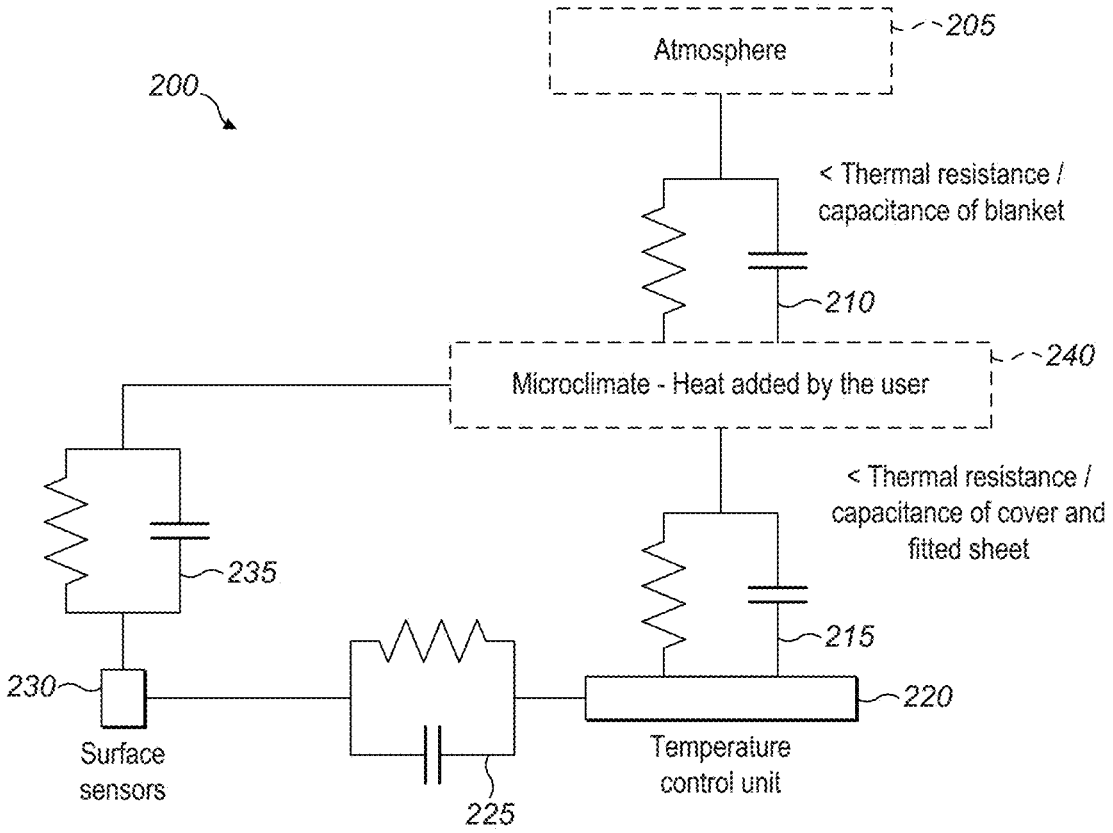
FIG. 2 shows a thermal diagram of the temperature-regulating mattress system.

Turning to FIG. 2, shown is a thermal model 200 the temperature-regulating mattress system. At the top of the thermal model 200 is the atmosphere 205 followed by the resistance/capacitance a of blanket 210. This combined with the heat added by a user comprises a microclimate 240 that sits above the mattress and below the blanket. Additional resistance/capacitance 215 of the cover and fitted sheet below the user is associated with a temperature control unit 220 (airbox). Surface sensors 230 sit in between the matter and mattress cover.

The capacitor/resistor pair 225 models the thermal relationship between the airbox (temperature control unit 220) and the location of the surface sensors 230. In other words, how is the temperature of air coming out of the airbox affecting the temperature at the surface sensors due to convection/conduction/radiation between them?

The capacitor/resistor pair 235 models the thermal relationship between the temperature in the micro-climate (air under the covers that the user is in) and the temperature at the surface sensors (which are separated from the micro-climate by several layers of fabric, and therefore do not read the micro-climate temperature directly). Determining the parameters for these interfaces (e.g. how much does the temperature change between the two environments, or in other words how much thermal resistance is there between them) enables a good estimate of the micro-climate temperature from the temperature measured at the location of the surface sensors.

Figure 3:
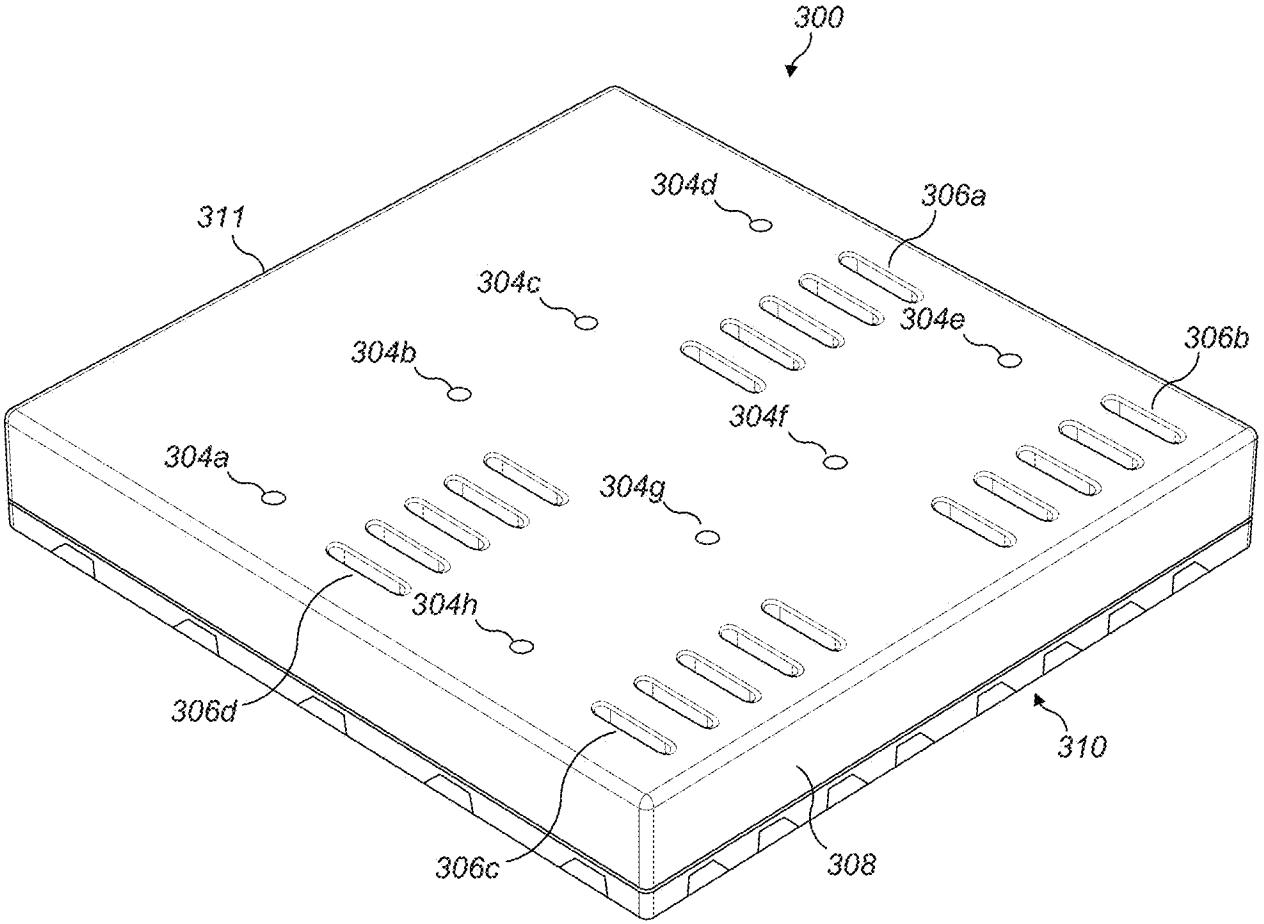
FIG. 3 shows a temperature-regulating mattress system having integrated sensors.

Turning to FIG. 3, shows a temperature-regulating mattress system having integrated sensors 300. This comprises a mattress 308 having a hidden base layer 310 on the bottom and a transparent mattress cover 311 on the top. Surface sensors 304*a*-304*h* and ventilation cuts 306*a*-306*d* are incorporated within the mattress 308. The surface sensors 304*a*-304*h* may include temperature, humidity and user presence sensors that are integrated into the mattress cover and are designed to be roll-packed. The ventilation cuts 306*a*-306*d* cut through the comfort layer near the torso and fee to allow air to distribute through the mattress.

The hidden base layer 310 is hidden by a fabric cap on a comfort layer and may be of any relevant size and shape. The transparent mattress cover 311 may have varying levels of opacity.

Figure 4A:
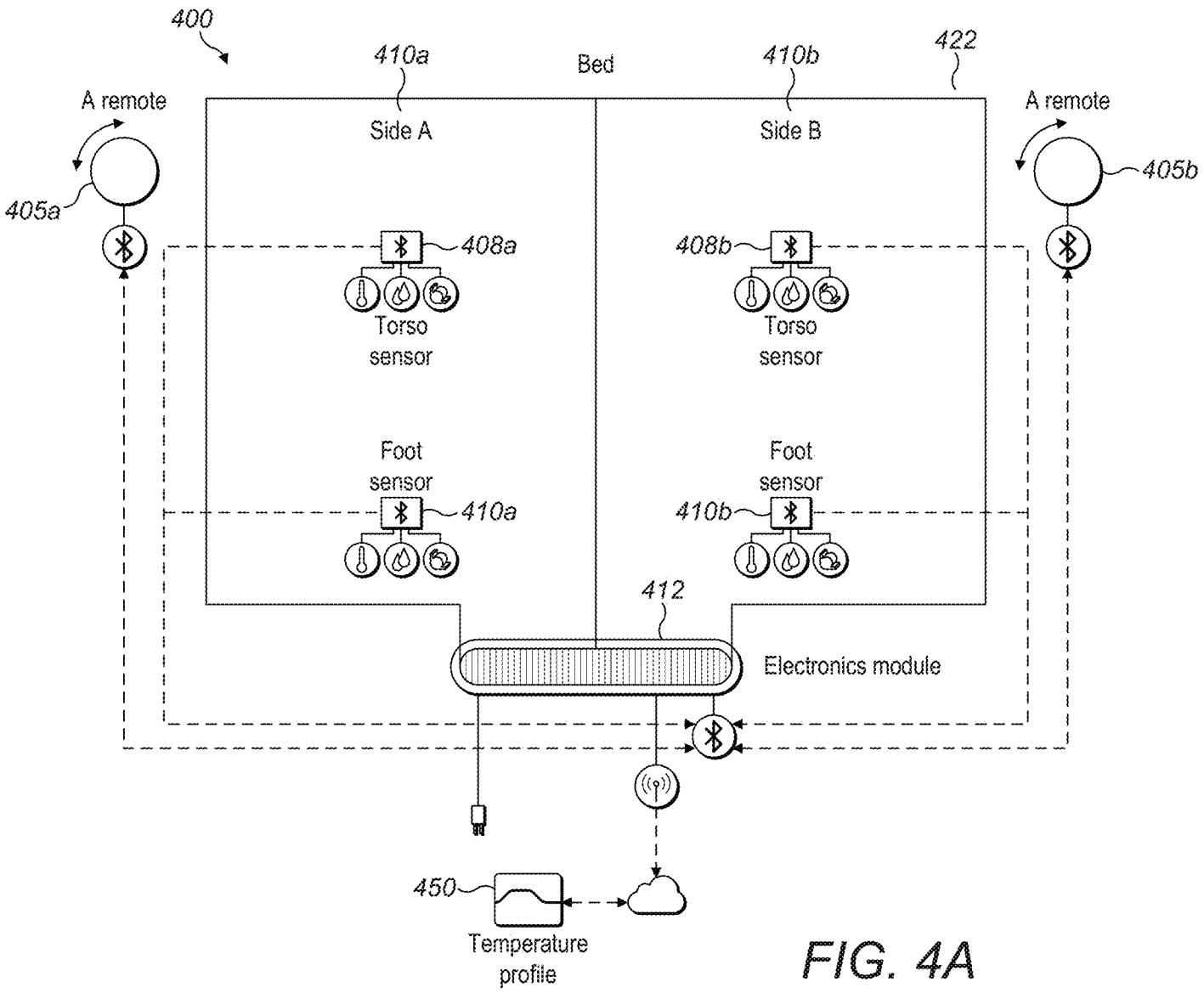
FIG. 4A shows a wireless communication path diagram of a temperature-regulating mattress system.

Turning to FIG. 4A, shown is a wireless communication path diagram 400 of a temperature-regulating mattress system. The mattress 422 is divided into two parts, side A 410*a* and side B 410*b*. Two consoles/remotes/user input devices 405*a*, 405*b* communicate with an electronics module 412 via Bluetooth. The electronics module 412 communicates through the cloud to wirelessly store and retrieve temperature profiles 450. The electronics module 412 may include fans, heaters, coolers, printed circuit boards and may be removable for servicing.

Based on the input of the console/remotes/user input devices 405*a*, 405*b* and the temperature profiles 450, the electronics module 412 interfaces with foot sensor groups 410*a*, 410*b* and torso sensor groups 408*a*, 408*b*. Each of the sensor groups communicates via Bluetooth with the appropriate temperature, relative humidity and pressure sensors. The sensors also may measure movement, presence, heart rate and breathing rate.

Although this FIG. 4A shows a wireless system, one or more portions of the system may be wired. Additional sensors may be placed within the mattress 422 as warranted. And although the electronics module 412 is shown at the foot of the bed 422, airboxes may be integrated in the foot and torso portions of the bed 422 (or other portions).

Figure 4B:
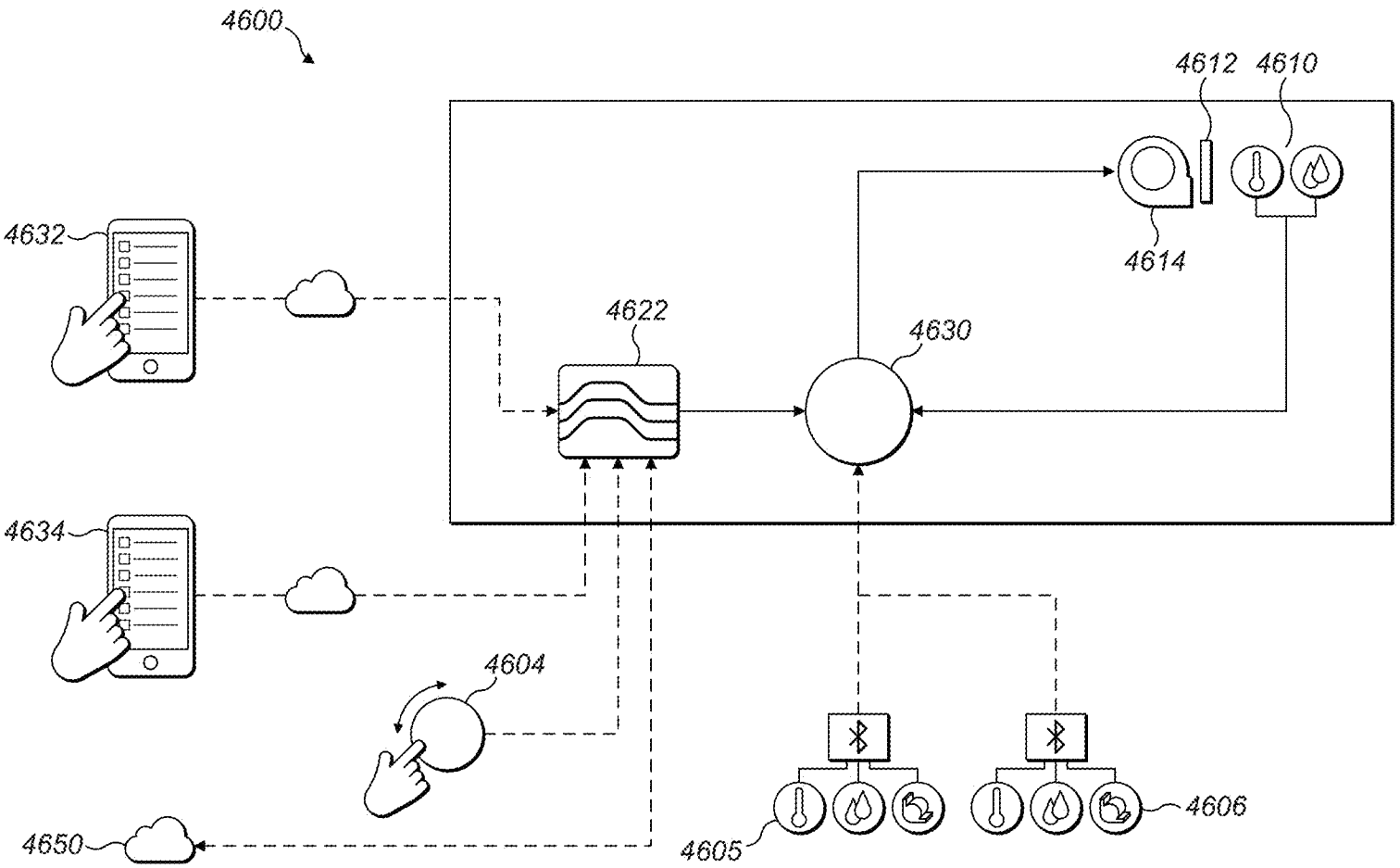
FIG. 4B shows a wireless communication path diagram of an app controlling a mattress system.

Turning to FIG. 4B, shown is a wireless communication path diagram of an app controlling a mattress system 4600. Comfort profile storage 4622 interfaces with cloud storage 4650, a remote 4604, an onboarding portal 4632 and a feedback portal 4634 and a mattress hub 4630.

The onboarding portal 4632 is designed to collect data about the user before the user goes to sleep. The data may include the user's gender, age, weight, sleep pattern, sleep location, desired temperature, desired relative humidity and the like. The onboarding portal 4632 may be used to control sleep parameters through the sleeping process. The remote 4604 may also be used during the sleep period to adjust sleep parameters through the sleep process. The advantage of the remote 4604 over the outboarding portal 4632 is that the remote 4604 only requires simple actions such as a push, twist or gesture to control the sleep parameters. This allows the user to easily and quietly adjust parameters throughout the sleep period without having to boot up an onboarding portal 4632 on a phone, tablet or other portable device.

At the end of a sleep period, a user may use a feedback portal 4634 to report on the quality of sleep, the temperature, the humidity and other parameters during the sleep period. This data is reported to the comfort profile storage 4622 to update the user profiles as appropriate.

The hub 4630 may also interface wirelessly with sensor groups 4605, 4606 having temperature, relative humidity and pressure sensors. The hub 4630 may interface with heaters 4612 and fans 4614 in the mattress system and their related exhaust temperature and humidity sensors 4610.

Although both onboarding portal 4632 and feedback portal 4634 are shown routing through cloud, one or both of portals may connect directly to a mattress control main board via Bluetooth/Wi-Fi/wireless or wired connection.

FIGS. 5, 6, 7 and 8 show exploded views of a temperature-regulating mattress system.

Figure 5:
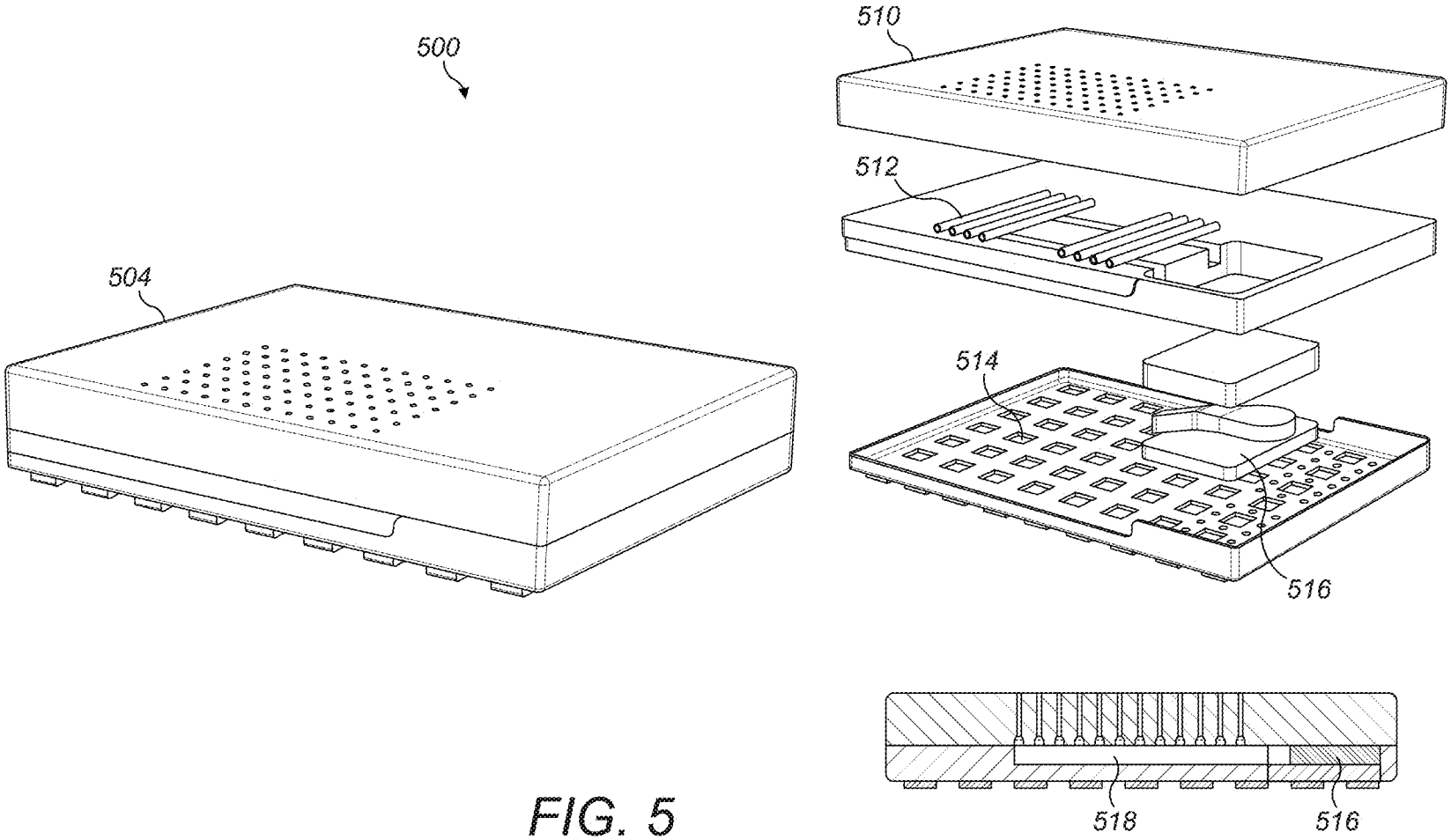
FIGS. 5, 6, 7 and 8 show exploded views of a temperature-regulating mattress system.

Turning to FIG. 5, shown is an exploded views of a temperature-regulating mattress system 500. On the left is an unexploded mattress view. On the right side, an exploded view shows a comfort layer 510 on the top, followed by comfort layer stiffness adjusters 512, followed by a base layer 514. The comfort layer stiffness adjusters 512 may be flexible structures made from foam, rubber, gel or other flexible materials. They may also be air permeable to aid in air distribution. The base may form protrusions from air paths between the mattress and bed frame or foundation.

Sandwiched between the comfort layer 510 and the base layer 514 is an electronics module 516. The electronics module 516 may include fans, heaters, printed circuit boards and may be removable for servicing.

A side view of a cross-section of a mattress system shows the electronics module 516 and an air distribution system 518 for distributing the air throughout the mattress. The system may be either incorporated into foam as molded or cut channels or a separately molded part that is inserted into a cavity under the comfort layers.

Figure 6:
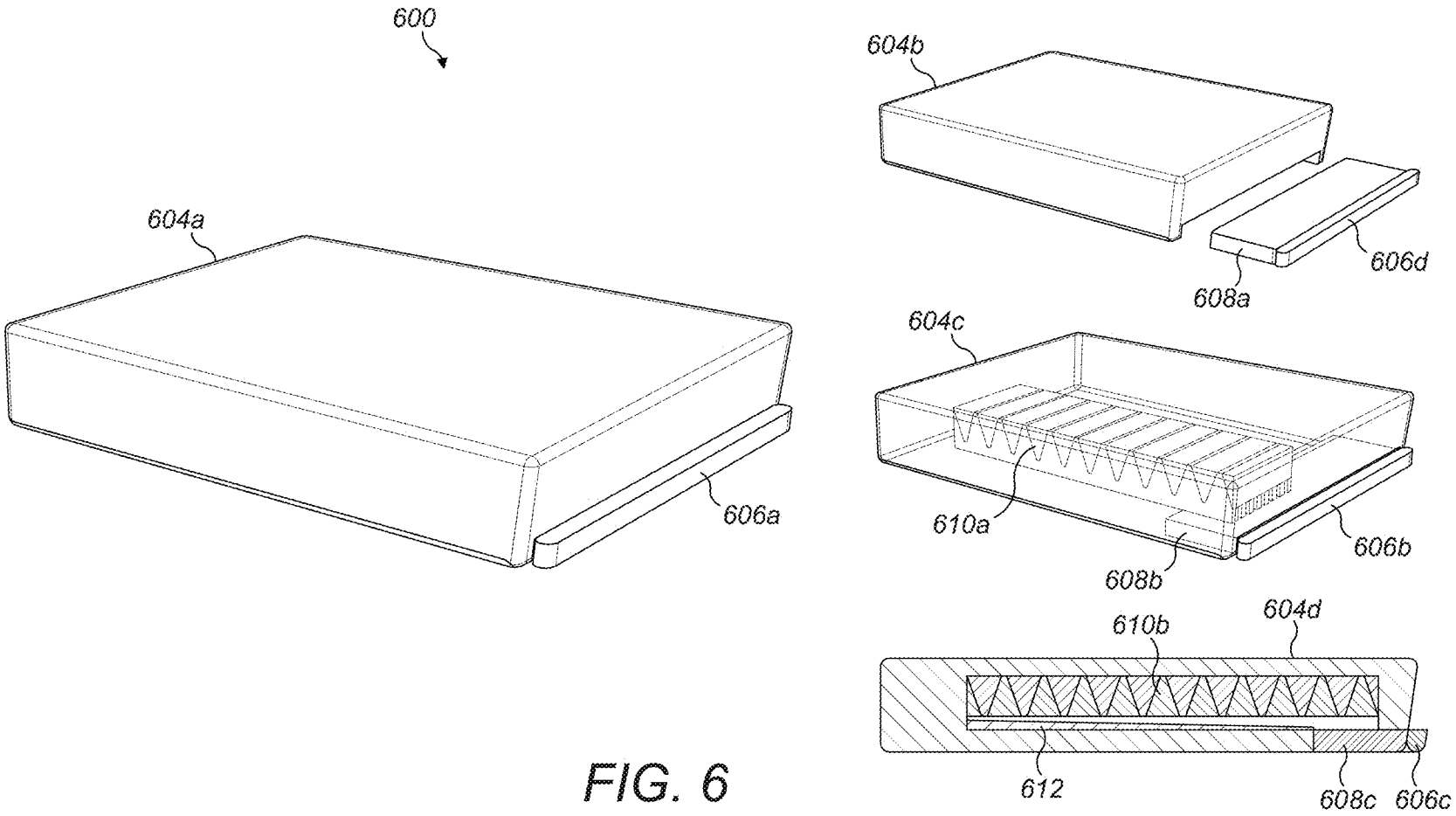

Turning to FIG. 6, shown are various views of a temperature-regulating mattress system 600. On the left is a complete mattress view 604*a* with the air intake module 606*a* jutting out. On the top right, the complete mattress view 604*b* is shown with the combined electronics module 608*a* and air intake module 606*d*. This may include fans, heaters, printed circuit boards and may be removable for servicing.

On the middle right and bottom right shown is a semi-transparent mattress in a perspective view 604*c* and side view 604*d* with the combined electronics module 608*b*, 608*c* and air intake module 606*b*, 606*c* in its place on the bottom of the mattress 604*c*, 604*d*.

The views also show comfort and diffusion materials 610*a*, 610*b* along with a distribution layer 612 below those materials. The comfort and diffusion materials 610*a*, 610*b* may be air permeable materials diffuses and distributes air delivered by the distribution layer 612. The distribution layer 612 may be either incorporated into foam as molded or cut channels or a separate part that is inserted into cavity under comfort layers.

Figure 7:
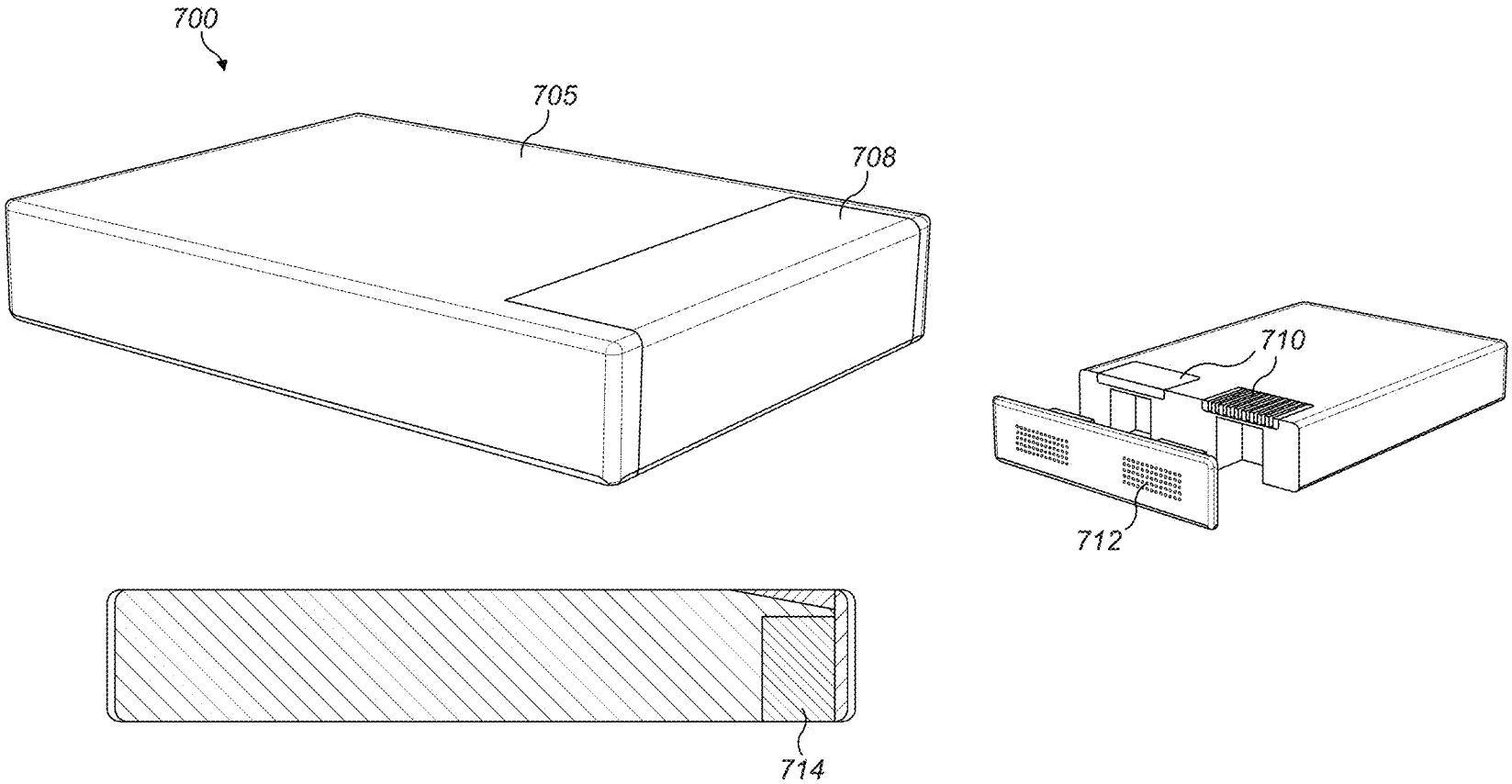

Turning to FIG. 7, shown are various views of a temperature-regulating mattress system 700. On the left is a complete mattress with a comfort cover top 705 and an air permeable cover top 708. On the bottom shown is the placement of electronics module 714. This may include fans, heaters, printed circuit boards and may be removable for servicing.

On the right shown is the placement of air intake 712 and diffusion materials 710 that may be air permeable material that diffuses and distributes air.

Figure 8:
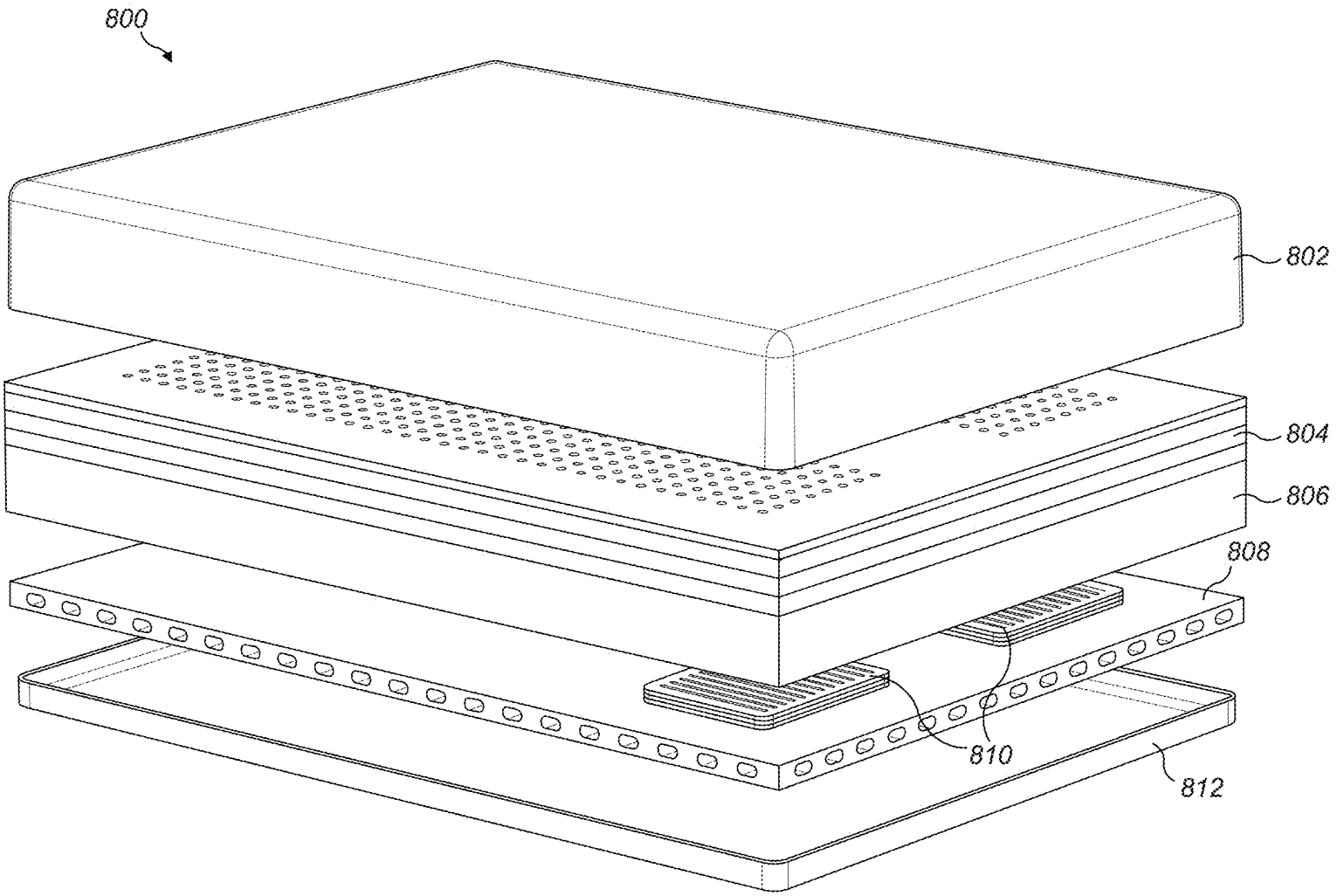

Turning to FIG. 8, shown is a complete mattress exploded view 800. The top layer is a cover top 802, followed by a series of comfort layers 804, followed by a distribution layer 806, followed by an intake layer 808 and followed by a cover bottom 812. Installed on the intake layer 808 are electronic modules 810 that may include fans, heaters, printed circuit boards and may be removable for servicing.

The cover top 802 may be comfortable and air permeable. The distribution layer 806 may be either incorporated into foam as molded or cut channels or, alternatively, be a separate part that is inserted into a cavity under comfort layers. The intake layer 808 may be about 2 inches in height and consist of flexible, structural impermeable materials with air channels. The cover bottom 812 may have air permeability and be durable.

Figure 9:
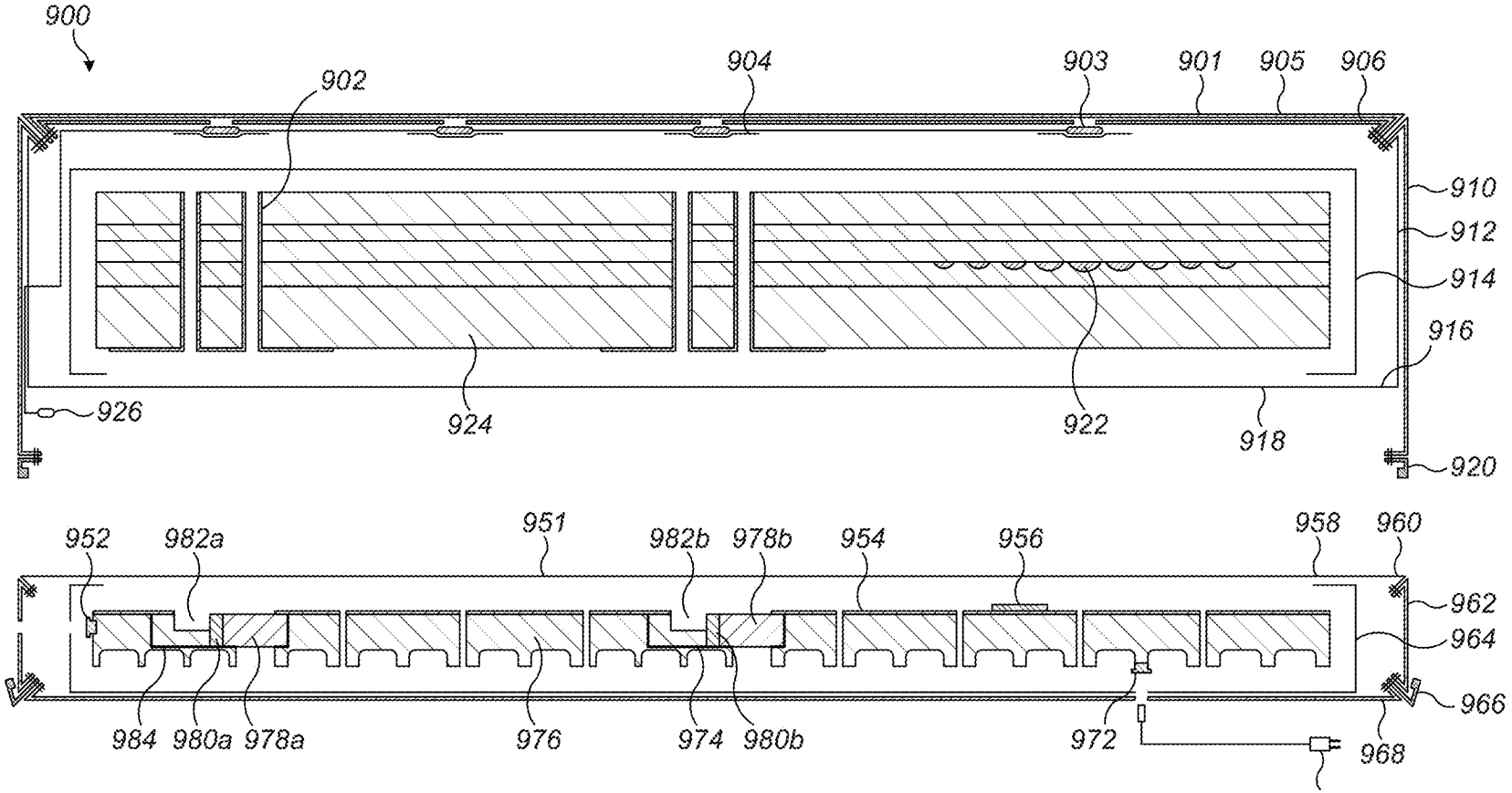
FIGS. 9,10 and 11 show cross-sections of a temperature-regulating mattress system.
Figure 10:
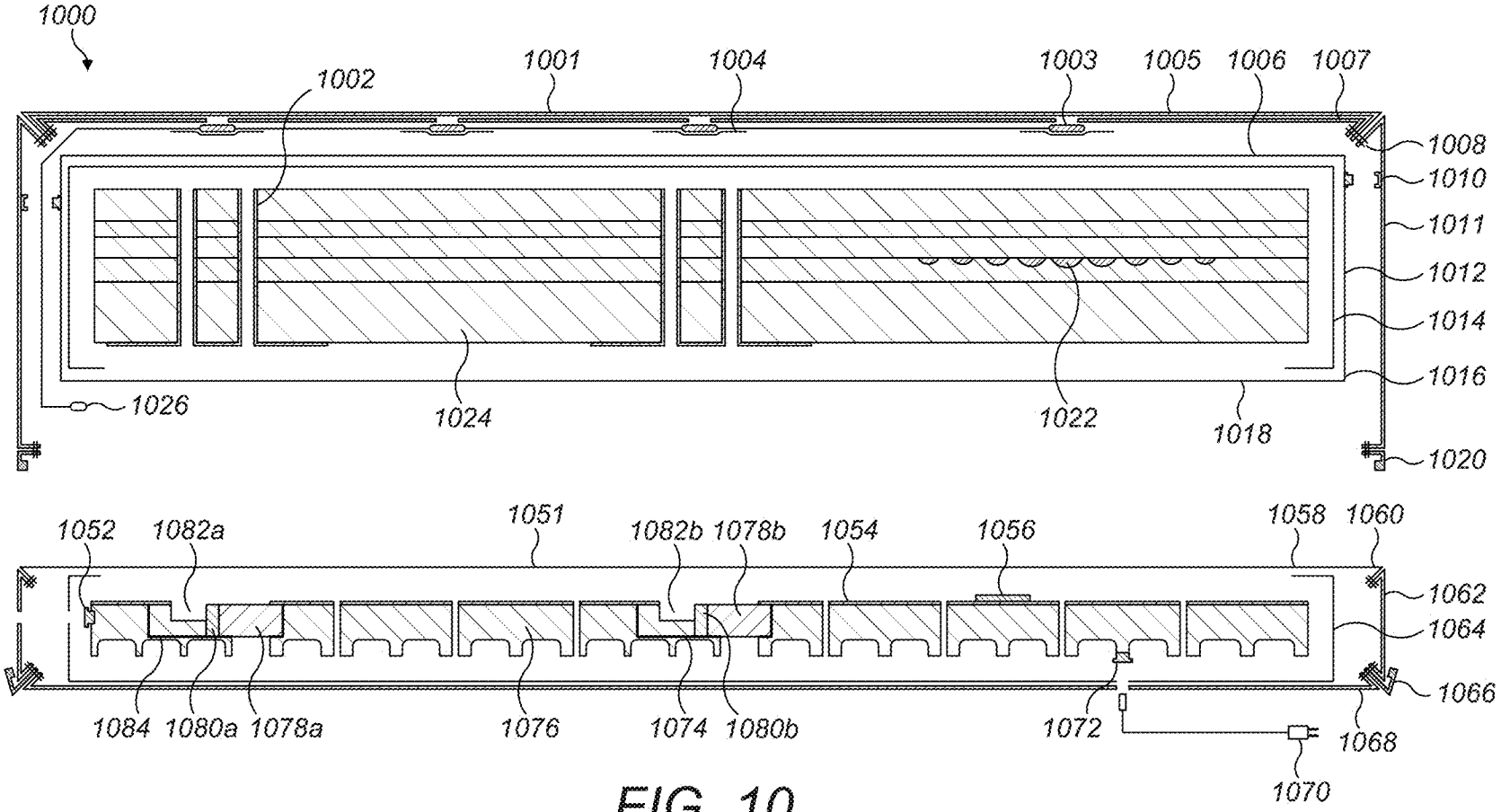
Figure 11:
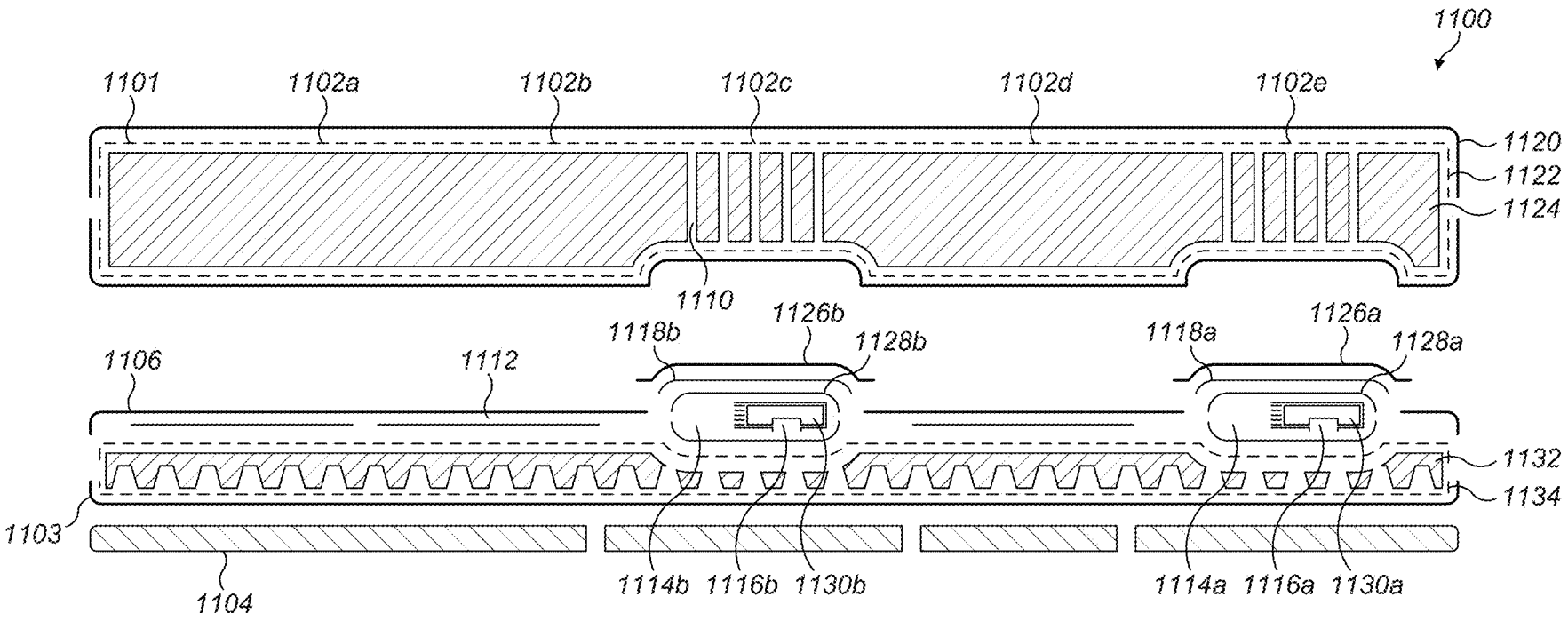

FIGS. 9,10 and 11 show cross-sections of a temperature-regulating mattress system.

Turning to FIG. 9, shown is a mattress cross-section first embodiment 900 consisting of a comfort layer cross-section 901 and a base layer cross-section 951. The comfort layer cross-section 901 includes a mattress cover top panel 905 over a top panel foam insert 906 that are joined at a stitch seam 908. On the side is a mattress cover outer border 910 and a mattress cover inner border 912 that are joined with the base via a mattress cover to base cover zipper 920. On the top are embedded surface sensors 903 and surface sensor patches 904.

The comfort layer 901 is partially surrounded by a mattress fire sock 914. A mattress cover zipper 916 secures a mattress cover base panel 918 and a mattress cover to base cover zipper 820. A surface sensor plug 926 provides power to the system.

Within the mattress itself are foam comfort layers 924 with an embedded ergonomic gel matrix 922. Cut vertically through the mattress are air-impermeable surfaces 902 for air passage.

The base layer 951 cross-section includes a base top panel 958 and a base cover zipper 960 that secures a base cover border 962. A mattress cover to base cover zipper 966 secures a base cover base panel 968. On the top is a biometric sensor 956. On the side is a surface sensor socket 952. On the bottom is an AC power socket 972 and AC power cord 970.

Across the base layer cross-section 951 are a series of expanded polypropylene (EPP) segments 976. A torso airbox 974 and feet air box 984 are integrated within the EPP segments 976. Each airbox includes a fan 978*a*, 978*b* and a heater 980*a*, 980*b*. Air ducts 982*a*, 982*b* allow air to circulate throughout the height of the base layer 951.

The EPP Segments 976 shown in this figure and elsewhere in the application consist of expanded polypropylene chosen because of its lightweight and strong properties. It may be easily molded in various shapes including molding including nuts that for screws to be inserted thereto. These segments may also comprise expanded polyethylene (EPE) expanded polystyrene (EPS) and be injection molded, blow molded, rotationally molded, pressure formed or vacuum formed.

Turning to FIG. 10, shown is a mattress cross-section second embodiment 1000 consisting of a comfort layer cross-section 1001 and a base layer cross-section 1051. The comfort layer cross-section 1001 includes a mattress cover outer top panel 1005 over a top panel foam insert 1007 that are joined at a stitch seam 1008. On the side is a mattress cover outer border 1011 and a mattress cover inner border 1012 held together by an inner cover to outer cover snap 1010. The mattress cover inner border 1012 is also the mattress cover inner top panel 1006 at the top of the mattress.

On the top are embedded surface sensors 1003 and surface sensor patches 1004.

The comfort layer 1001 is partially surrounded by a mattress fire sock 1014. A mattress cover zipper 1016 secures a mattress cover base panel 1018 and a mattress cover to base cover zipper 1020. A surface sensor plug 1026 provides power to the system.

Within the mattress itself are foam comfort layers 1024 with an embedded ergonomic gel matrix 1022. Cut vertically through the mattress are air-impermeable surfaces 1002 for air passage.

The base layer 1051 cross-section includes a base top panel 1058 and a base cover zipper 1060 that secures a base cover border 1062. A mattress cover to base cover zipper 1066 secures a base cover base panel 1068. On the top is a biometric sensor 1056. On the side is a surface sensor socket 1052. On the bottom is an AC power socket 1072 and AC power cord 1070.

Across the base layer cross-section 1051 are a series of expanded polypropylene (EPP) segments 1076. A torso airbox 1074 and torso air box 1084 are integrated within the EPP segments 1076. Each airbox includes a fan 1078*a*, 1078*b* and a heater 1080*a*, 1080*b*. Air ducts 1082*a*, 1082*b* allow air to circulate throughout the height of the base layer 1051.

Turning to FIG. 11, shown is a mattress cross-section third embodiment 1100 consisting of a comfort layer 1101 cross-section, an airbox layer 1106 cross-section, an intake layer 1103 cross-section and an adjustable base 1104 cross-section. The adjustable base may be folded about the gaps shown.

The comfort layer 1101 may be about 11.5 inches comprises a plurality of temperature, humidity, motion sensors 1102*a*-1102*e* below the mattress cover and is surrounded by a comfort layer fire sock 1122. On the top is a comfort layer cover 1120 and within are comfort foam layers 1124. Vertical sealed inside surfaces 1110 allow for air distribution through the comfort layer 1101 while prevented lateral airflow.

The airbox layer 1106 may be 2 inches and includes a biometric sensor 1112, and 2 airboxes 1130*a*, 1130*b* (one torso, one foot, each having a heater and fan that are not shown) surrounded by an airbox chassis 1128*a*, 1128*b*. The biometric sensor 1112 may measure heart rate, breathing rate and presence sensing.

Between each airbox chassis 1128, 1128*b* and the airbox cover 1126*a*, 1126*b* is thermoformed foam 1118*a*, 1118*b*. Also incorporated are temperature and humidity sensor downstream of the heater 1114*a*, 1114*b* and temperature and humidity sensor upstream of the fan 1116*a*, 1116*b*.

The intake layer 1103 may be about 2 inches comprises intake layer foam 1132 and surrounded by an intake layer fire sock 1134.

III. Sensors

The scope and functionality of sensors within a temperature-regulating mattress system is described herein. Such sensors may measure one or more of the following: temperature, (relative) humidity, pressure/presence, movement, presence, heart rate, breathing rate and other biometric parameters.

Figure 12:
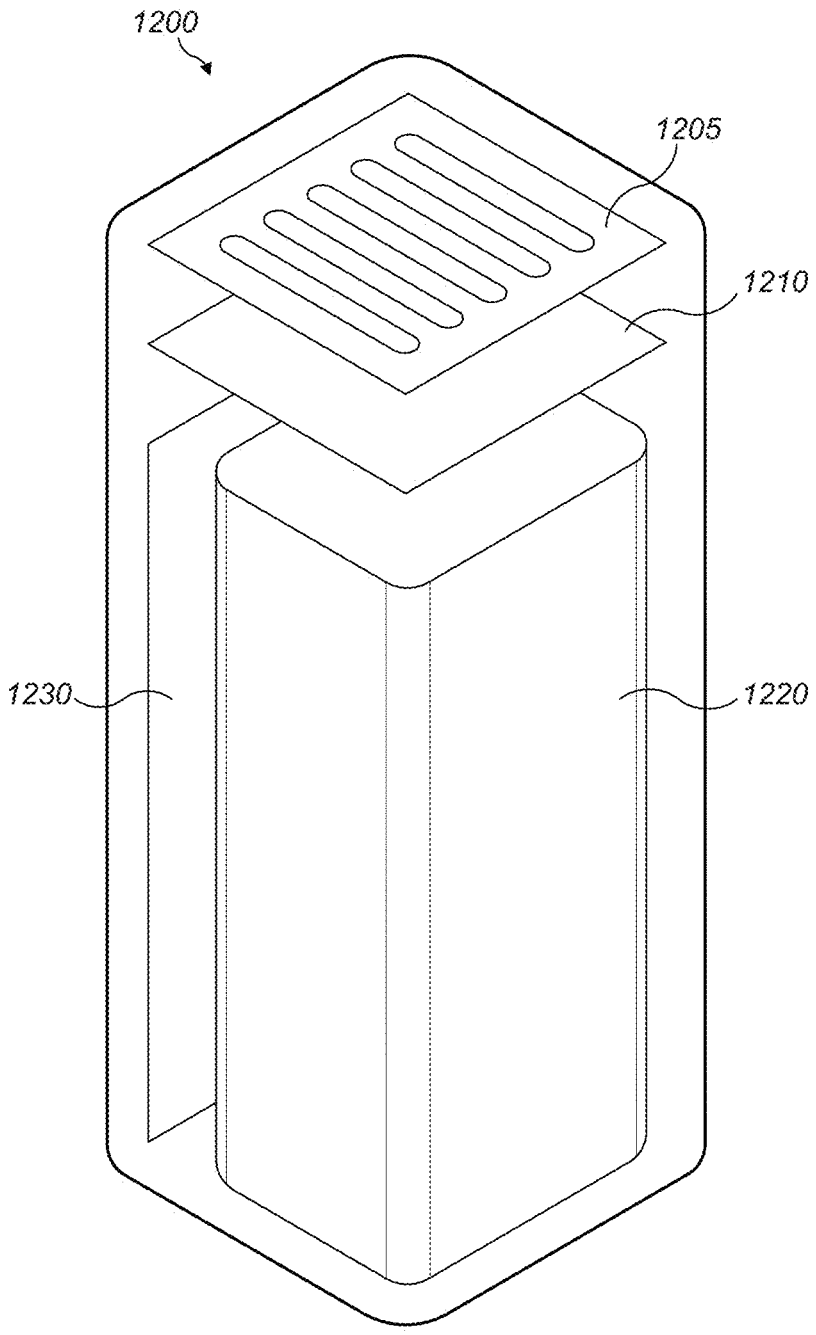
FIG. 12 shows a schematic of a sensor.

Turning to FIG. 12, shown is a schematic of a wireless sensor system 1200. Within the system, there is a metal grille 1205 over electronics for temperature and humidity sensing 1210 powered by a battery 1220. The sensor system 1200 communicates wirelessly via an antenna 1230.

Figure 13:
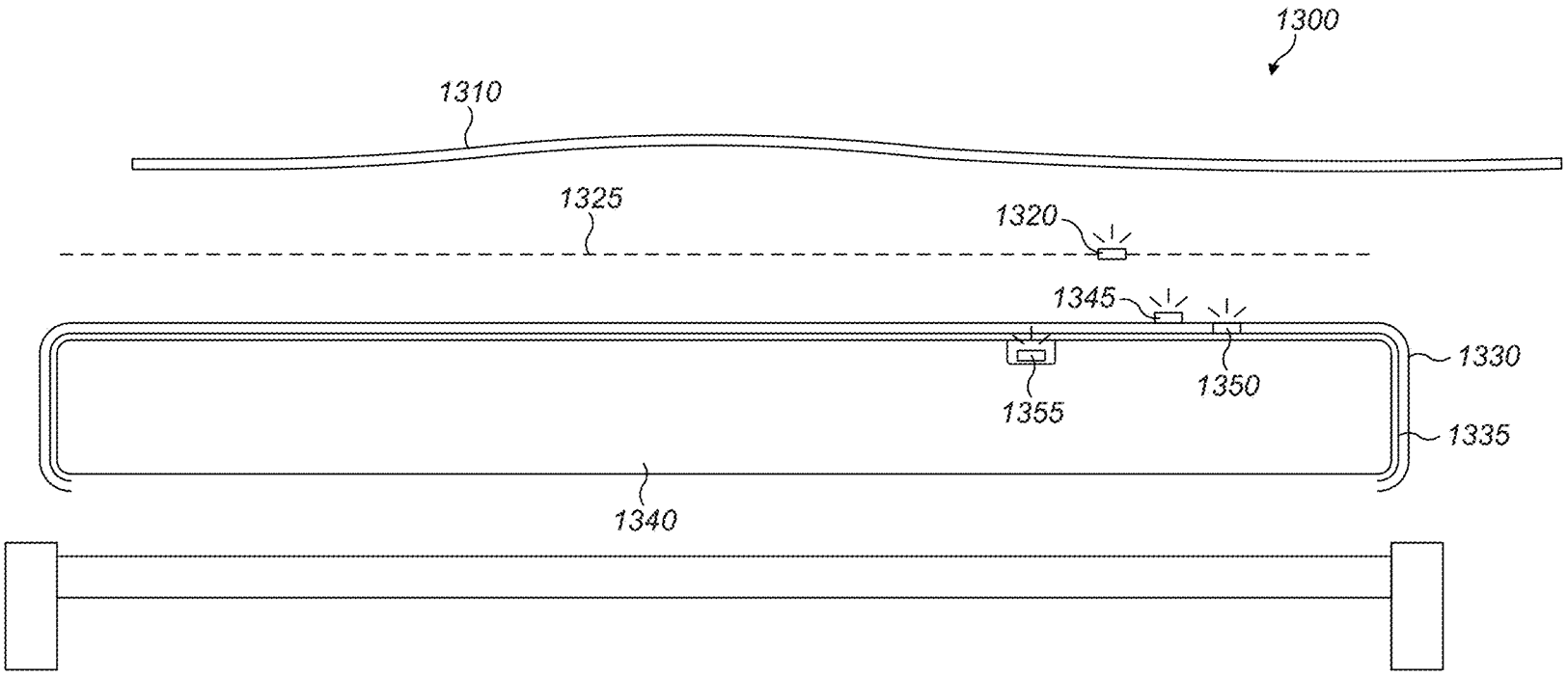
FIG. 13 shows a cross-section of a temperature-regulating mattress system with integrated sensors.

Turning to FIG. 13, shown is a cross-section of a temperature-regulating mattress system 1300 with various integrated or embedded sensors.

A user lies on the mattress 1340 along the dashed line 1325 with bedding 1310 above and a sheet 1330 and mattress protector 1335 below. Sensors may be integrated or embedded in all parts of the system, including at foot sensor 1320, a top-of-sheet sensor 1345, an under-sheet sensor 1350 and an embedded sensor 1355. Single or multiple sensors per user may be used.

Figure 14:
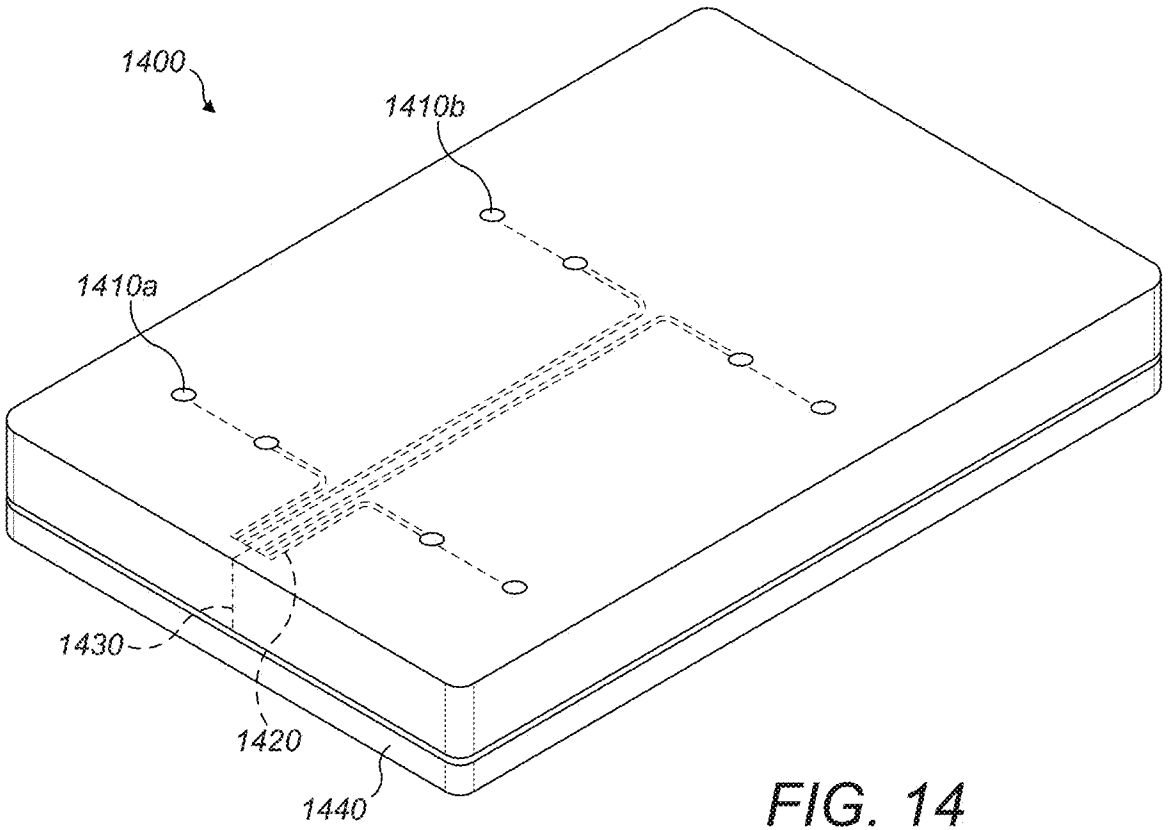
FIG. 14 shows sensors embedded in a comfort layer.

Turning to FIG. 14, shown are sensors embedded in a comfort layer mattress system 1400.

A series of sensors are wired into comfort layer at the foot 1410*a* and the torso 1410*b*. Wires 1420 run through the mattress system 1400 that are installed in the comfort layer before the cover is installed. The wires 1420 then are directed to a connector 1430 that interfaces with the base 1440. The power of the base layer 1440 may also power the sensors 1410*a*, 1410*b* via the connector 1430 and wires 1420.

Figure 15:
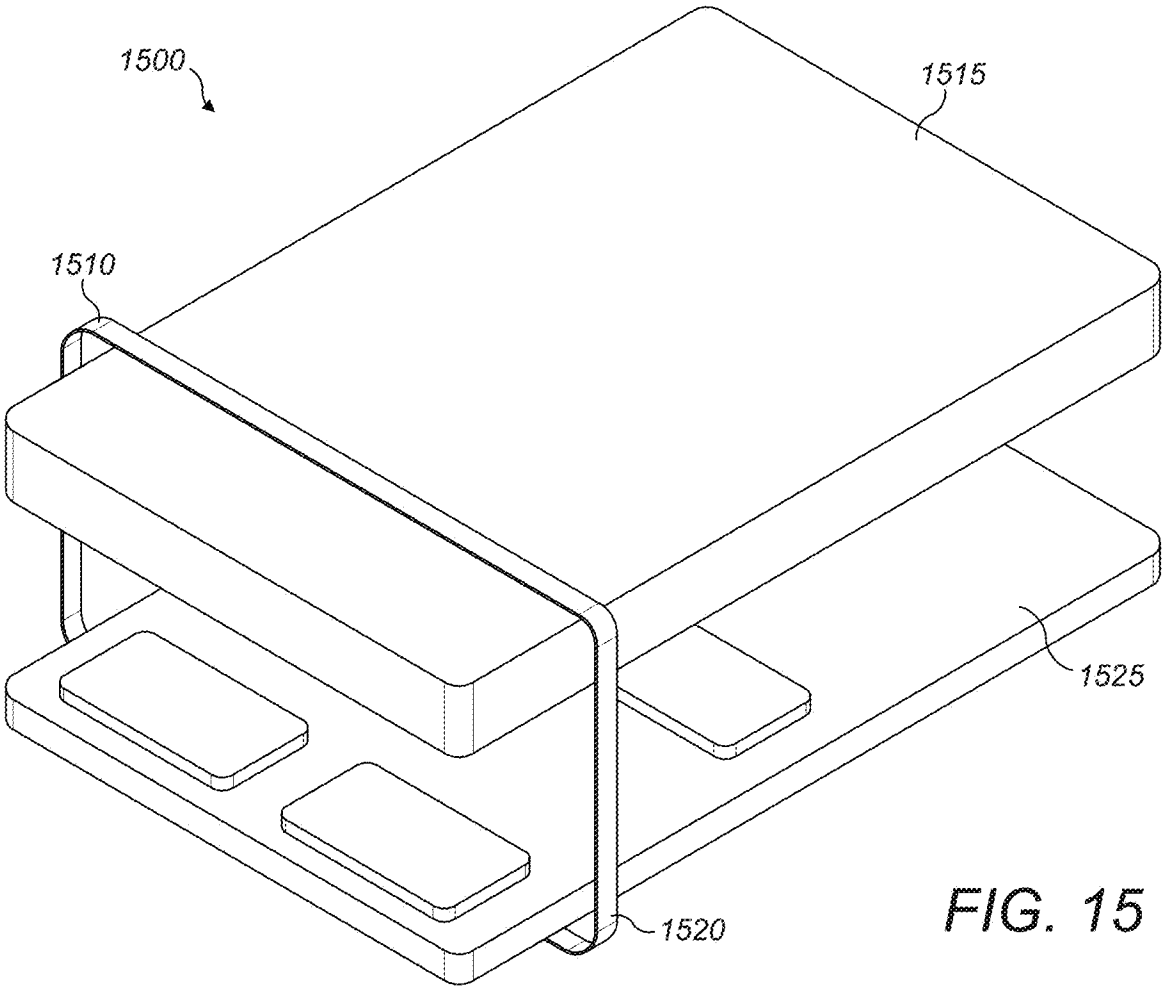
FIG. 15 shows sensors embedded in tethered layers.

Turning to FIG. 15, shown are sensors embedded in tethered layers mattress system 1500. A sensor band 1510 wraps around a comfort layer 1515 and is secured 1520 to the base layer 1525. The sensor band 1510 may include multiple sensors of various functions and includes an electric connection when secured 1520 so that the power of the base layer 1525 may also power the sensor band 1510.

The sensor band 1510 is covered with sheeting by the user.

There may also be wider bands or multiple bands in this system. Or the band footprint may extend to any part of the mattress and have multiple cutouts.

Figure 16:
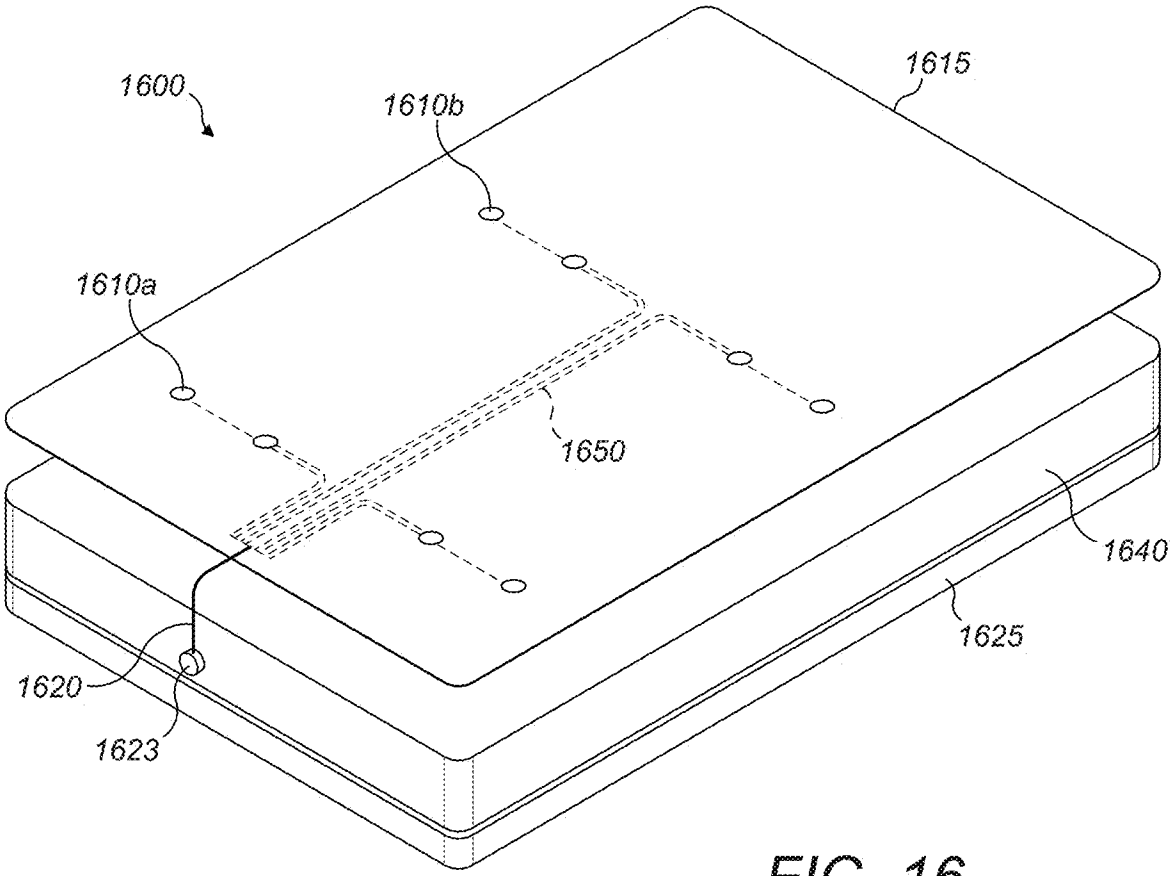
FIG. 16 shows sensors embedded in a mattress cover.

Turning to FIG. 16, shown are sensors embedded in a cover mattress system 1600.

A series of sensors are wired into the cover layer 1615 at the foot 1610*a* and the torso 1610*b*. The cover layer 1615 is designed to be placed over the comfort layer 1640. Wires 1650 run through the cover layer 1615. The wires 1615 are directed to a connector wire 1620 that terminates at a snap connector 1623 that interfaces with the base 1625. The power of the base layer 1625 may also power the sensors 1610*a*, 1610*b* via the connector 1620 and wires 1650.

IV. Cover

The scope and functionality of covers within a temperature-regulating mattress system is described herein. The cover may consist of any suitable materials, including latex, memory foam, polyester blends, feathers, wool, cotton, flannel, silk and bamboo. Connecting systems such as zippers may be replaced by any other connector such hook and loop fasteners (Velcro®), snaps, tape and the like.

Figure 17:
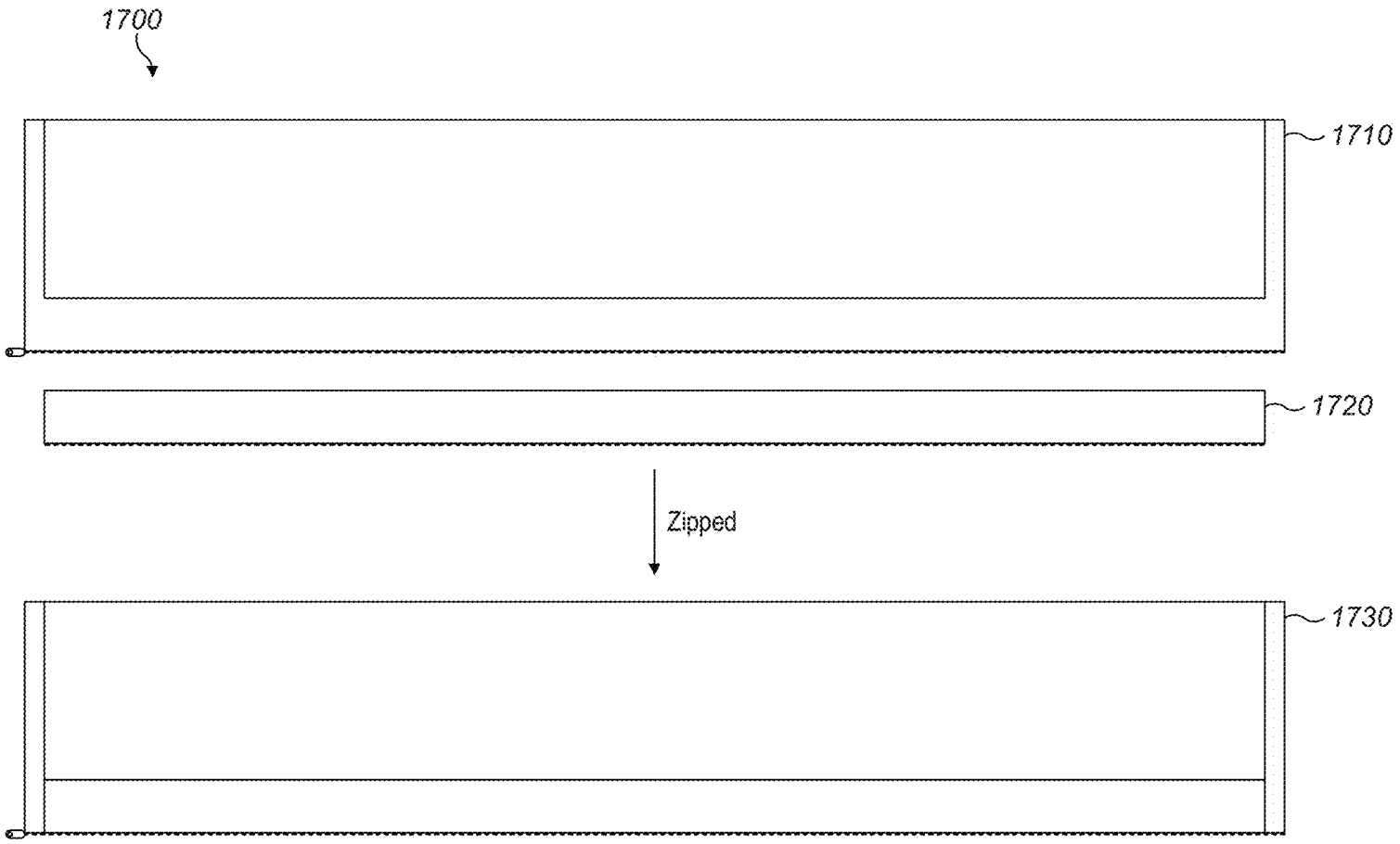
FIG. 17 shows assembly of a cover over a mattress system.

Turning to FIG. 17, shown is an assembly of a cover over a mattress system 1700. A mattress core 1710 is shown separated from a base 1720. After being zipped, an assembled mattress core plus base 1730 is shown.

Figure 18A:
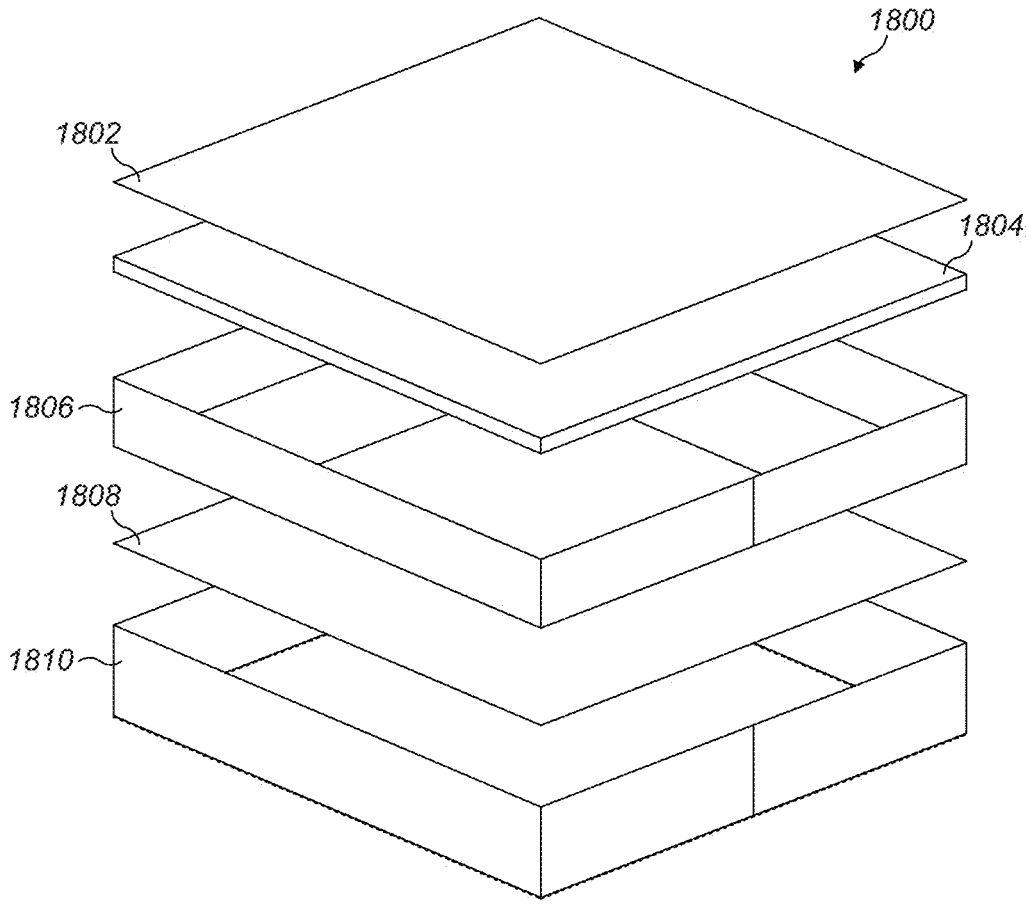
FIG. 18A shows an exploded view of a mattress cover.

Turning to FIG. 18A, shown is an exploded view 1800 of a mattress cover. Shown staring from the top is a top panel 1802, a foam insert 1804, an inner border 1806, a bottom panel 1808 and an outer border 1810

Figure 18B:
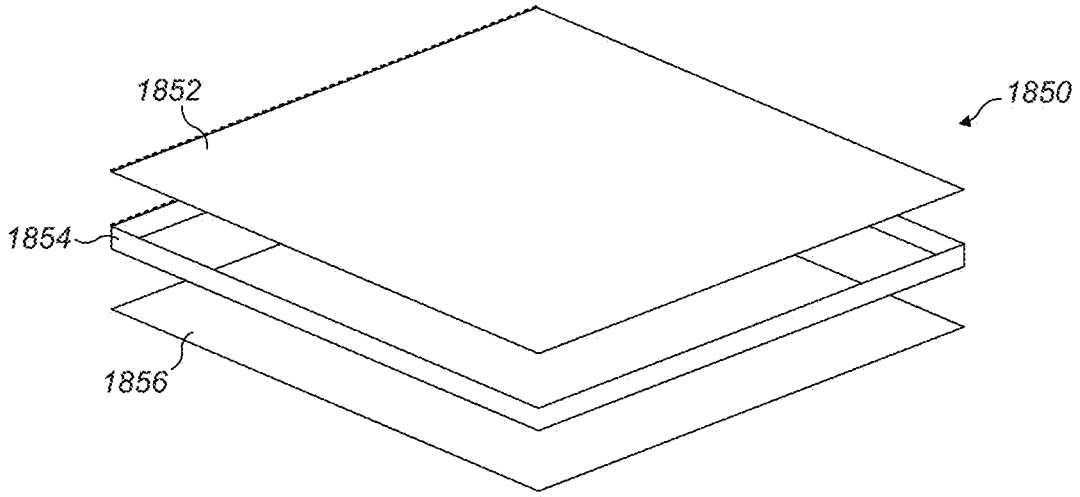
FIG. 18B shows an exploded view of a base cover.

Turning to FIG. 18B, shown shows an exploded view 1850 of a base cover. Shown starting from the top is a top panel 1852, a border 1854 and a bottom panel 1856.

Figure 19:
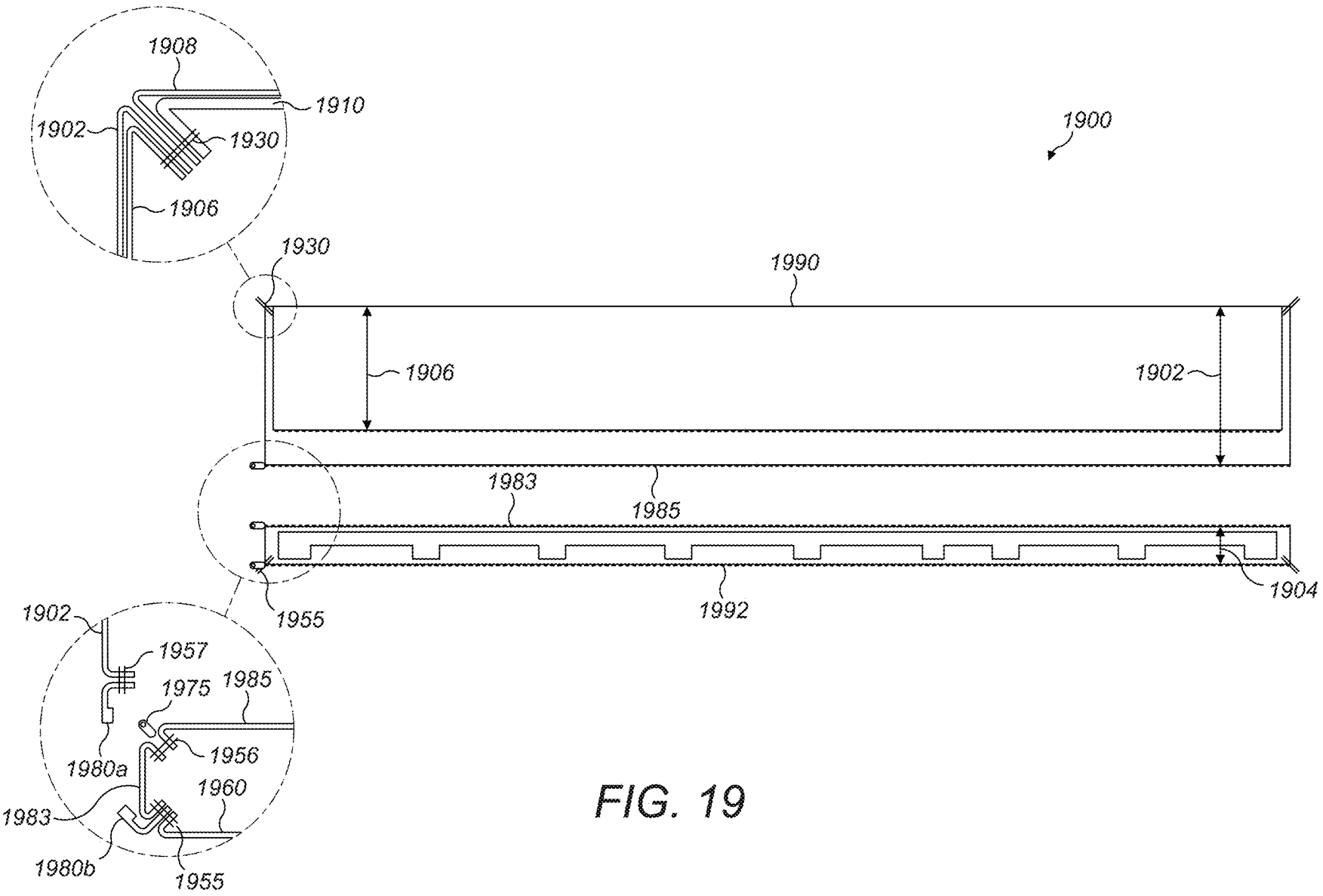
FIG. 19 shows a detailed view of a seams within the mattress cover and base cover.

Turning to FIG. 19, shown is a detailed view of a seams within a mattress system 1900 with a cover mattress layer 1990 having lower zipper teeth 1985 and a cover base layer 1992 having upper zipper teeth 1983.

On the top shown is a mattress cover outer border 1902 and a mattress cover inner border 1906. In the top inset shown is a mattress cover top panel 1908, an optional top panel foam insert 1910, a mattress cover outer border 1902 and a mattress cover inner border 1906 all joined together by stitching 1930.

On the bottom shown is a base cover border 1904. In the bottom inset shown is a mattress cover outer border 1902 and an interchangeable reverse coil zipper 1980*a* joined together by stitching 1957. Also shown is a base cover mesh fabric 1960 and an interchangeable reverse coil zipper 1980*b* joined together by stitching 1955. Also shown is lower zipper teeth 1985 and upper zipper teeth 1983 joined together by stitching 1956 and zipper 1975. This zipper 1975 is designed to join the cover mattress layer 1990 and a cover base layer 1992.

Figure 20:
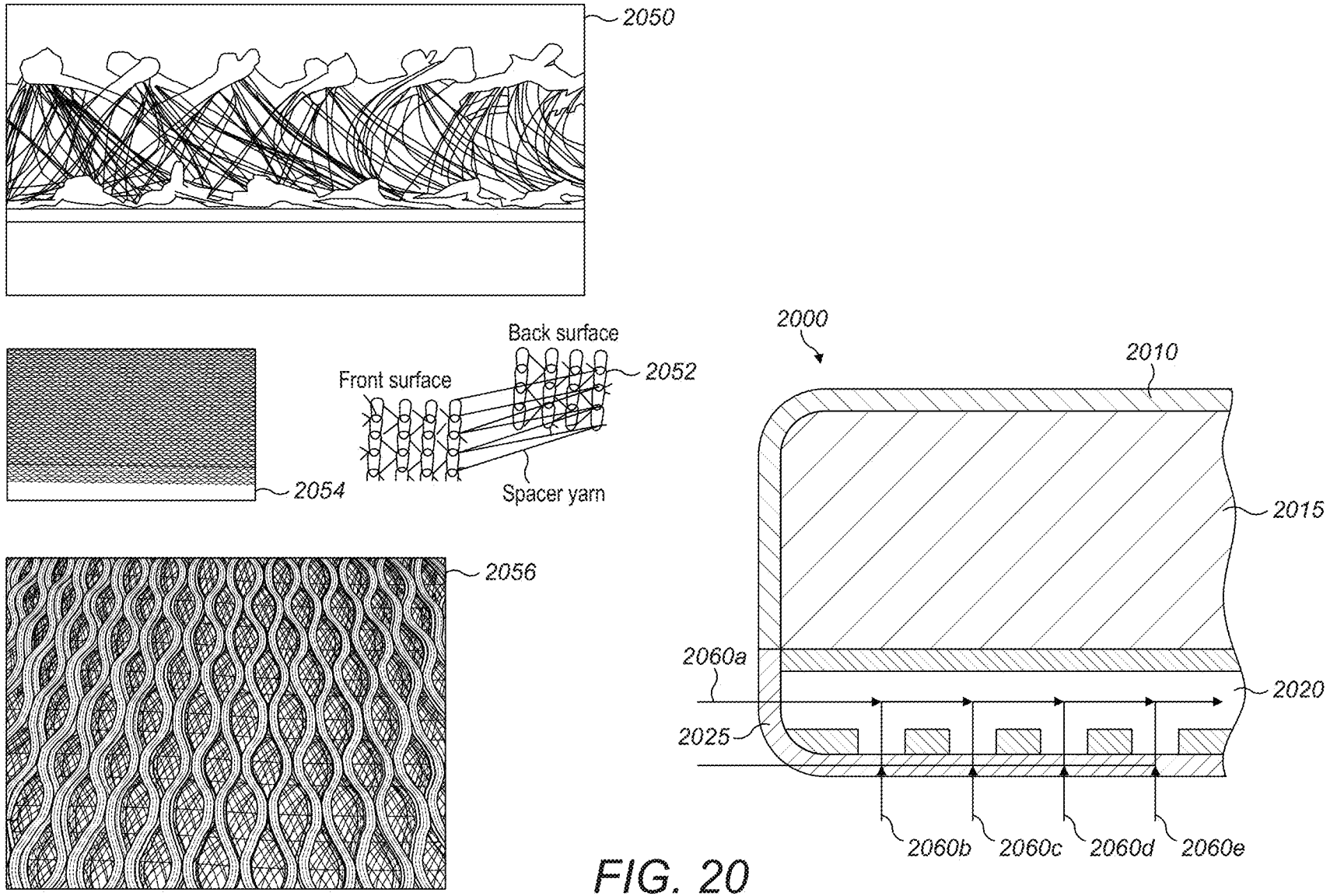
FIG. 20 shows further detail of the bottom cover of a temperature-regulating mattress system.

Turning to FIG. 20 shown is further detail of the bottom cover of a temperature-regulating mattress system. On left side, shown is a spacer fabric sample 1 2050, a spacer fabric sample 2 2054, a fabric diagram 2052 and a spacer fabric sample 3 2056. The fabric diagram 2502 shows a front surface, a back surface and spacer yarn in between the front surface and back surface.

On the right side, shown is a mattress cross section detail system 2000. Shown is a cover top 2010 that may be comfortable and air permeable and a cover bottom 2025. The cover top 2010 and cover bottom 2025 surround comfort layers 2015 (that may be about 10 inches in height) and an intake layer 2020. The intake layer 2020 may be about 2 inches in height and have a flexible impermeable structure with air channels on the perimeter side 2060*a* and bottom 2060*b*, 2060*c*, 2060*d*, 2060*e*.

Airflow through the air channels 2060*a*, 2060*b*, 2060*c*, 2060*d*, 2060*e* are enabled because the cover bottom 2025 may be constructed from spacer fabric or similar material (as shown on the left side of FIG. 20). This fabric allows air to move freely through the cover bottom 2025 in both the perpendicular and parallel directions. In particular, airflow moves through the fabric parallel to the surface when the underside and vertical sides of the mattress are blocked by bedframe and bedding.

V. Base

The scope and functionality of bases within a temperature-regulating mattress system is described herein. The base may include components integrated within the base structure or modular components affixed to the base structure (or a combination of the two).

Figure 21:
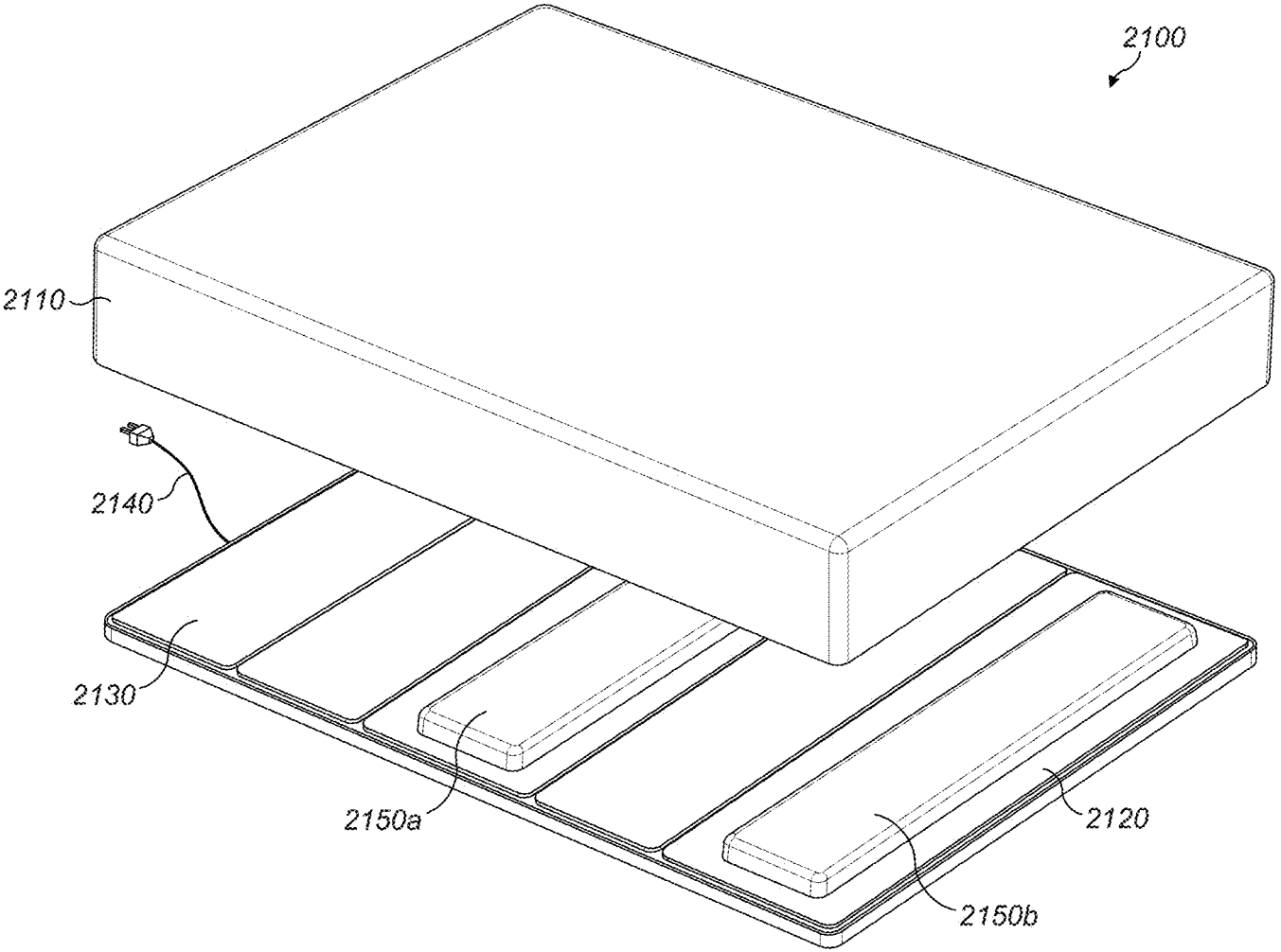
FIGS. 21 and 22 show schematics of an integrated mattress base.
Figure 22:
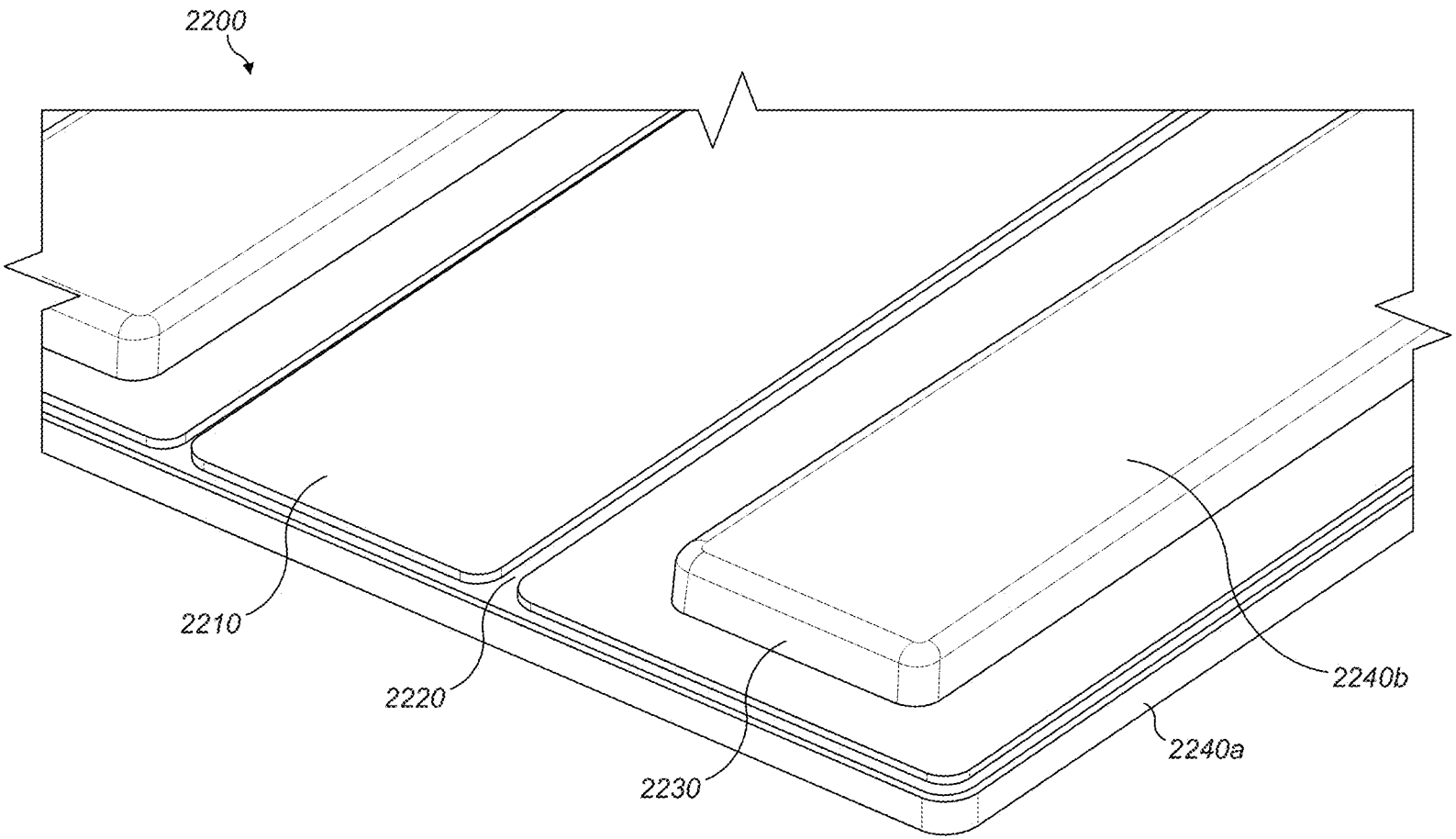

FIGS. 21 and 22 show schematics of an integrated base.

FIG. 21 shows a schematic of an integrated base 2100 have a mattress 2110 and a base 2120 powered by wire 2140. Air distribution may take place in the mattress 2110. Biometric sensors 2130 may be integrated within the base 2120. Such sensors may include hear rate/breathing rate/presence sensing and other biometrics.

Also shown is an integrated torso module 2150*a* and an integrated foot module 2150*b*. These modules 2150*a*, 2150*b* may jut out from base 2120 because of the airboxes contained therein or may be level with the base 2120. The base 2120 may include electronics, fans, heaters and air intake apparatuses.

Turning to FIG. 22, shown is a base system detail 2200 with foam panels 2210, a fabric hinge 2220, thermoformed foam 2230 and permeable fabrics 2240*a*, 2240*b*. As will be shown below, the fabric hinge will allow the base 2120 to be folded in various combinations.

Figure 23:
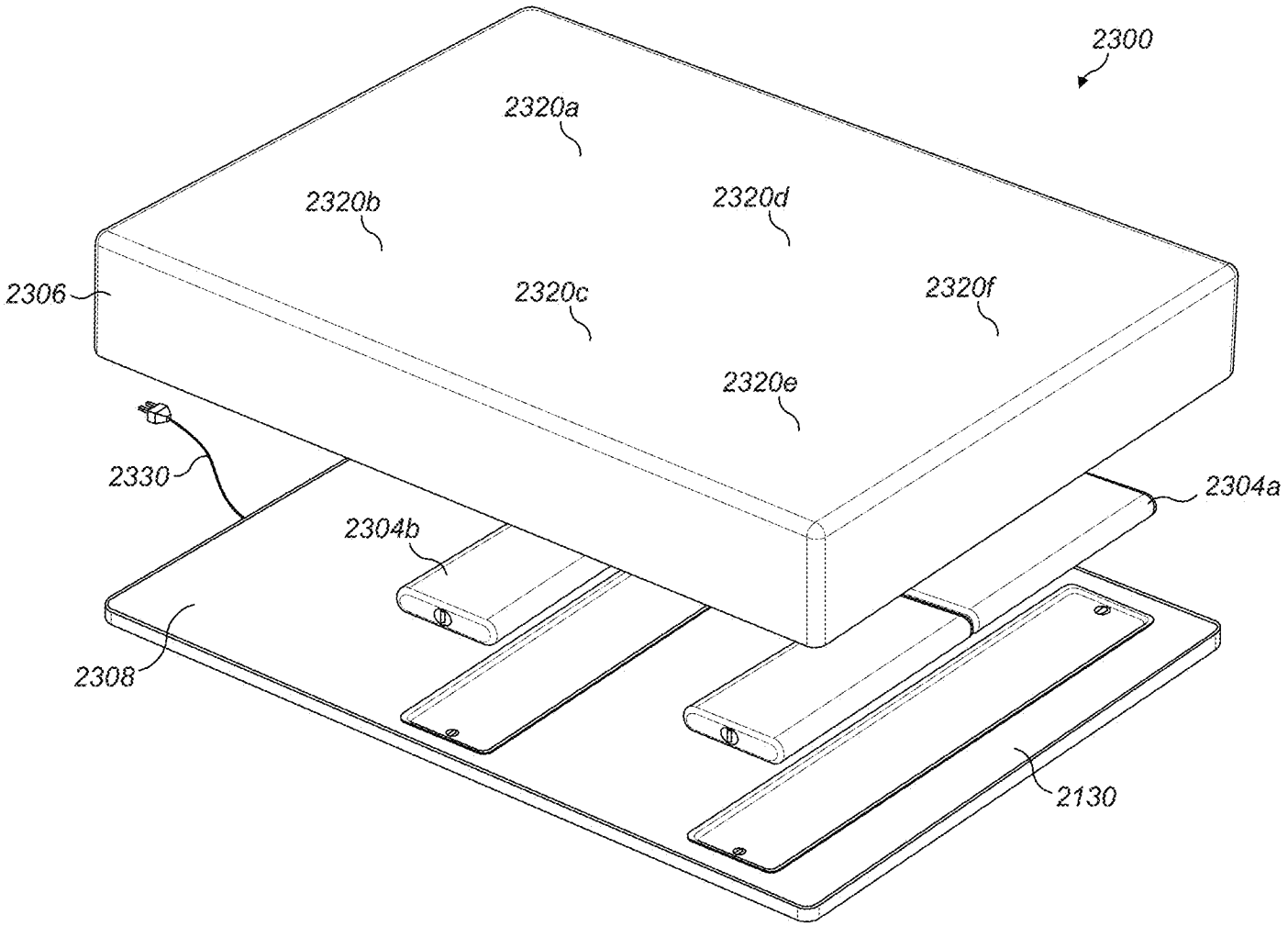
FIGS. 23, 24A and 24B show schematics of a modular mattress base.
Figure 24B:
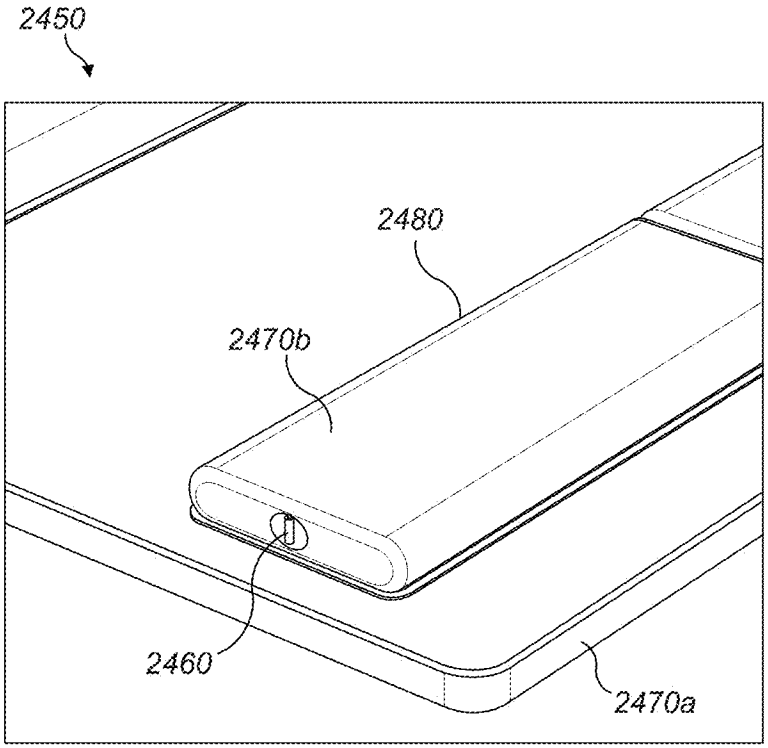
Figure 24A:
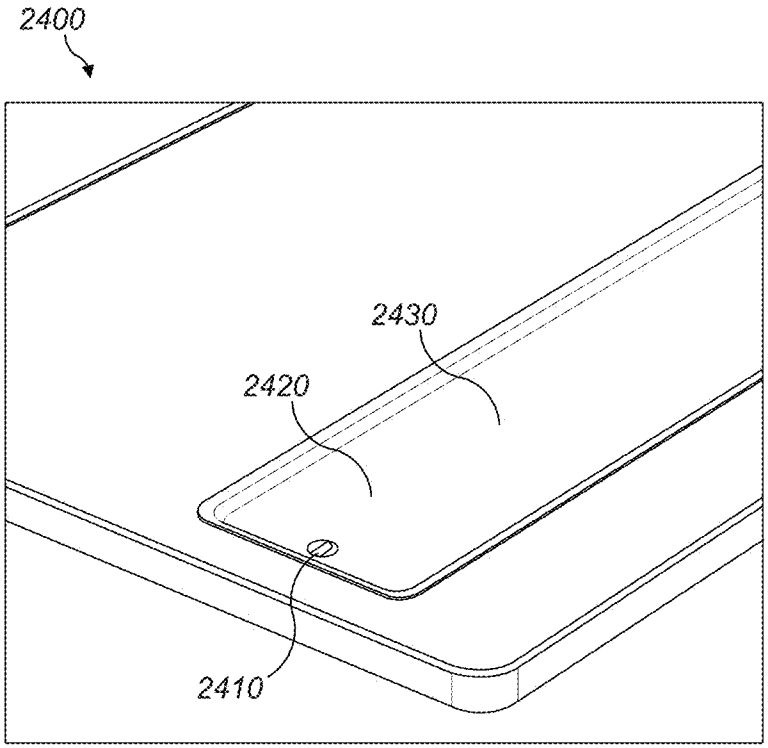

FIGS. 23, 24A and 24B show schematics of a modular base.

Turning to FIG. 23, shown is a schematic of a modular base system 2300.

Temperature, humidity and motion sensors 2302*a*-2302*f* are incorporated below the mattress cover within the mattress 2306. Modules 2304*a*, 2304*b* (each of which is split into 2 parts) that at least contain airboxes (not shown) are installed on the base 2310.

Biometric sensors 2308 may be integrated within the base 2310. Such sensors may include hear rate/breathing rate/presence sensing and other biometrics.

The modules 2304*a*, 2304*b* are normally assembled by the end user and connected to the base 2310 electrically. This may produce better packaging solutions with smaller boxes.

Turning to FIG. 24A, shown is a modular base system detail 2400 without the module installed. Shown is a permeable fabric 2420 and a thermoformed tray 2430 with a power cable storage 2410.

Turning to FIG. 24B, shown is a modular base system detail 2400 with the module 2480 installed. Shown is a permeable fabric 2470*a*, 2470*b* and a power connection 2460.

The system is designed so that the module 2480 is snapped into a thermoformed tray 2430 where the power cable located in the power cable storage 2410 is connected to the power connection 2460. This provides power to the module 2480. Similar setups for 3 other modules (not shown) may be implemented.

Figure 25:
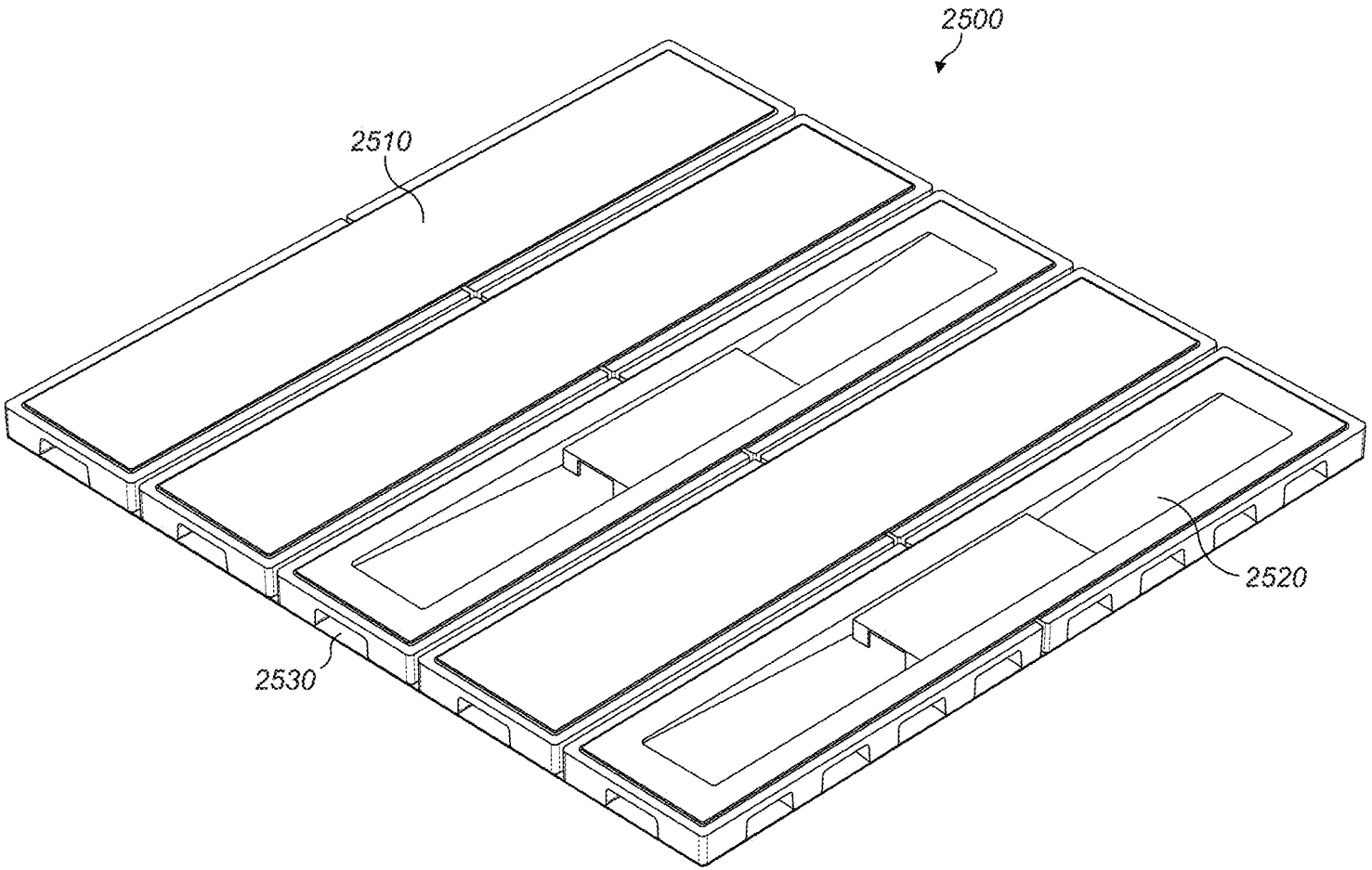
FIGS. 25 and 26 show schematics of a mattress base layer.

Turning to FIG. 25, shown is a schematic of a base layer with cover 2500. The fabric cover 2510 (shown as transparent) may be of any suitable material that is either opaque, translucent or transparent. This allows the base layer components to be contained in a fabric shell. The fabric cover 2510 may be permeable so as to allow air to be distributed to holes in the mattress installed above the base layer (not shown). A segmented structure 2530 comprising several segments that allow the base layer to fold for shipment and flex for compatibility with adjustable bases.

Figure 26:
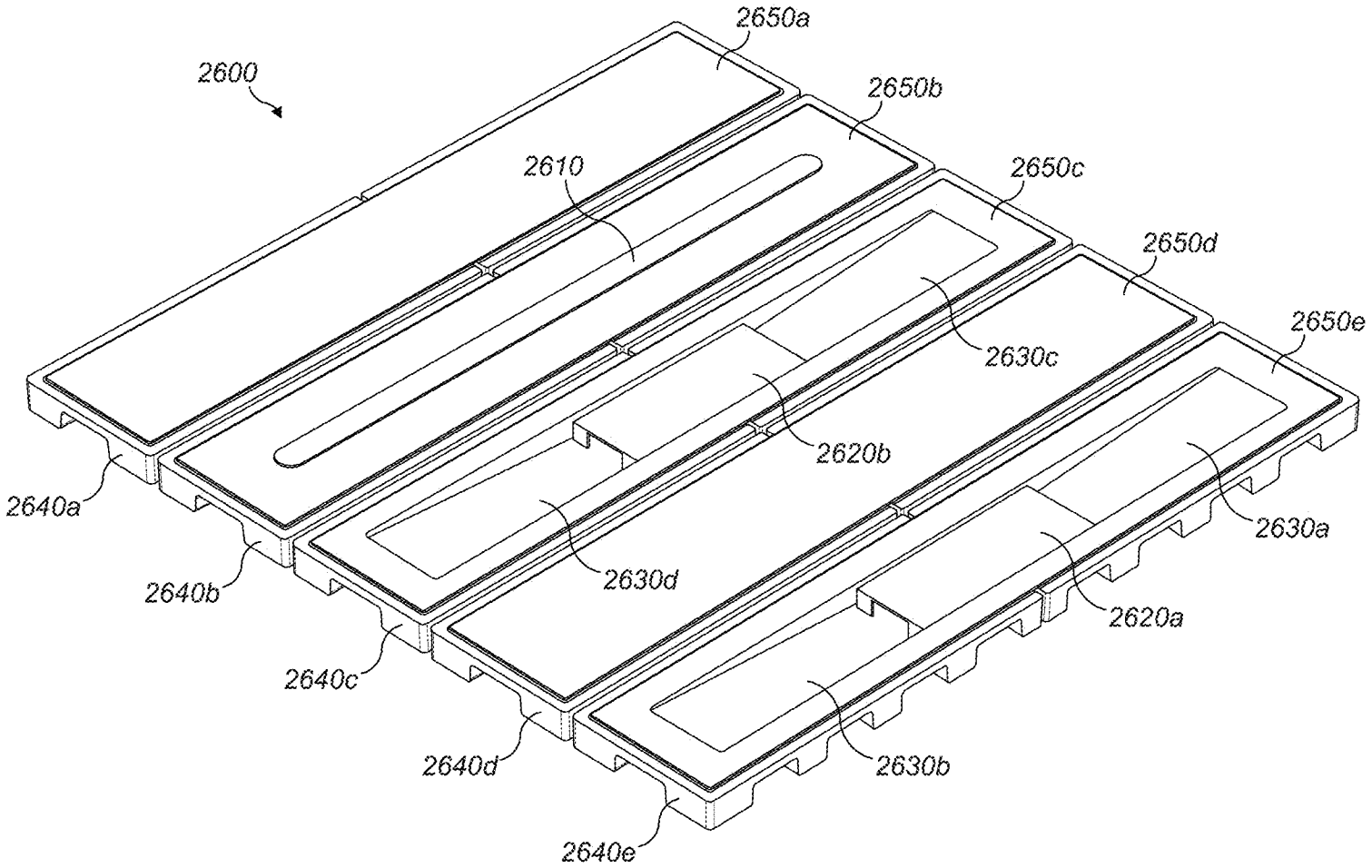

Turning to FIG. 26, shown is a schematic of a base layer without a cover 2600. A biometric sensor track 2610 is inlaid to measure dynamic sleeping profiles for the mattress user, including measuring breathing rate, heart rate and movement throughout the night. Five rigid panels 2650*a*, 2650*b*, 2650*c*, 2650*d*, 2650*e* are installed over five molded EPP segments 2640*a*, 2640*b*, 2640*c*, 2640*d*, 2640*e*. This segmented structure comprising several segments allows the base layer to fold for shipment and flex for compatibility with adjustable bases.

A torso airbox system 2602*b* is installed within rigid panel 2650*c* flush with the top of the base layer. Ramps 2630*c*, 2630*d* are carved out of the rigid panel 2650*c* to allow for airflow. In the alternative, the torso airbox system 2602*b* may include integrated ramps on the left and right to allow for airflow.

A foot airbox system 2602*a* is installed within rigid panel 2650*e* flush with the top of the base layer. Ramps 2630*a*, 2630*b* are carved out of the rigid panel 2650*e* to allow for airflow. In the alternative, the foot airbox system 2602*a* may include integrated ramps on the left and right to allow for airflow.

Figure 27:
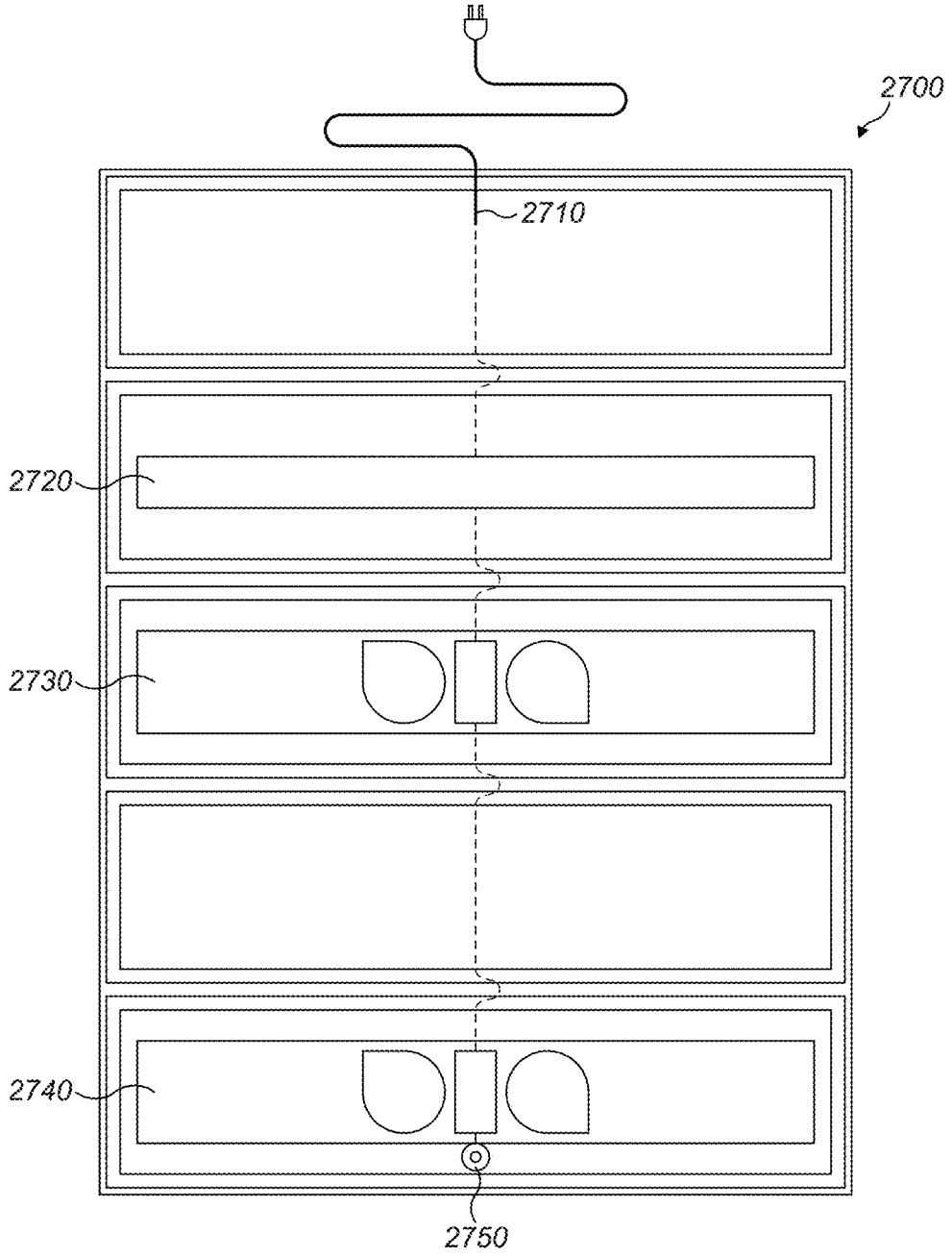
FIG. 27 shows internal wiring of a base layer.

Turning to FIG. 27, shown is an internal wiring schematic of a base layer 2700. Within the base layer 2700 are a wiring system 2710 that connects (among other possible devices) a biometric sensor strip 2720, a torso airbox 2730, a feet airbox 2740 and a surface sensor interconnect 2750. The torso airbox 2730 and feet airbox 2740 each include two fans on the side and an electrical component in the middle to control operation of the airboxes 2730, 2740. The surface sensor interconnect 2750 interfaces with other sensors throughout the mattress system to providing inputs to the airboxes 2730, 2740 and transmit outputs from the biometric sensor strip 2720.

Figure 28:
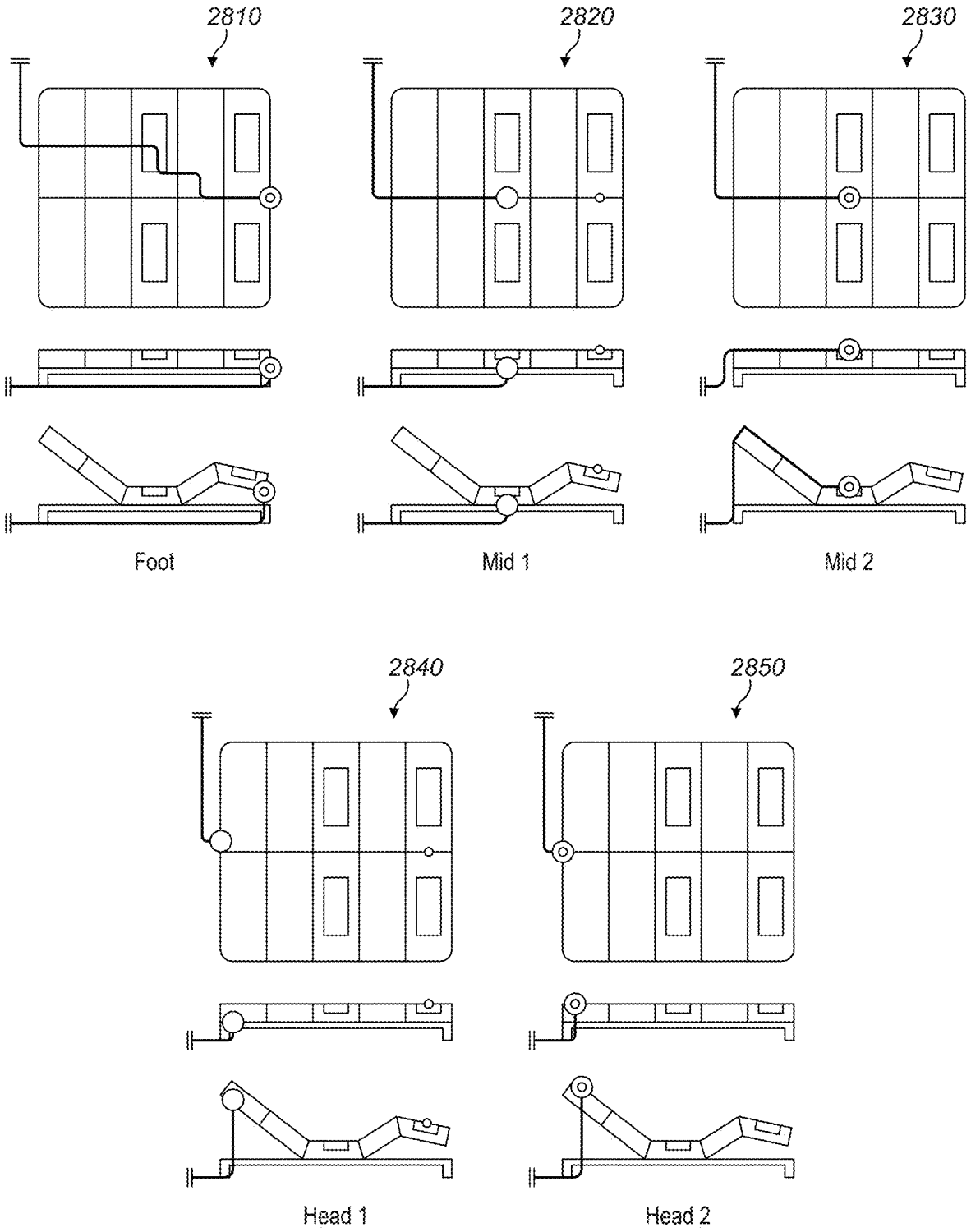
FIG. 28 shows external wiring of a base layer.

Turning to FIG. 28, shown are five external wiring schematics within a base layer.

Schematic 1 2810 shows a wiring system sourced on the side of the foot of the mattress. A top view, side flat view and side folded view are shown.

Schematic 2 2820 shows a wiring system sourced on the bottom of the middle of the mattress. A top view, side flat view and side folded view are shown.

Schematic 3 2830 shows a wiring system sourced on the top of the middle of the mattress. A top view, side flat view and side folded view are shown.

Schematic 4 2840 shows a wiring system sourced on the bottom of the head of the mattress. A top view, side flat view and side folded view are shown.

Schematic 5 2850 shows a wiring system sourced on the top of the head of the mattress. A top view, side flat view and side folded view are shown.

The foregoing schemes may be adjusted such that the wiring is sourced at any other position within the mattress.

Figure 29A:
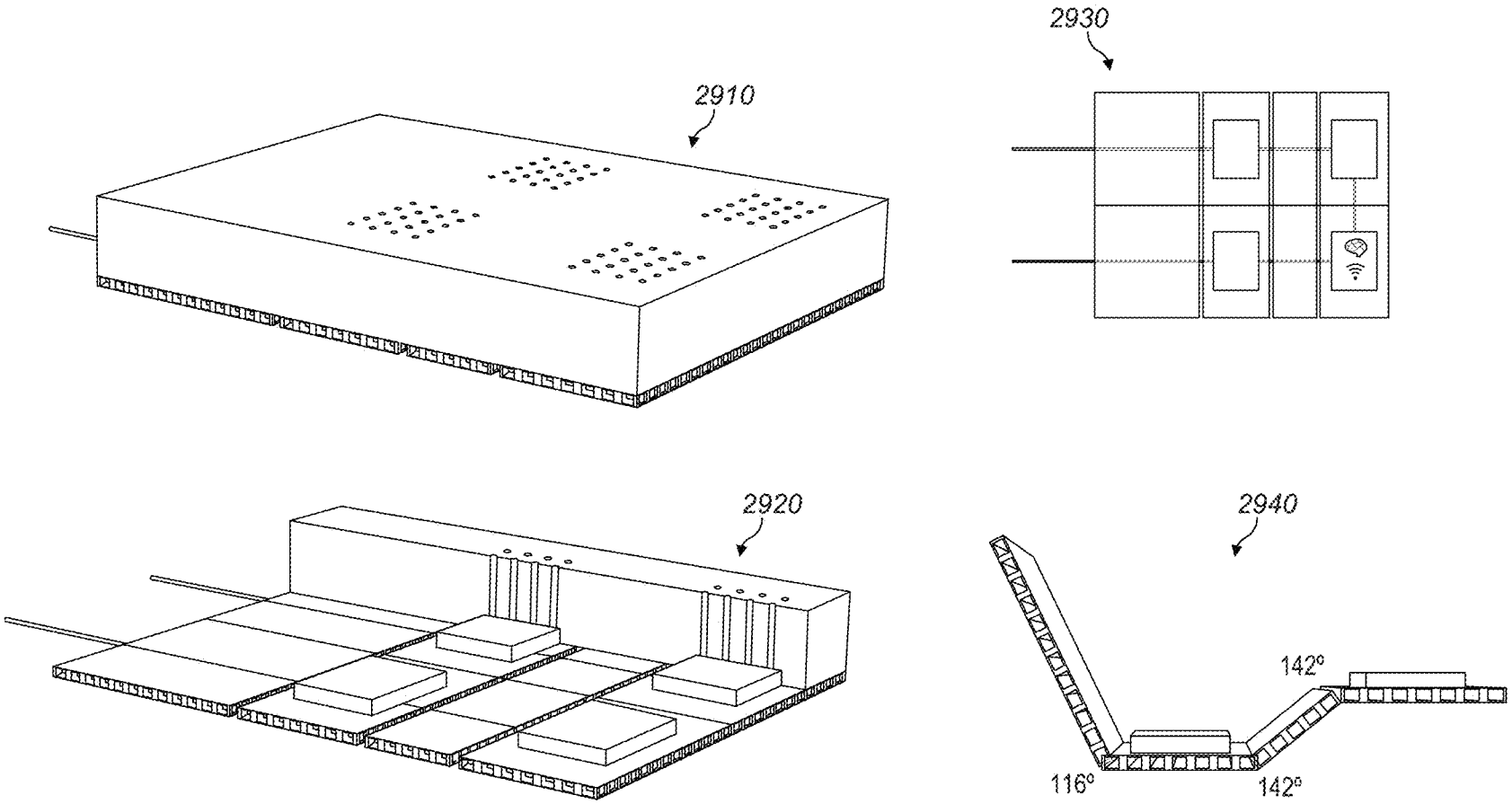
FIGS. 29A and 29B show schematics of an adjustable base layer.

Turning to FIG. 29A, shown are various schematics of an adjustable base layer and its associated mattress. Making the base layer adjustable allows the mattress system to be formed into various configurations for additional user comfort and for easier shipping.

On the top left, shown is an articulating mattress system 2910 with four segments in the base layer to allow for such articulation. On the bottom left, shown is an internal view of the same articulating mattress system 2920 with four segments: head (the widest segment), torso (including an airbox), legs and feet (including an airbox). On the top right, shown is an overhead schematic view of the same articulating mattress system 2930 with the same four segments. On the bottom right, the same articulating mattress system 2940 with the same four segments is set in an exemplary configuration. Here, the head segment is set at a 116-degree angle from the torso segment, the torso segment is set at a 142-degree angle from the legs section and the legs section is set at a 142-degree angle from the feet section.

The foregoing system may have a different number of layers capable of being articulated in angles ranging from above 0 degrees to 180 degrees.

Figure 29B:
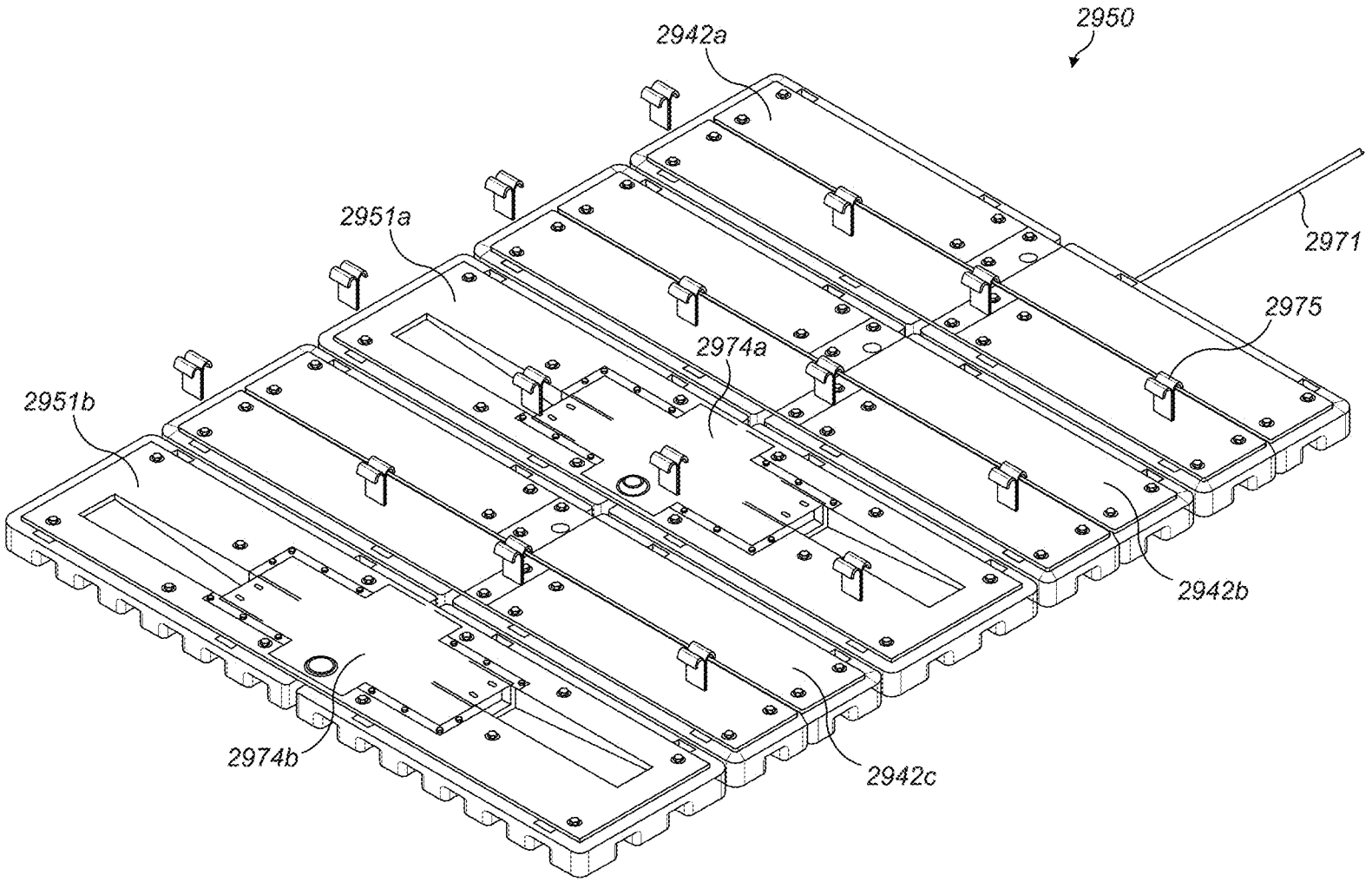

Turning to FIG. 29B, shown is a partially exploded view of schematic of a base of an articulating mattress system 2950. The schematic shows five segments joined together with sixteen hinges 2975 shown in an exploded view. The first, second and fourth segments 2942*a*, 2942*b*, 2942*c* include no visible electronic parts. The third segment 2951*a* includes an integrated torso airbox system 2947*a* and the fifth segment 2951*b* includes an integrated feet airbox system 2947*b*. The entire system is powered via a power cord 2971 and an internal wiring system (not shown).

Figure 29C:
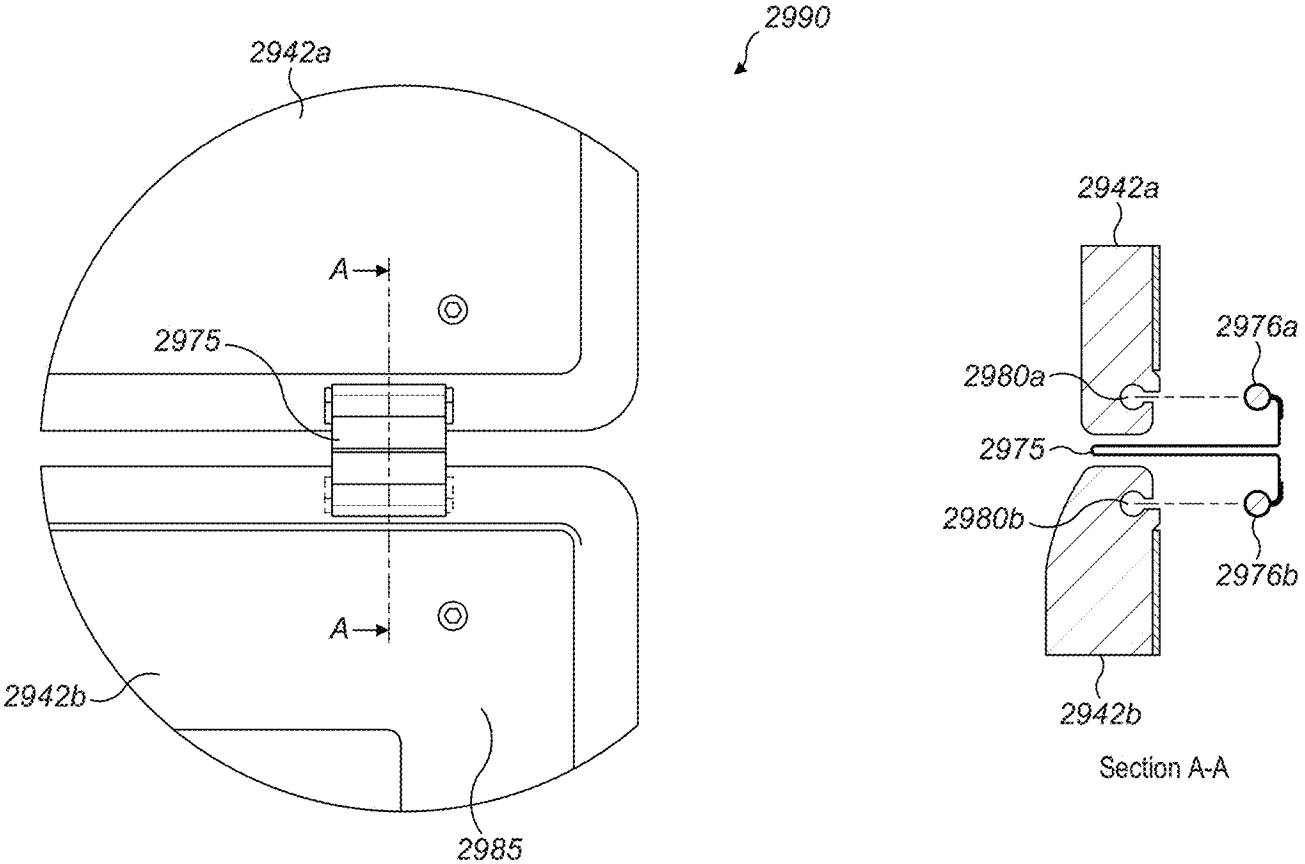
FIGS. 29C and 29D show hinges in an adjustable base layer.

Turning to FIG. 29C, shown is a detail view of an adjustable base layer hinge 2990. On the left side, an overhead view shows the hinge 2975 (which may be the same hinge as in FIG. 29B) joining two segments 2924*a*, 2924*b* together. The cross section of hinge 2975 and the two segments 2924*a*, 2924*b* at line A-A is shown on the right side. Here it can be seen that the hinge 2975 flexibly joins the two segments 2924*a*, 2924*b* because the hinge 2975 includes two circular protrusions 2976*a*, 2976*b* that snap into two circular receptacles 2980*a*, 2980*b*. The circular receptacles 2980*a*, 2980*b* may be carved out of the material that comprises the two segments 2924*a*, 2924*b* such that the circular protrusions 2976*a*, 2976*b* remain ensconced in the two segments 2924*a*, 2924*b* at any angle the two segments 2924*a*, 2924*b* may be set. These angles may include those shown in FIG. 29A.

Figure 29D:
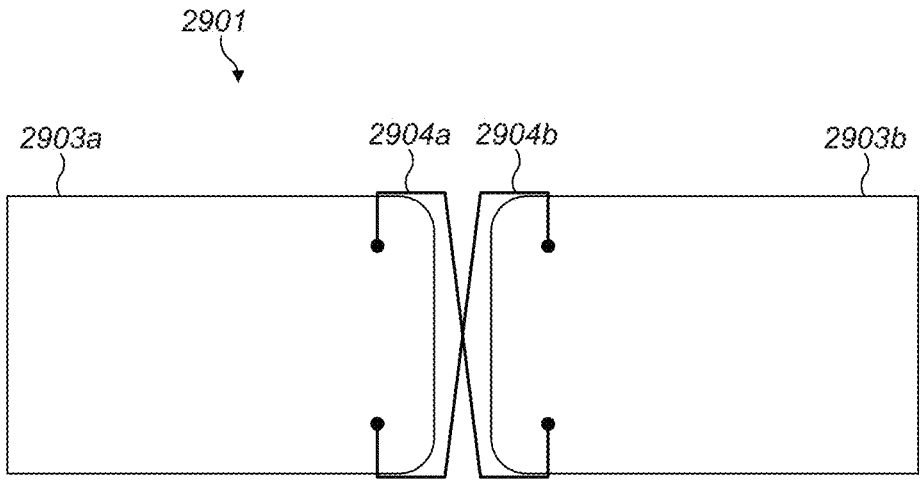
Figure 29D:
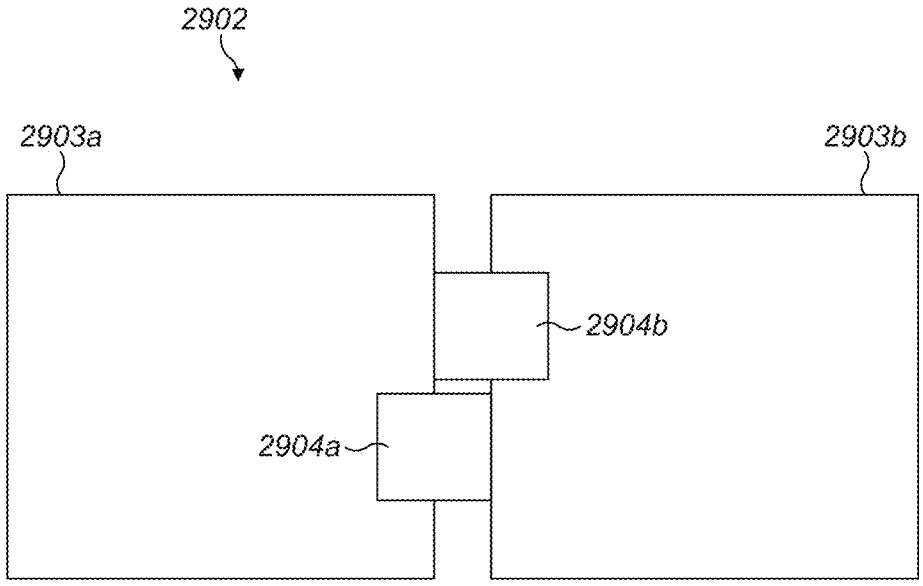

Turning to FIG. 29D, shown is a detail view of another adjustable base layer hinge. A side view 2901 shows a double hinge 2904*a*, 2904*b* ensconced within two segments 2903*a*, 2903*b*. A top view 2902 shows the same double hinge 2904*a*, 2904*b* ensconced within two segments 2903*a*, 2903*b*. The advantage of this embodiment is that the hinge structure is reinforced in both directions so that flexibility of the two segments 2903*a*, 2903*b* to bend in both directions is enhanced.

Figure 29E:
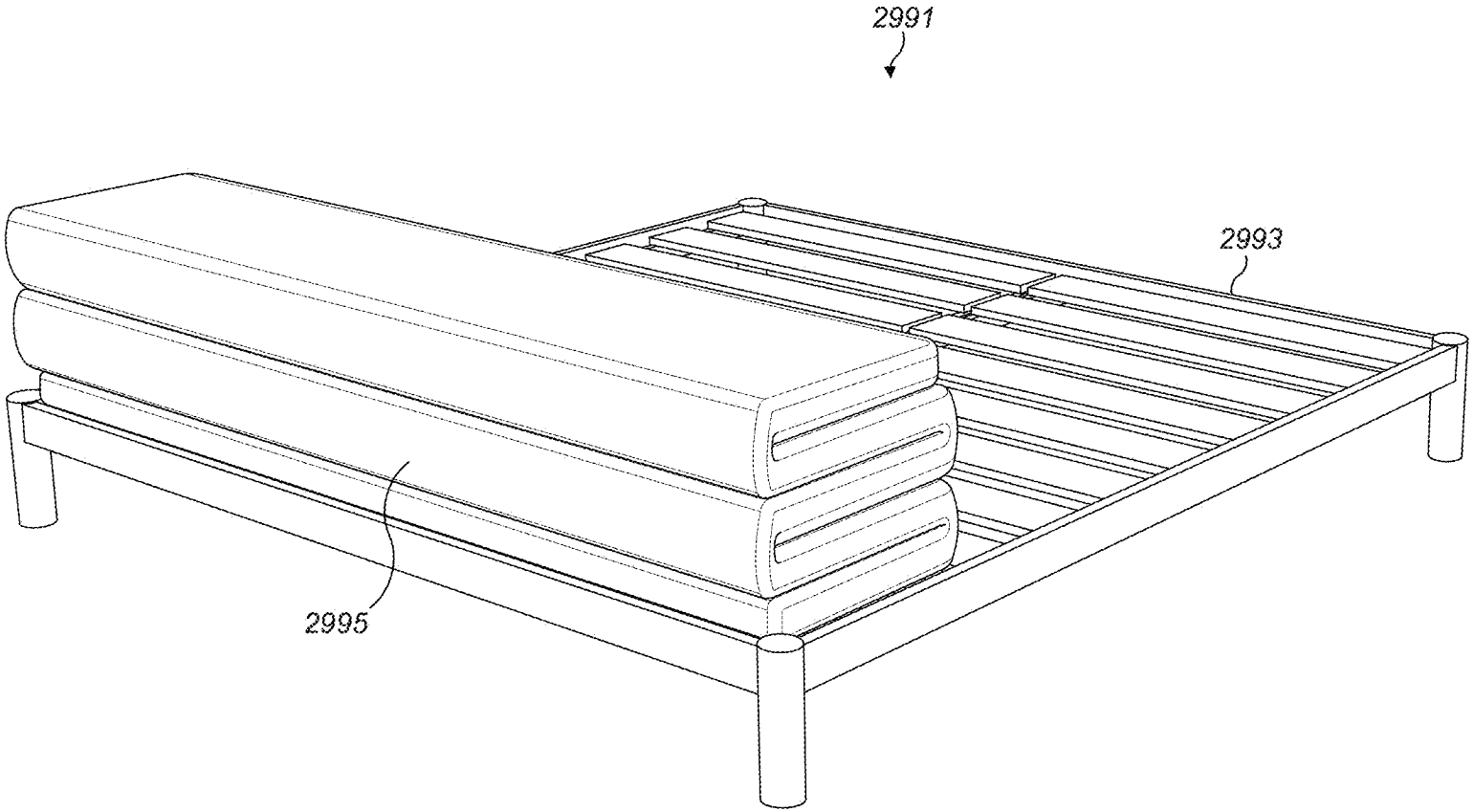
FIG. 29E shows a folded base layer.

Turning to FIG. 29E, shown is a foldable base layer system 2991. A folded base layer 2995 shows five segments folded on top of one another on a bed frame 2993. The folded nature of these five segments may be accomplished by using the hinges shown in either FIG. 29C or 29D.

VI. Airbox

The scope and functionality of airboxes within a temperature-regulating mattress system is described herein. The airboxes may include components integrated within the base structure or modular components affixed to the base structure (or a combination of the two).

The general function of an airbox in the base layer is the selective use of a fan and a heater to generate heated air or cooled air that will be forcefully blown into areas of the mattress installed above the base layer. Although positive temperature coefficient (PTC) heaters are shown in this section, any suitable convection heater or thermoelectric heater may be substituted.

In addition, an airbox may be used without the heater for delivery of air at the ambient air temperature. In addition, an airbox may be used with a cooler for delivery air cooler than the ambient air temperature. In addition, an airbox may be coupled with a humidifier or dehumidifier to adjust the relative humidity of the delivered air.

In general, airboxes may be installed in the center of the base layer (to provide air to the torso area of a mattress user) and at the bottom of the base layer (to provide air to the feet area of a mattress user).

FIGS. 30A, 30B, 31 and 32 show schematics of an airbox that is integrated into the base layer.

Figure 30B:
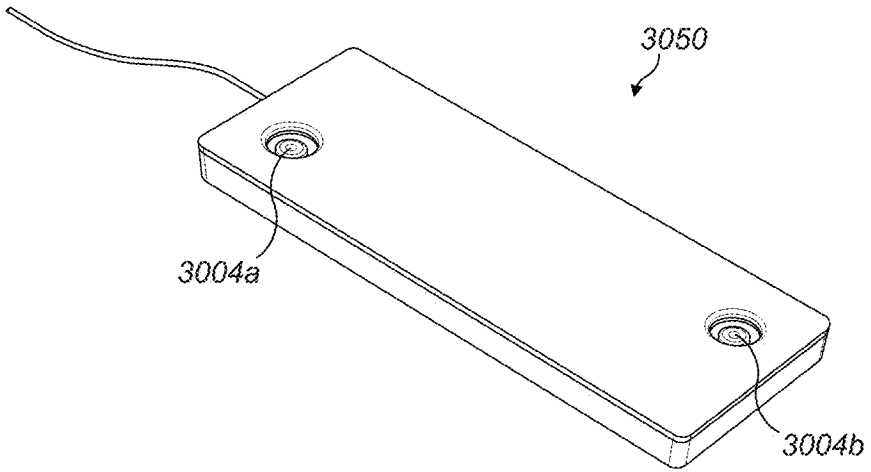
FIGS. 30A, 30B, 31 and 32 show schematics of an integrated airbox.
Figure 30A:
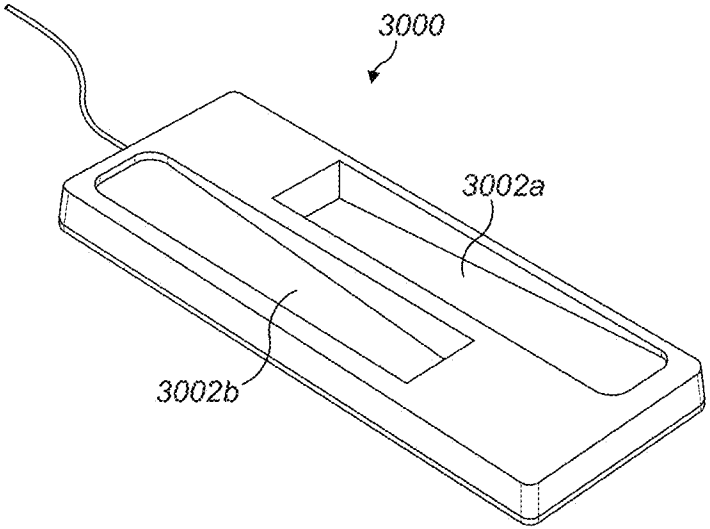

Turning to FIG. 30A, shown is top view of an integrated airbox 3000 with air exhausts 3002*a*, 3002*b* that may output warmed air. The air exhausts 3002*a*, 3002*b* include ramps that allow for enhanced air distribution to the rest of the mattress.

Turning to FIG. 30B, shown is bottom view of an integrated airbox 3050 with air inlets 3004*a*, 3004*b*. The air inlets 3004*a*, 3004*b* may draw ambient air for possible heating and further distribution with the mattress system.

Figure 31:
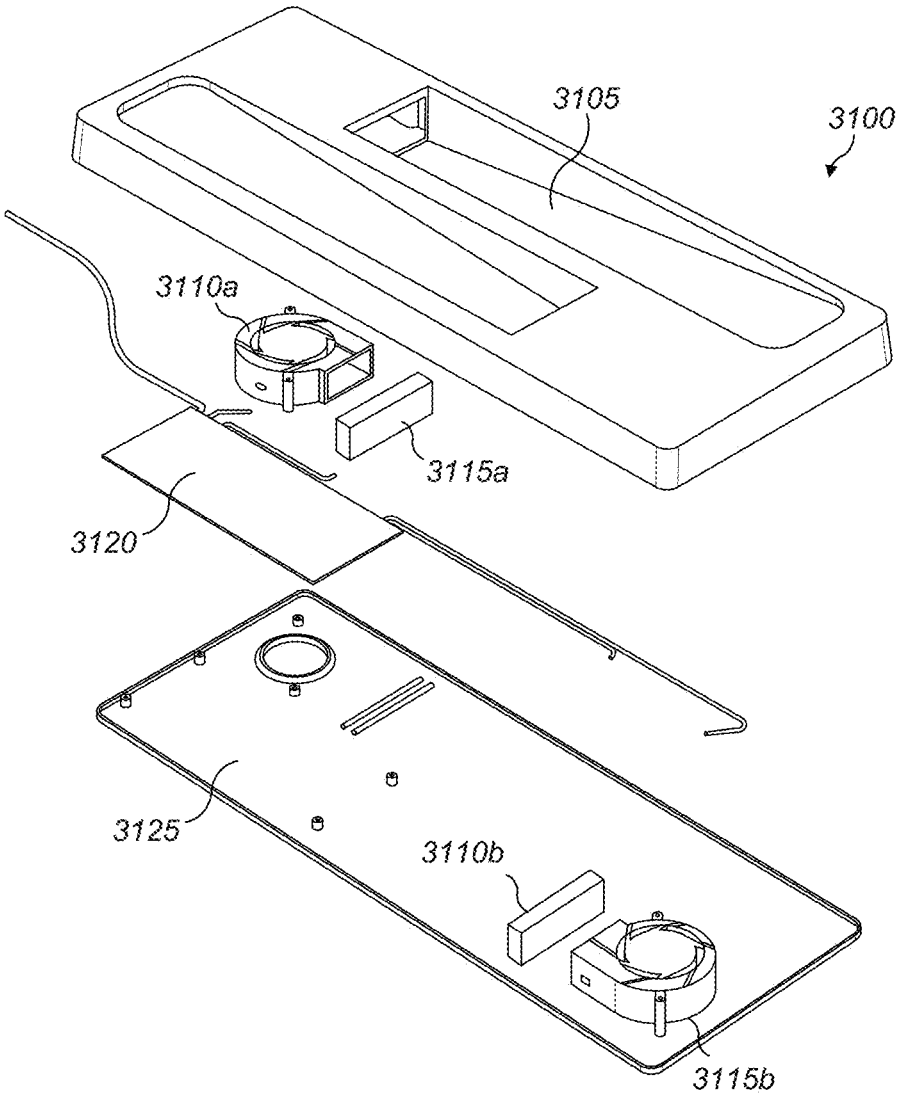

Turning to FIG. 31, shown is a cross-section view of an integrated airbox 3100. The ducting/enclosure top 3105 covers a first blower 3110*a* and a PTC heater 3115*a* pair and a second blower 3110*b* and a PTC heater pair 3115*b*, both of which are installed on an enclosure bottom 3125. Also included is logic board and wiring 3120 that controls the power and operation of each of the blower/PTC heater pairs 3110*a*, 3115*a*, 3110*b*, 3115*b*.

Figure 32:
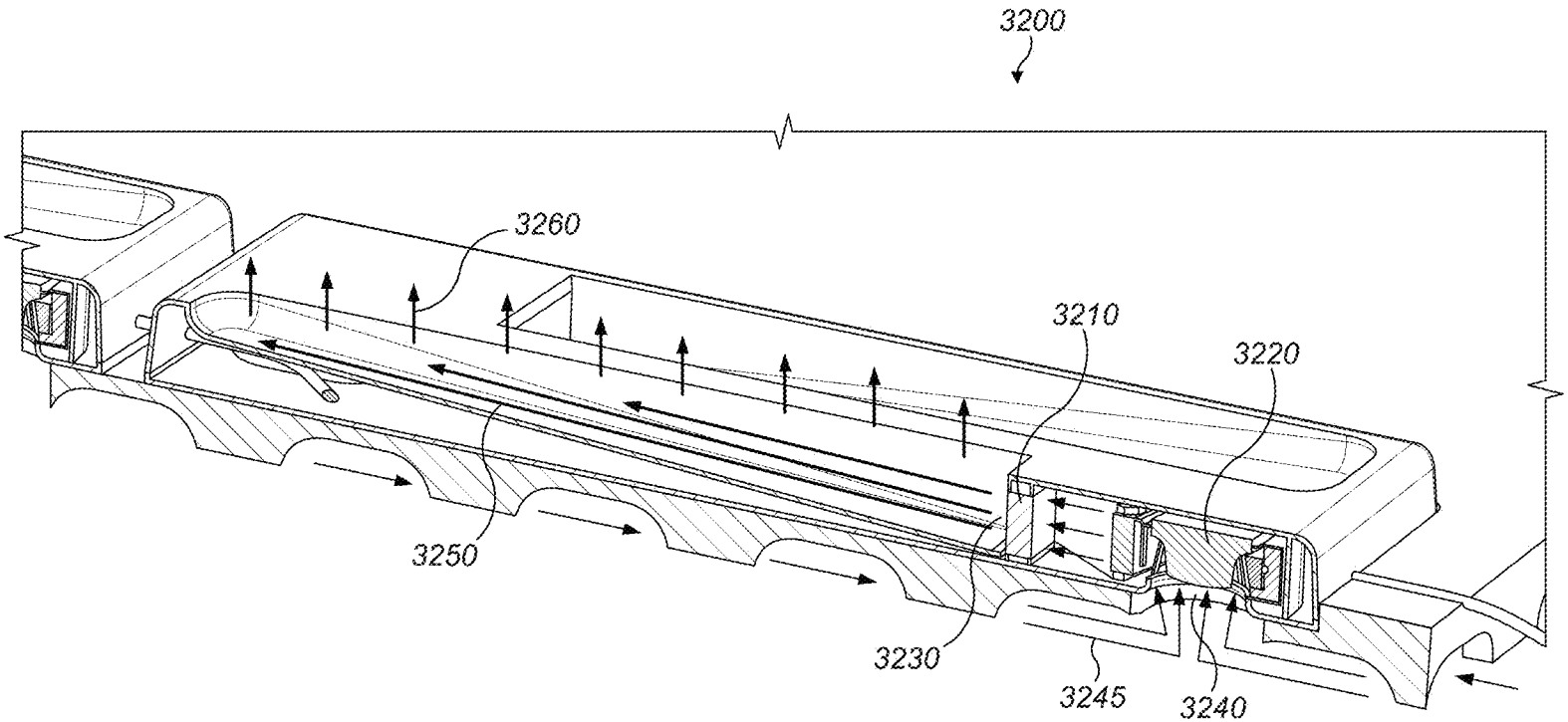

Turning to FIG. 32, shown is an integrated airbox system 3200. Intake airflow 3245 enters a blower 3220, proceeds to a heater 3210 and then is outputted via lateral airflow 3250 and upward airflow 3260. Downstream sensors 3230 and upstream sensors 3240 may measure temperature and humidity of the passing air (where downstream and upstream means downstream and upstream from the blower 3220 and heater 3210). This data can be passed to the rest of the mattress system to keep the mattress environment comfortable for the user.

FIGS. 33A, 33B, 34 and 35 show schematics of a modular airbox that is affixed to the base layer.

Figure 33B:
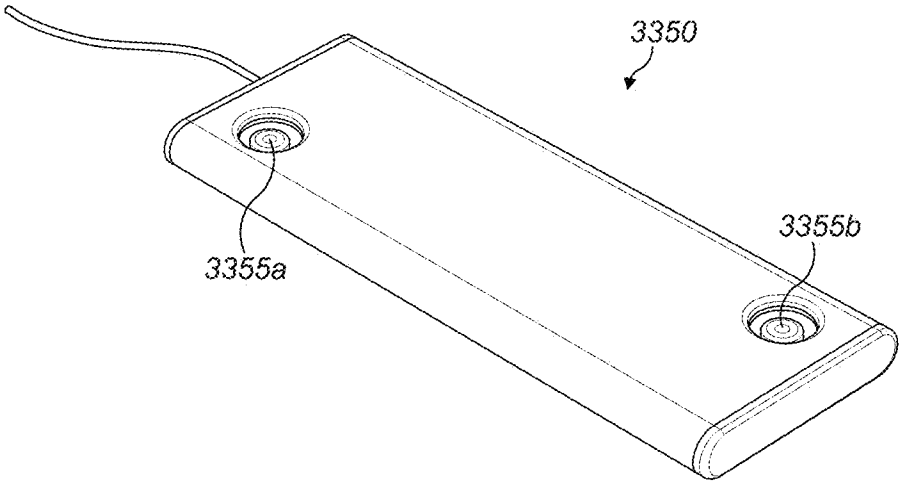
FIGS. 33A, 33B, 34 and 35 show schematics of a modular airbox.
Figure 33A:
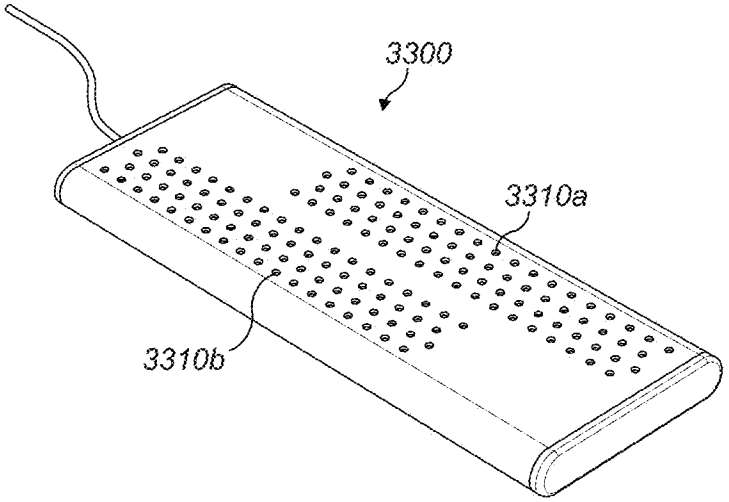

Turning to FIG. 33A, shown is top view of a modular airbox 3300 with air exhausts 3310*a*, 3310*b* that may output warmed air.

Turning to FIG. 33B, shown is bottom view of a modular airbox 3350 with air inlets 3355*a*, 3355*b*. The air inlets 3355*a*, 3355*b* may draw ambient air for possible heating and further distribution with the mattress system.

Figure 34:
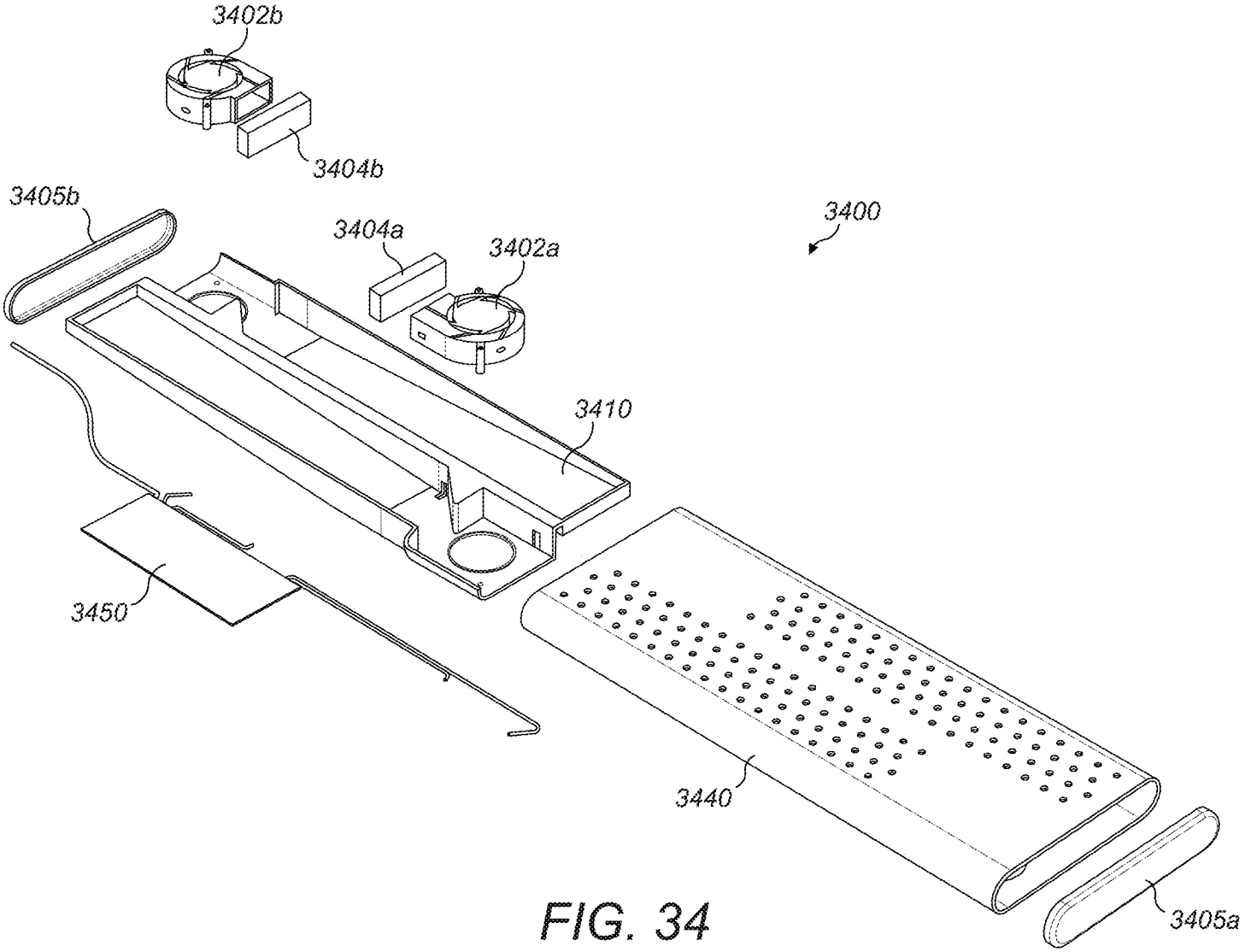

Turning to FIG. 34, shown is an exploded view of a modular airbox 3400. The exterior comprises a ducting/enclosure mounting frame 3410, endcaps 3405*a*, 3405*b* and an enclosure 3440. The interior comprises a first blower 3402*a* and a PTC heater 3404*a* pair and a second blower 3402*b* and a PTC heater pair 3404*b* and a logic board and wiring 3450 that controls the power and operation of each of the blower/PTC heater pairs 3402*a*, 3402*b*, 3404*a*, 3404*b*.

Figure 35:
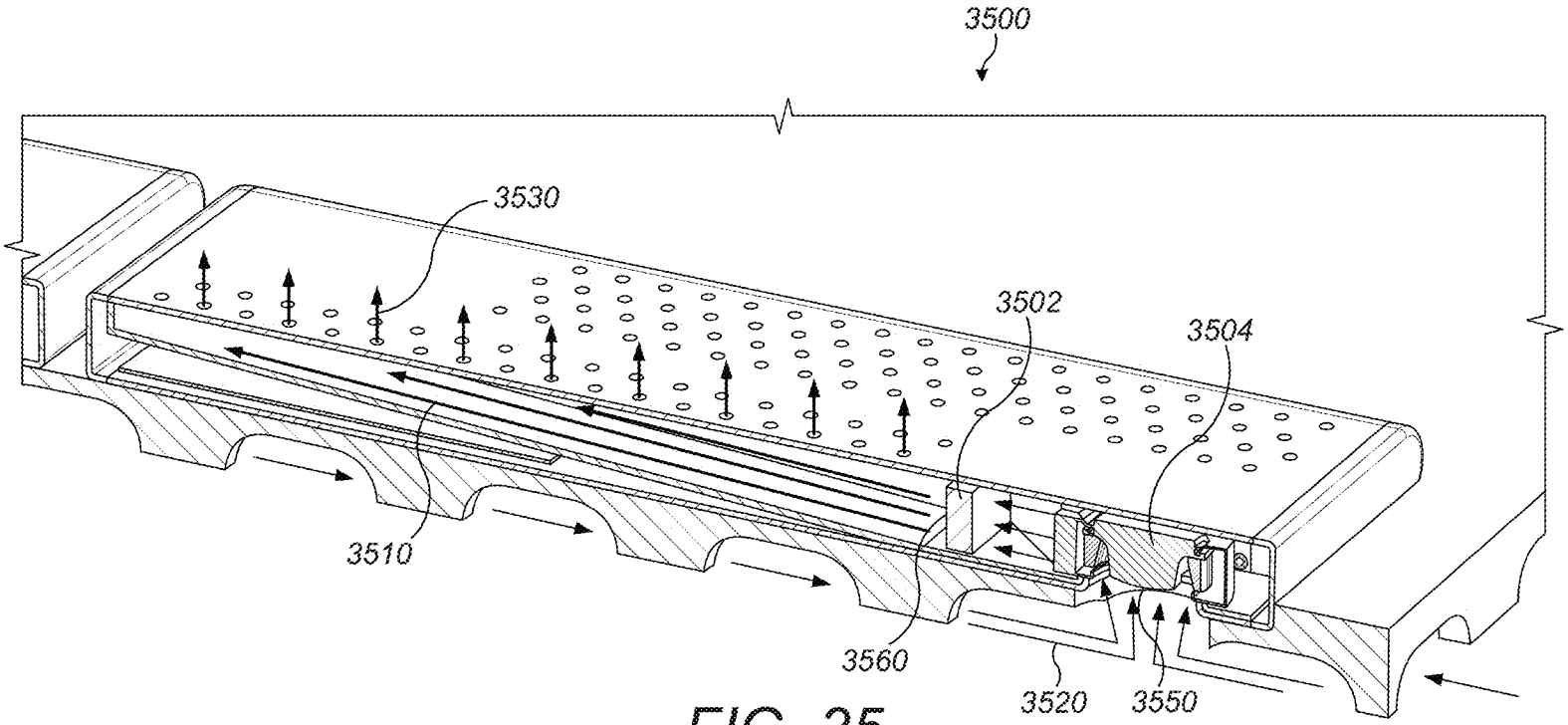

Turning to FIG. 35, shown is an integrated airbox system 3500. Intake airflow 3520 enters a blower 3504, proceeds to a heater 3502 and then is outputted via lateral airflow 3510 and upward airflow 3530 though the holes on top of the airbox. Downstream sensors 3550 and upstream sensors 3560 may measure temperature and humidity of the passing air (where downstream and upstream means downstream and upstream from the blower 3504 and heater 3502). This data can be passed to the rest of the mattress system to keep the mattress environment comfortable for the user.

Figure 36:
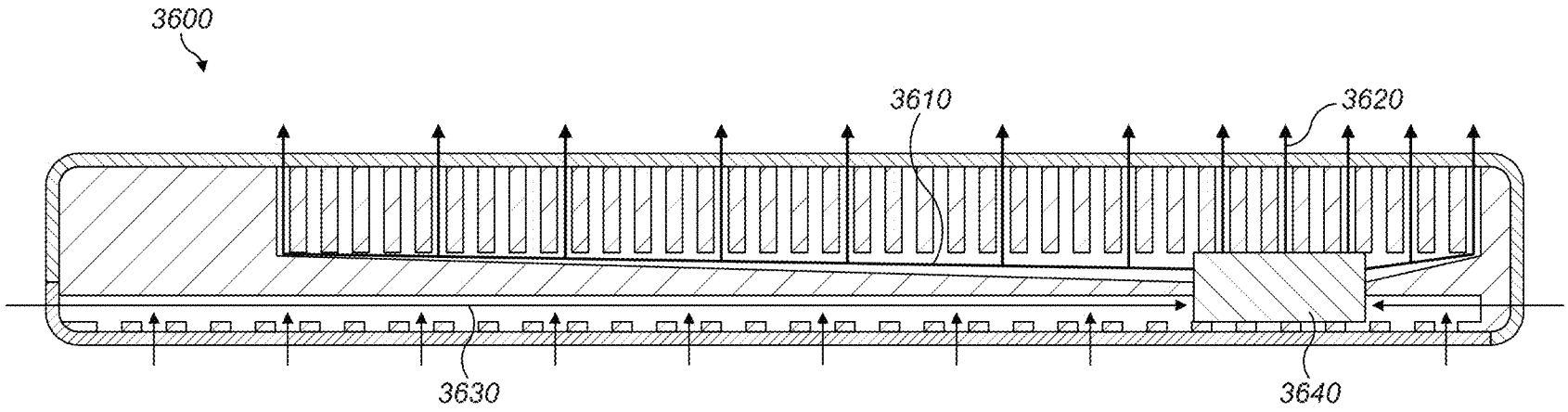
FIG. 36 shows a cross-section of a mattress system showing air delivery channels.

Turning to FIG. 36 shows a cross-section of a mattress system 3600 having air delivery channels. Here, the air entry 3630 passes through holes in the base or through a vertical perimeter or through body of spacer fabric. The air then passes through the electronics module 3640. The outputted air passes through distribution ducts 3610 then exits the mattress via a series of vertical exhausts 3620. The volume of the distribution ducts 3610 may vary along its length to affect air distribution patterns across the surface area of the mattress. The electronics module 3640 may include a blower, heater and sensors on one or more printed circuit boards (PCBs). There may be two or more electronics modules 3640 in the mattress system 3600. The electronics module 3640 may be removable for servicing and upgrades.

Figure 37:
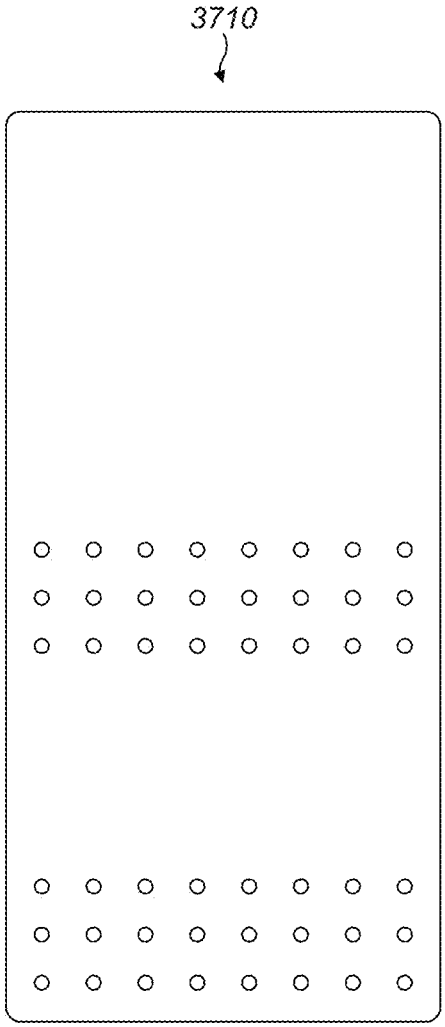
FIGS. 37 and 38 show a schematic of air distribution patterns in a mattress system.
Figure 38:
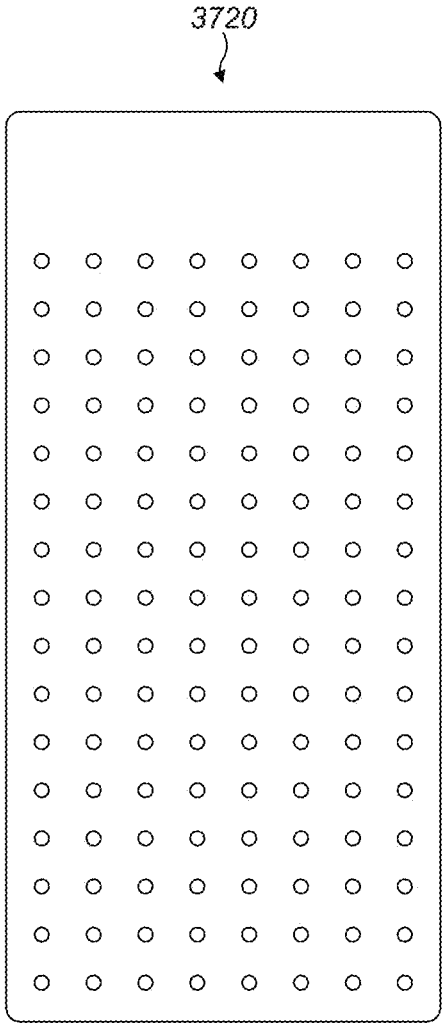

FIGS. 37 and 38 show different air distribution patterns for air exiting a mattress. Turning to FIG. 37, shown is a schematic of air distribution patterns in a mattress system 3710 that primarily provide torso and feet airflow through the mattress top. Turning to FIG. 38, shown is a schematic of air distribution patterns in a mattress system 3720 that primarily provides airflow throughout the entirety of the mattress top.

VII. Airflow

The scope and functionality of devices that improve airflow within a temperature-regulating mattress system is described herein.

FIGS. 39A, 39B, 39C, 39D, 39E and 39F show various methods for sealing surface of holes or slots in a mattress cut through the foam comfort layers. Sealed holes prevent the fluid flow horizontally into the foam through the walls of the cutout or from the underside. These methods may be combined in a mattress system. (The pointers in FIGS. 39A-39F are shown on the right side of the slots, they may equally apply to the left side of the slots.)

Figure 39A:
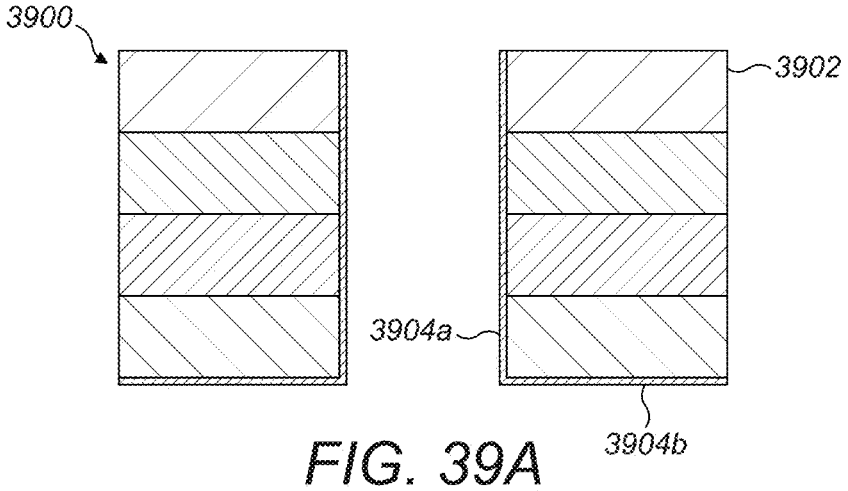
FIGS. 39A, 39B, 39C, 39D, 39E and 39F show various methods for sealing surface of holes or slots in a mattress.

Turning to FIG. 39A (liquid sealant solution), shown is a sealant system 3900 with foam comfort layers 3902 adjacent to dried sealant on the side 3904*a* and bottom 3904*b*. These sealants dry to form an impermeable skin (made from, for example, gel, silicon, rubber or adhesive). The sealant may be poured in the hole or sprayed using a nozzle.

Figure 39B:
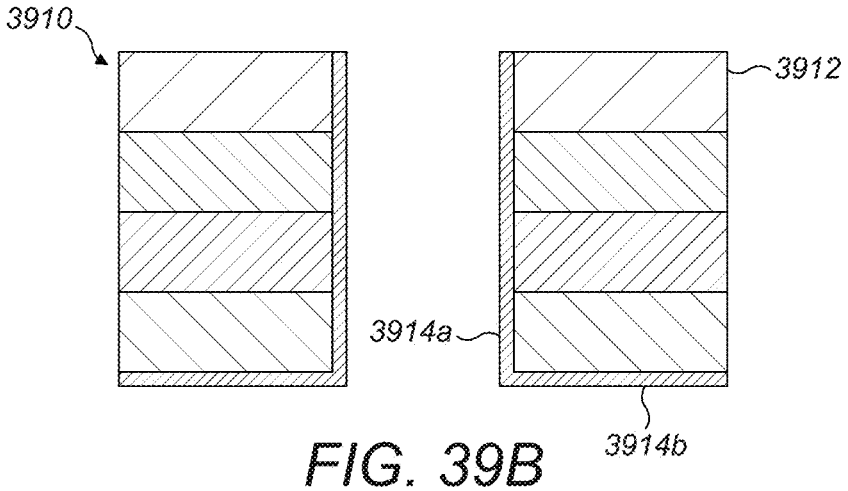

Turning to FIG. 39B (molded/self-skinning solution), shown is a sealant system 3910 with foam comfort layers 3912 adjacent to an impermeable foam on the side 3901*a* and bottom 3914*b*. Here the, impermeable foam may be created in the hole by the comfort foam layers 3912 poured sequentially into the mold. The surfaces touching the side and bottom self-skin creating an impermeable surface.

Figure 39C:
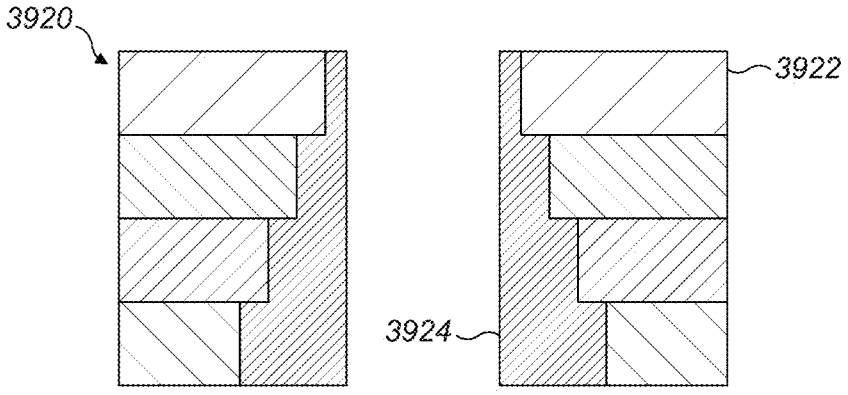

Turning to FIG. 39C (molded/insert), shown is a sealant system 3920 with foam comfort layers 3922 adjacent to a single impermeable foam insert 3924. Here the, impermeable foam insert 3924 may be molded from self-skinning or a pneumatic foam is assembled into the comfort layers 3922 using adhesive.

Figure 39D:
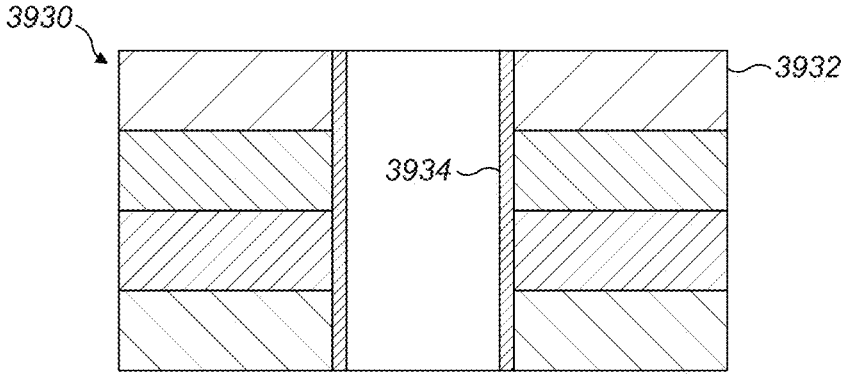

Turning to FIG. 39D (flexible insert), shown is a sealant system 3930 with foam comfort layers 3932 adjacent to a flexible tube 3934. Here a thin-walled flexible tube 3934 is inserted into the hole and is held into place by friction and/or adhesive. The hole may be expanded during insertion to aid in installation. Possible flexible tube 3934 materials include gel, silicone, rubber, latex, polymers or a flexible duct hose.

Figure 39E:
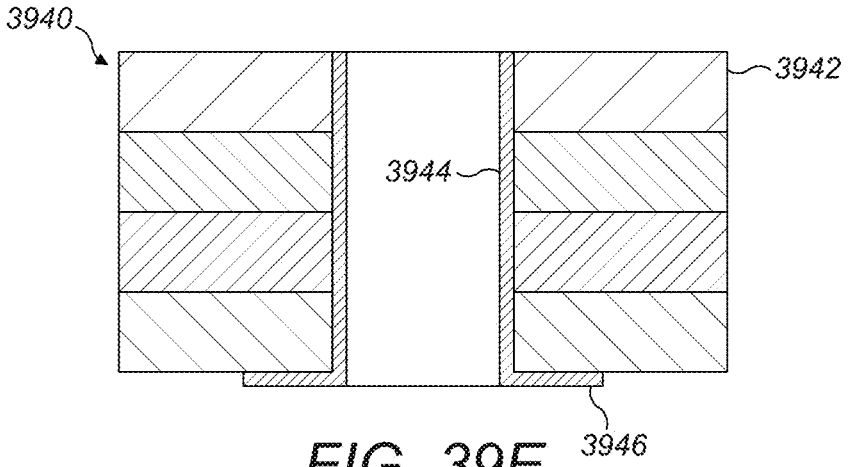

Turning to FIG. 39E (flexible insert with flange), shown is a sealant system 3940 with foam comfort layers 3942 adjacent to a flexible tube with flange 3944. Here a thin-walled flexible tube with flange 3944 is inserted into the hole and is held into place by friction and/or adhesive. The hole may be expanded during insertion to aid in installation. Possible flexible tube with flange 3944 materials include gel, silicone, rubber, latex, polymers or a flexible duct hose. The flange 3946 adds impermeability to the underside of the mattress.

Figure 39F:
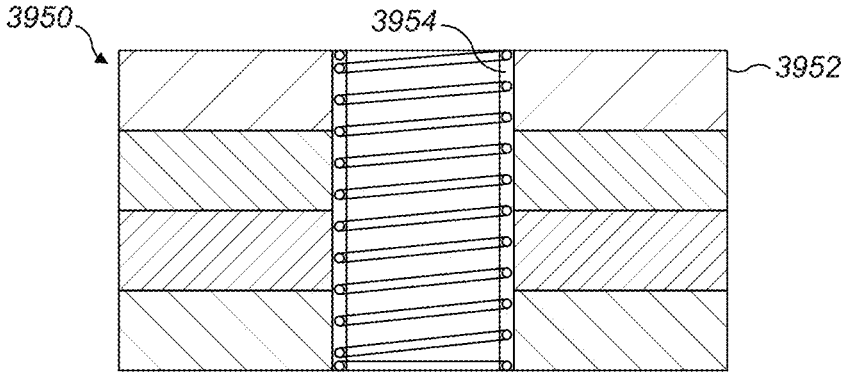

Turning to FIG. 39F (encapsulated spring insert), shown is a sealant system 3950 with foam comfort layers 3952 adjacent to a low stiffness coil spring 3954. The low stiffness coil spring 3954 is encapsulated in a sealant such as: an impenetrable polyethylene pocket or sleeve; over-molded rubber; pneumatic foam; or a flexible duct hose. The spring holds the hole open while providing minimal vertical stiffness.

Figure 40A:
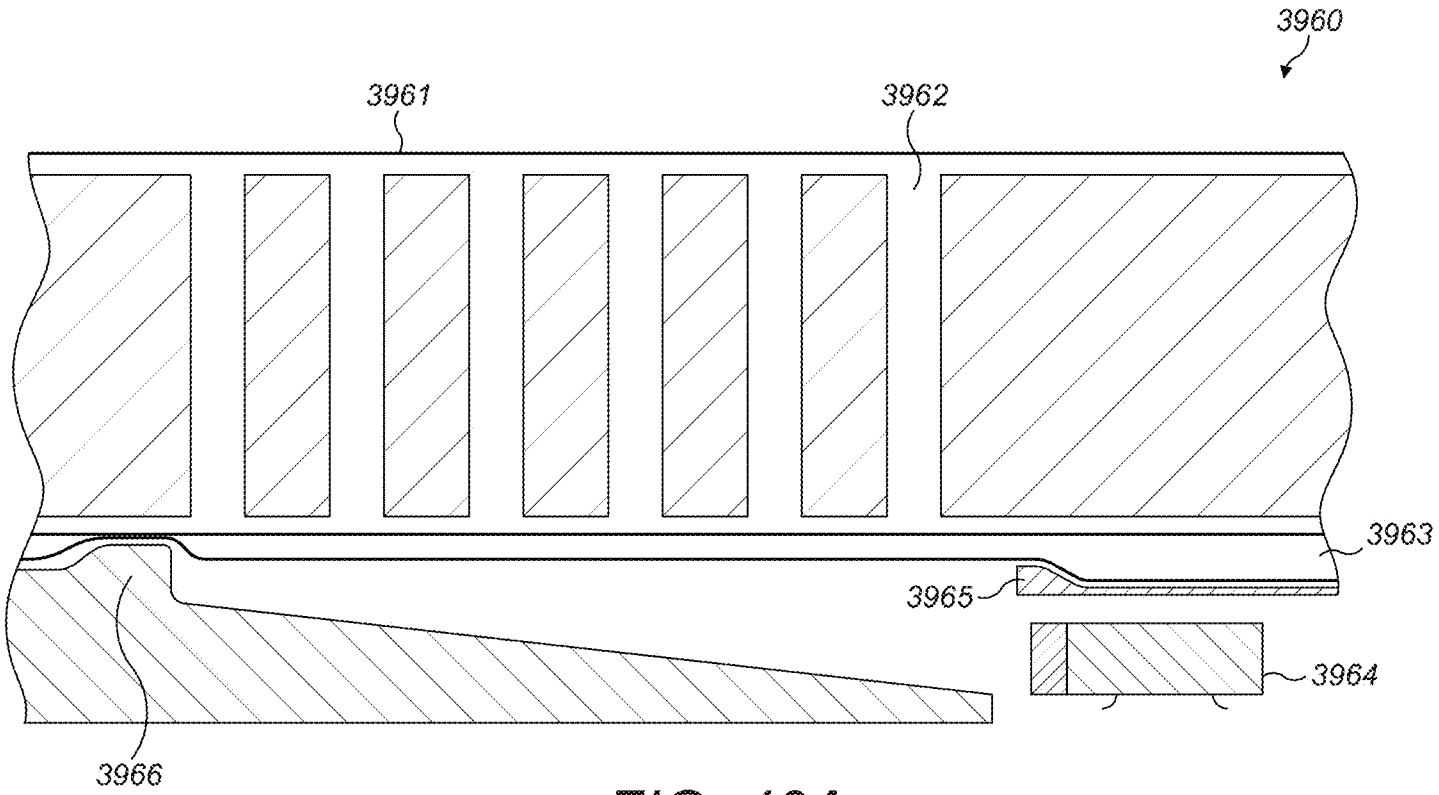
FIGS. 40A, 40B and 40C show configurations to improve airflow in a mattress system.
Figure 40B:
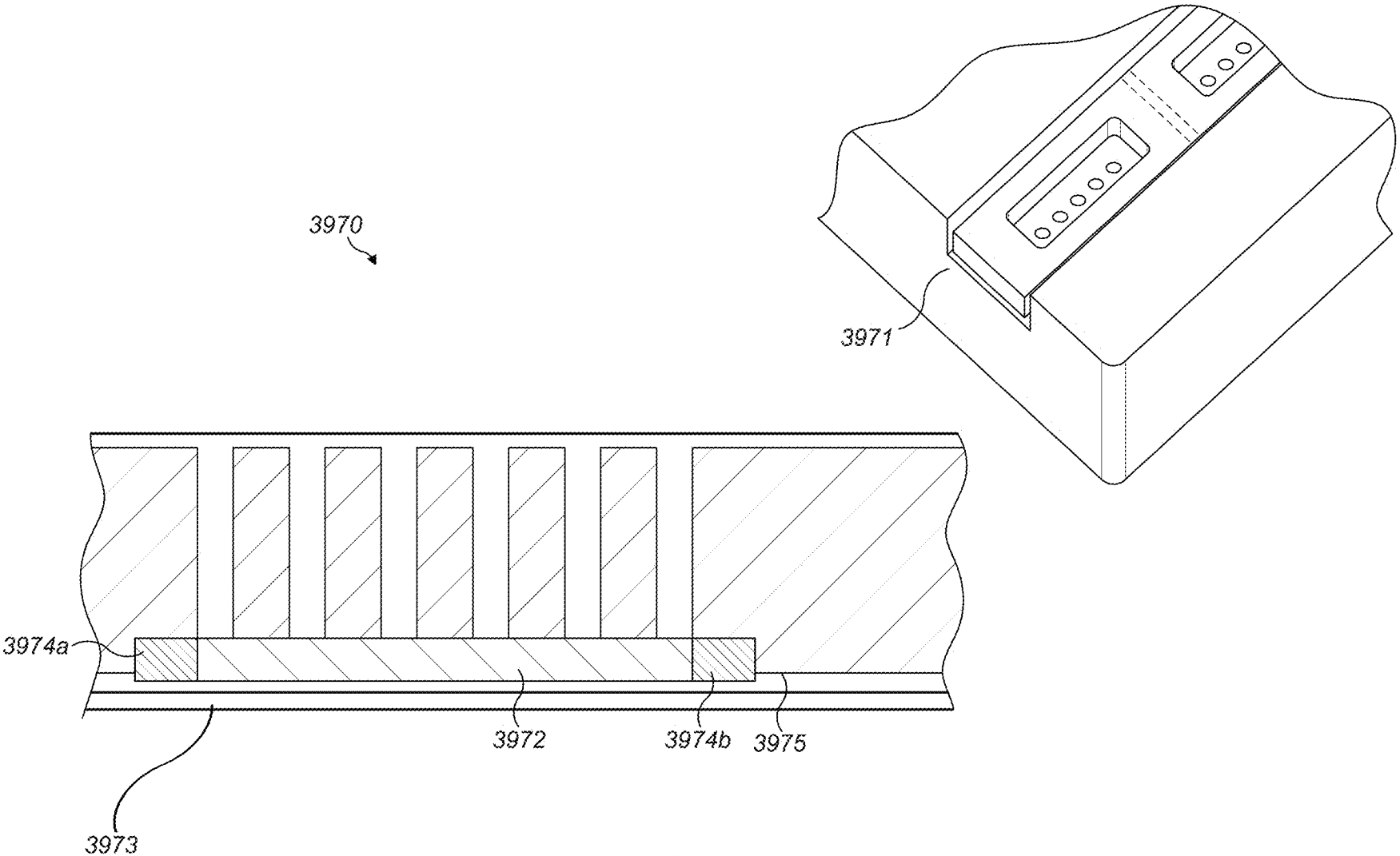
Figure 40C:
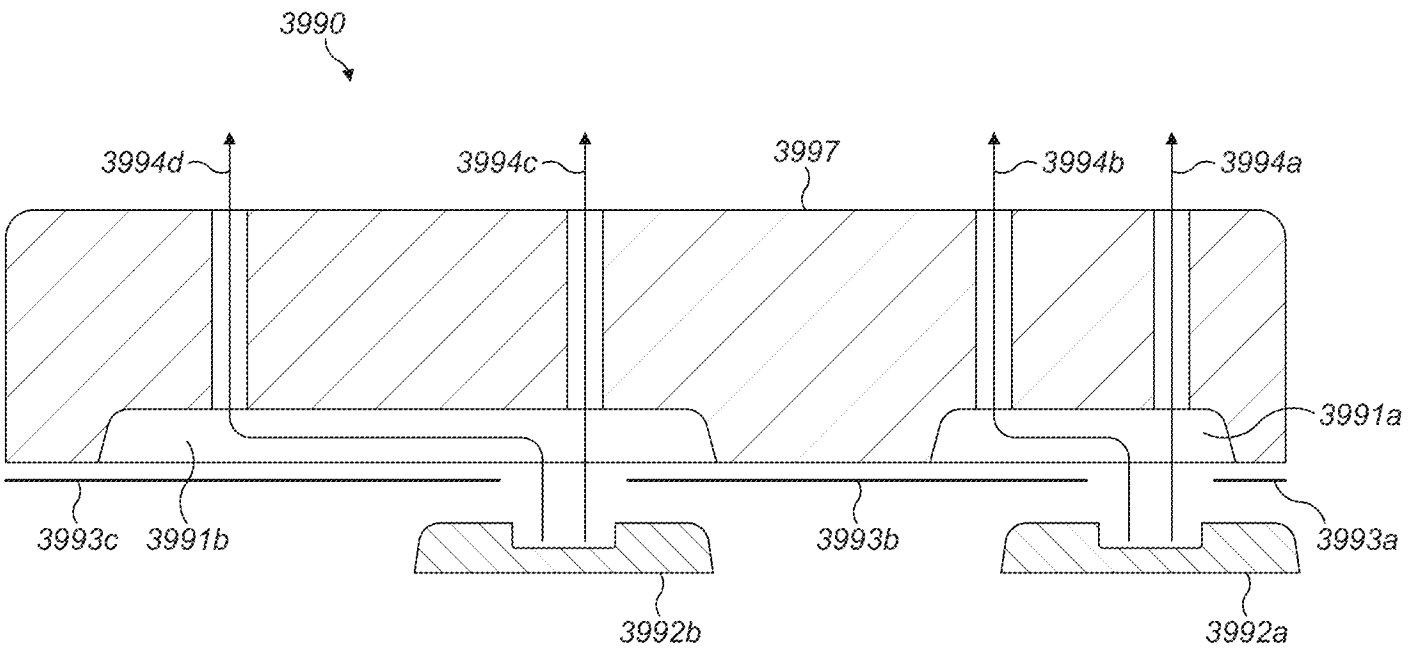

FIGS. 40A, 40B and 40C show various constructions that improve airflow throughout a mattress system. They may be used singly or in combination.

Turning to FIG. 40A, shown is a partial mattress system cross-section 3960 where a mattress 3961 includes a plurality of vertical cutouts 3962. A specially formed EPP segment 3966 has a raised edge that increases the pressure around the duct outlet perimeter. This compresses the bottom foam layer 3963 and creates a better seal between the base layer and the mattress. Another portion of the EPP segment 3965 (partially shown) also compresses the bottom foam layer 3963. The blower/heater combination 3964 may be inserted into the EPP segment as well to complete construction of the base layer interfacing with the mattress.

Turning to FIG. 40B, shown is a partial mattress system cross-section 3970 with a frame 3972 installed at the bottom of the foam layers. As shown in the inset 3971 on the top left, the frame 3972 incorporates holes that lets air through from the base layer to the mattress layer. The holes in the frame 3972 may "match up" with the holes in the mattress.

Alternatively, the frame 3972 may have only edges with an open middle. The frame edges 3974*a*, 3974*b* may consist of impermeable but flexible material (such as EPP) that solidifies the installation of the frame 3972 within the mattress.

One purpose of the frame 3972 is to create air space between the mattress cover 3973 and the underside of the foam 3975. This increases area that the air can flow through the mattress cover 3973 which results in lower pressure drop and less losses in flow.

Turning to FIG. 40C, shown is a partial mattress cross-section 3990 with a mattress having vertical air passages 3994*a*, 3994*b*, 3994*c*, 3994*d* taking air blown from airboxes 3992*a*, 3992*b* through ducts 3991*a*, 3991*b*. Underneath the airboxes 3992*a*, 3992*b* and their related EPP segments (not shown) is a permeable base cover (also not shown) that allows the air to be drawn in by the airboxes 3992*a*, 3992*b*. Surrounding the mattress on the top and the sides is a permeable mattress cover (not shown) that allows the air to be pushed out through the vertical air passages 3994*a*, 3994*b*, 3994*c*, 3994*d*. In contrast, portions of the top of the base layer and the bottom of the mattress layer 3993*a*, 3993*b* and 3993*c* may be made of an impermeable material such as rubber having lamination. This material improves airflow throughout the mattress by maximizing the amount of air drawn in by the airboxes 3992*a*, 3992*b* actually passing through ducts 3991*a*, 3991*b*.

VIII. Remote

The scope and functionality of remotes to allow the user to control features within a temperature-regulating mattress system is described herein. The purpose of these remotes includes allowing users to make real-time adjustments to mattress parameters without the user having to get out of bed. This is especially useful when the user wants to make an adjustment in the midst of a sleep cycle.

The properties of the remote discussed herein may be mixed and varied as needed to provide various functions for the mattress system.

In addition to these remotes, an app may be used to control similar features of the mattress in addition to providing an interface for more complex operations (such as those described above in FIG. 4B).

Figure 41A:
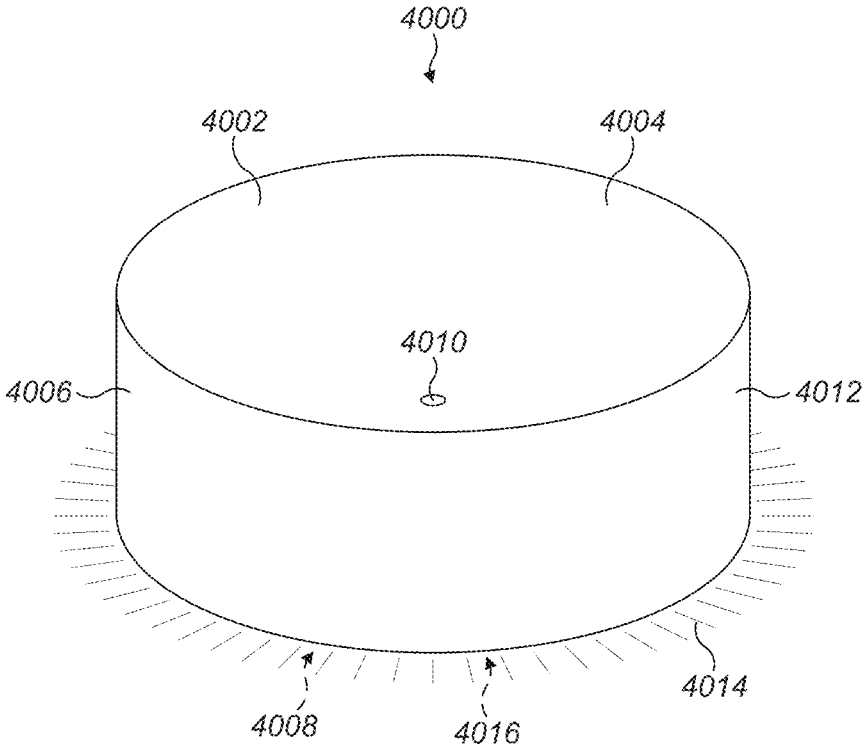
FIG. 41A shows a schematic of a remote for a mattress system.

Turning to FIG. 41A, shown is a schematic of a remote 4000 for a mattress system. The remote 4000 is generally puck-shaped and incorporates a full surface tactile button 4002 and is capable of recognizing gesture sensing 4004 performed on the remote 4000. The remote 4000 is capable of rotations 4006 and has a haptic motor 4012. A light indicator 4010 is installed on the top of the remote 4000. A gradient light indicator 4014 emanates from the bottom of the remote 4000. Installed on the bottom of the remote 4000 is a reset button 4008 and LED 4016.

Figure 41B:
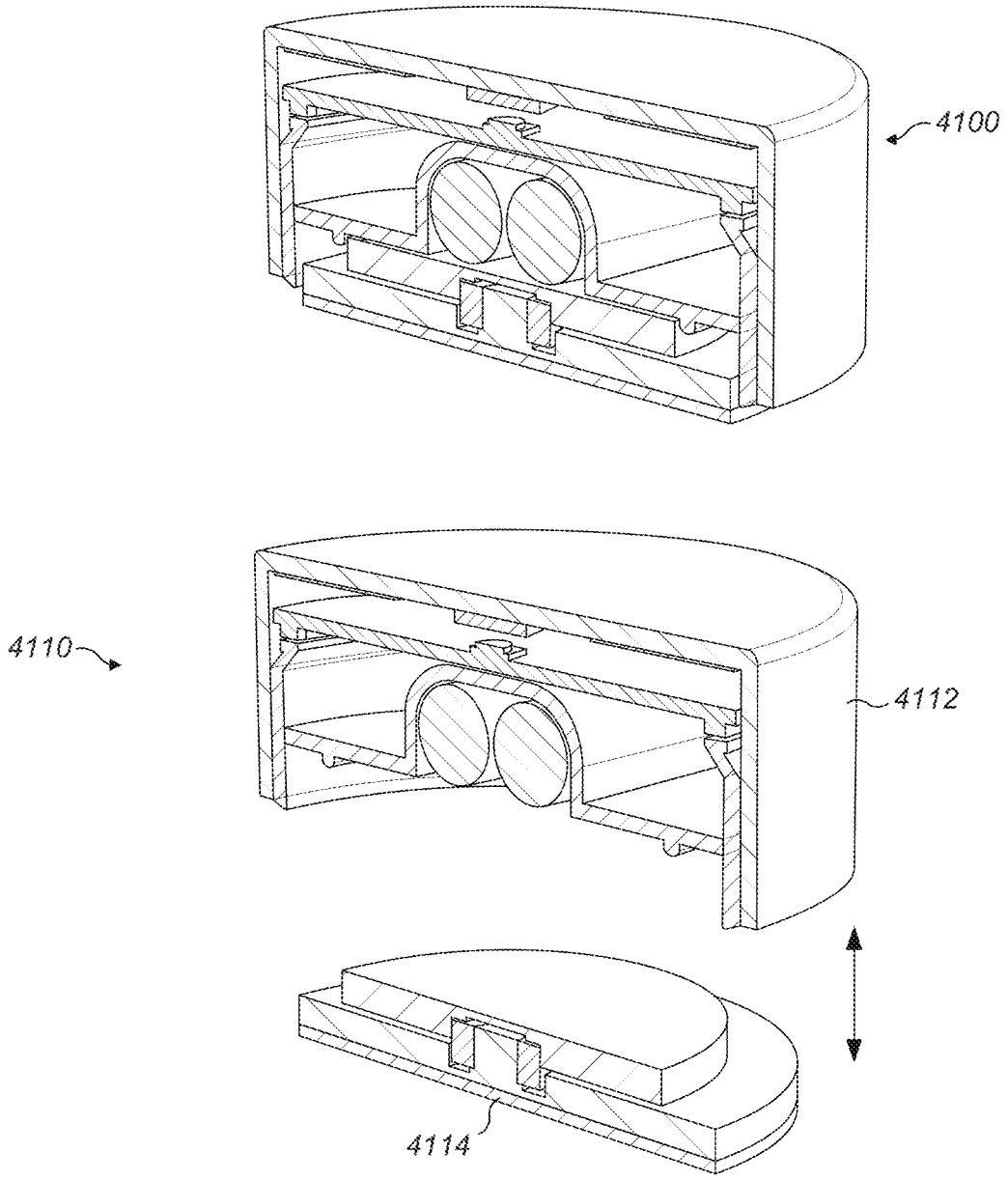
FIG. 41B shows a cross-section and FIG. 41C shows an exploded views of the remote in FIG. 41A.

Turning to FIG. 41B, shown is a cross-section of the remote in FIG. 41A integrated with its base 4100 and a cross-section of the remote separated from its base 4110. The rotating member 4112 is selectively separable and attachable from its base 4114 to allow for battery access.

Figure 41C:
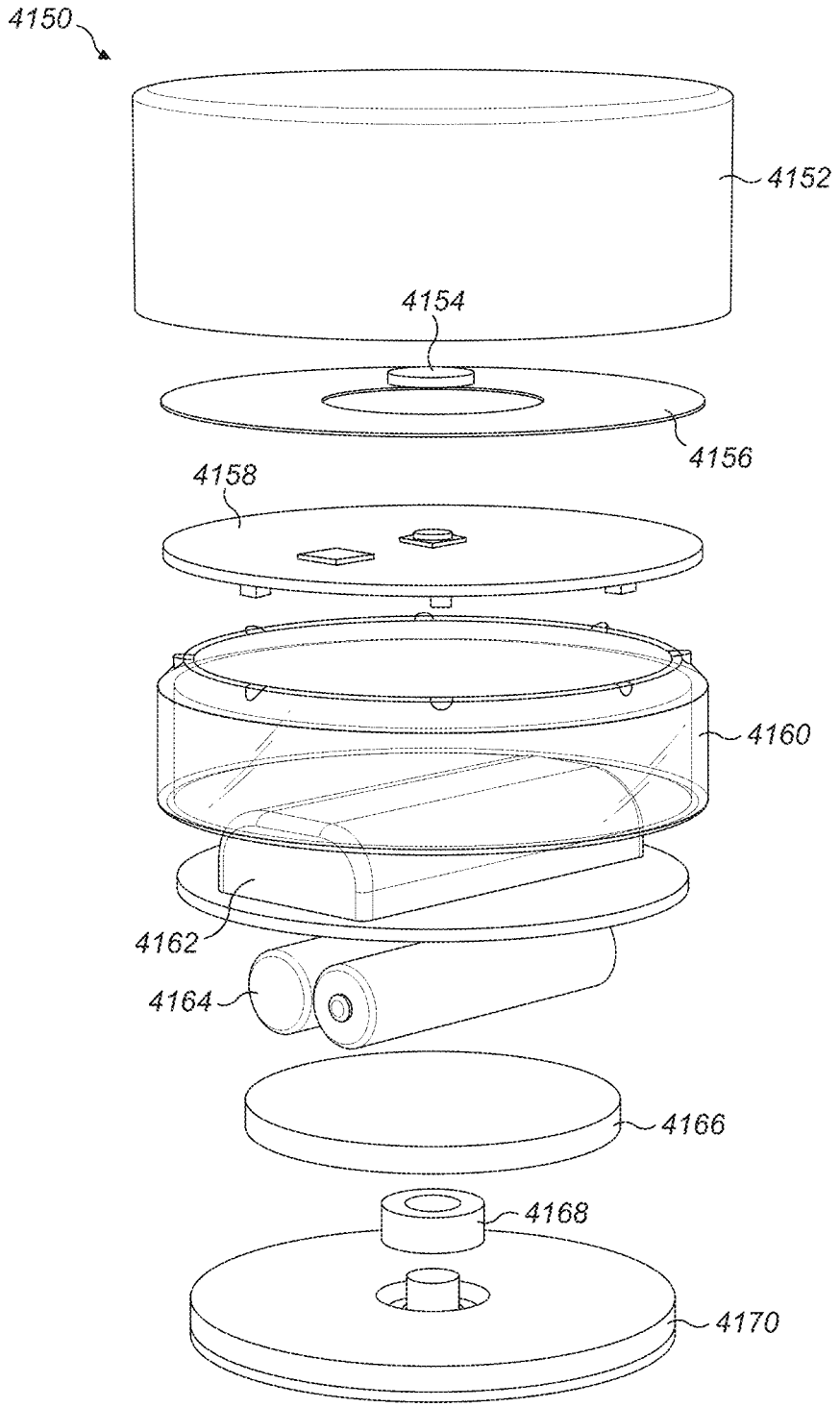

Turning to FIG. 41C, shown is an exploded view 4150 of the remote in FIG. 41A. Moving from top to bottom, shown is a dial top 4152, a linear resonant actuator/haptic motor 4154, capacitive touch sensor 4156, a PCB 4158, a light pipe/diffuser 4160, a battery housing 4162, batteries 4164, a rotating plate 4166, a bearing 4168 and a base with rubber grip 4170.

The PCB 4158 may contain an internal management unit, accelerometer or gyroscope.

FIGS. 42, 43, 44 and 45 show schematics of alternative remotes for mattress system.

Figure 42:
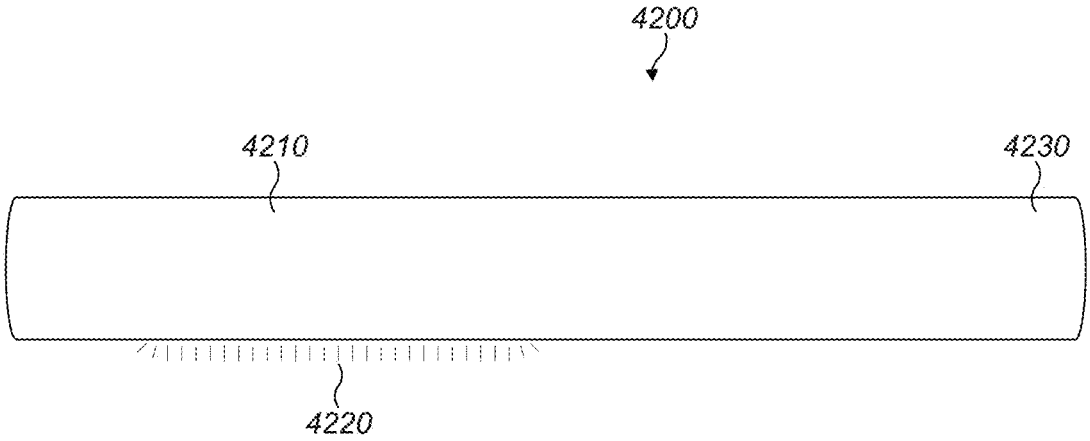
FIGS. 42, 43, 44 and 45 show schematics of alternative remotes for mattress system.

Turning to FIG. 42, shown is a schematic of a log-shaped remote system 4200. This log-shaped remote system 4200 includes a touch and press surface 4210, an emanating light 4220 and a re-charging port door 4230.

Figure 43:
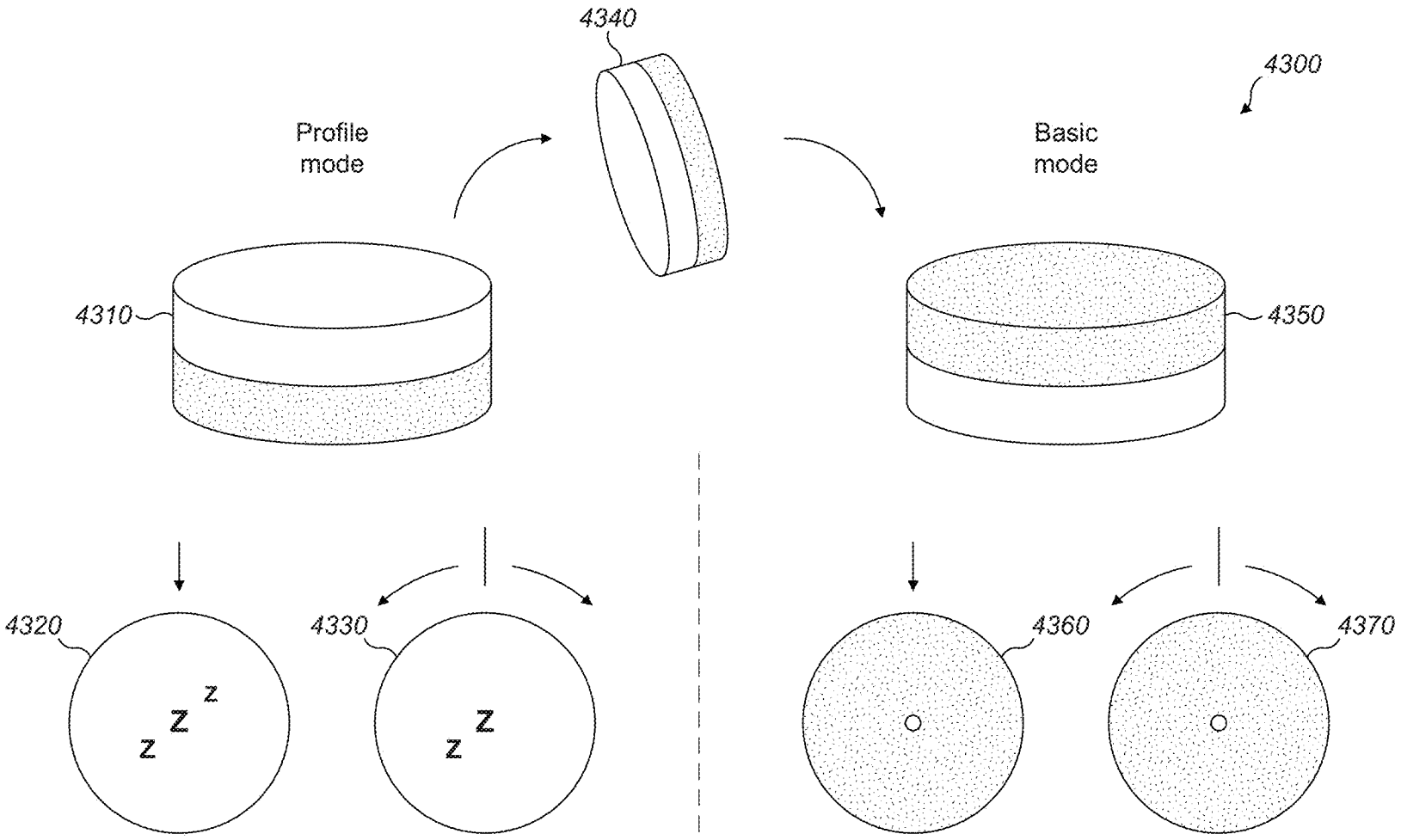

Turning to FIG. 43, shown is a schematic of a flip-over remote system 4300. On the left, the remote 4310 is in profile mode. Here the profile mode may show the remote is in standby mode (represented by Z's in one color). A press on the remote 4320 may be used by a user to cycle between desired features and a twist of the remote 4330 may increase or decrease the temperature, airflow or other feature parameter. When activated the color of the Z's may change, telling the user that the status of the remote or parameter has changed.

The remote may be flipped 4340 to enter basic mode 4350. Here a press may turn the remote on or off 4360 and a twist 4370 may activate or adjust various features in the mattress system.

Figure 44:
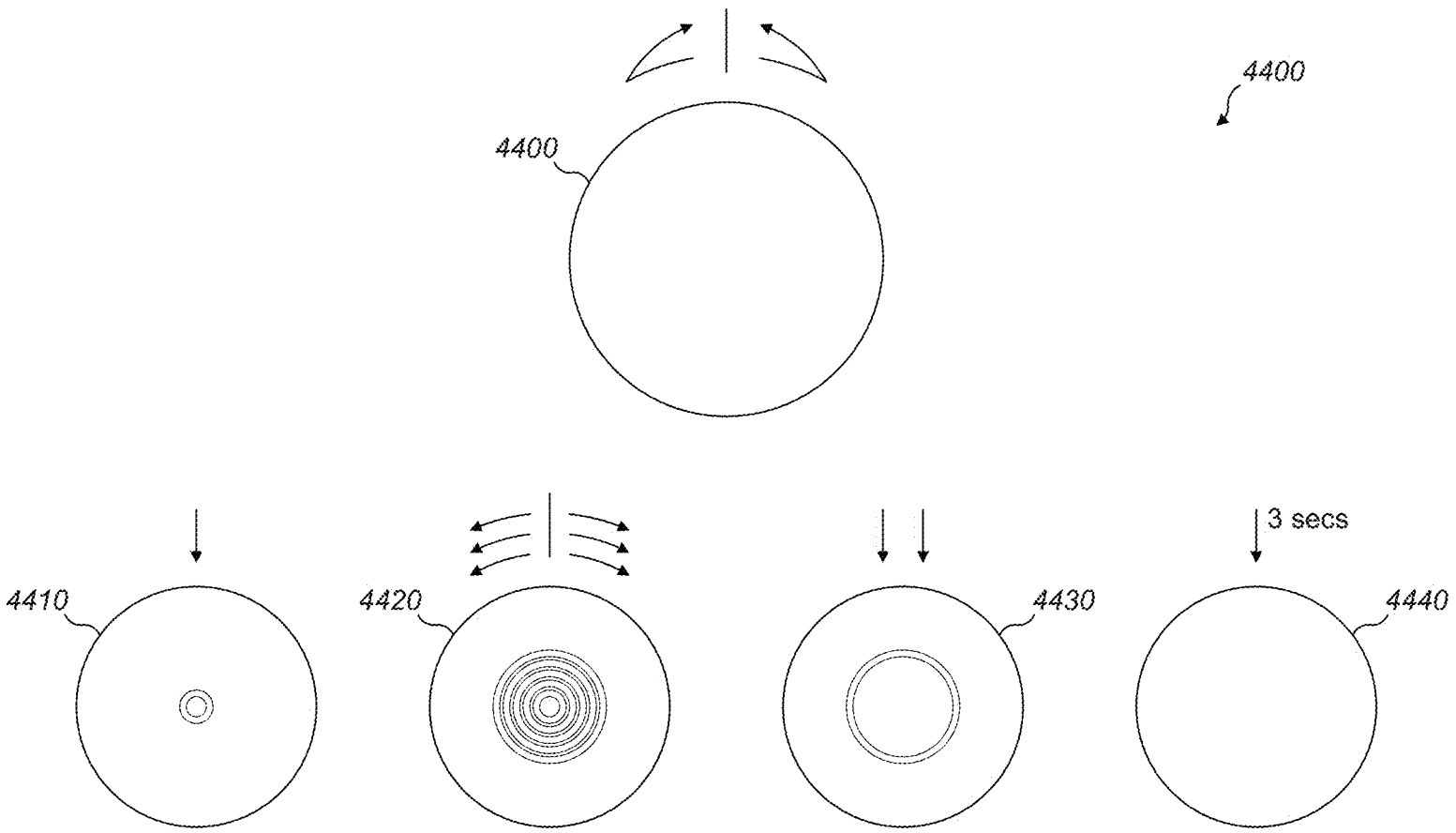

Turning to FIG. 44, shown is a schematic of a bounce-back remote system 4400. This remote is constructed so a left or right twist of the dial always springs back to the center. A press 4410 on the remote may start the system. A twist 4420 on the remote may adjust various system parameters. A double press 4430 on the remote may pause the system. A long press 4440 (such as 3 seconds) may turn the system off.

Figure 45:
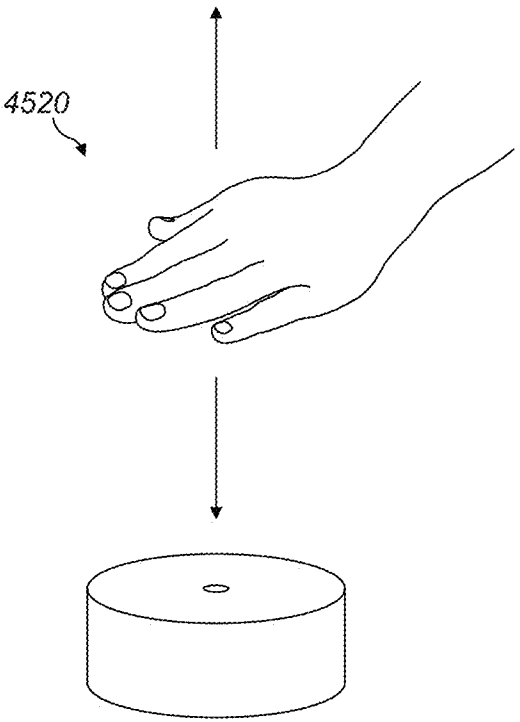
Figure 45:
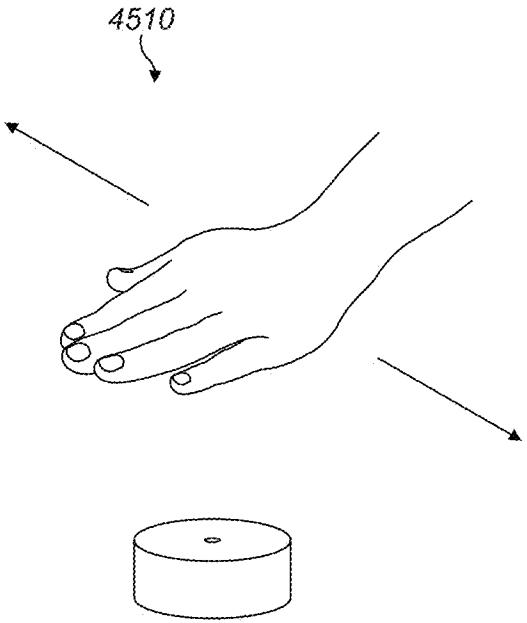

Turning to FIG. 45, shown is a remote horizontal gesture system 4510 and a remote vertical gesture system 4520 that may control features of a mattress system. The gesture sensing module in the remote detects mid-air horizontal and vertical gestures.

IX. Conclusion

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The term "coupled" as used herein is defined as connected, although not necessarily directly and not necessarily mechanically. A device or structure that is "configured" in a certain way is configured in at least that way but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, various features are grouped together in various embodiments for streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

We claim:

1. A mattress system comprising:

a comfort layer and an intake layer, wherein the comfort layer is situated above the intake layer and is attached to the intake layer, wherein the intake layer comprises a set of air passages along a bottom surface and a periphery;

an air permeable top cover surrounding a top and sides of the comfort layer;

an air permeable bottom cover comprising spacer fabric surrounding the bottom surface and the periphery of the intake layer;

wherein the comfort layer comprises:

a plurality of horizontal foam comfort layers;

a plurality of vertical air-impermeable surfaces cut through the horizontal foam comfort layers;

wherein the spacer fabric forms air channels through the bottom surface and the periphery of the intake layer so that air moves freely through the air permeable bottom cover and through the set of air passages of the intake layer in both perpendicular and parallel directions.

2. The mattress system as in claim 1, wherein the comfort layer further comprises an embedded ergonomic gel matrix.

3. The mattress as in claim 1, wherein the spacer fabric comprises a front surface, a back surface and spacer yarn in between the front surface and back surface.

4. The mattress as in claim 1, wherein the comfort layer is partially surrounded by a fire sock.

5. The mattress as in claim 1, wherein the air permeable top cover is selectively joinable with the air permeable bottom cover via a zipper.

6. The mattress system as in claim 1, wherein two of the plurality of vertical air-impermeable surfaces cut through the horizontal foam comfort layers forms a mattress vertical channel having a left channel wall and a right channel wall;

and further comprising:

a low stiffness coil spring installed the mattress vertical channel that provides minimal vertical stiffness; and a sealant between the left channel wall and the low stiffness coil and between the right channel wall and the low stiffness coil.

7. The mattress as in claim 1, wherein the comfort layer further comprises a surface sensor that measures one of temperature, humidity, and presence of a user.

8. A mattress base comprising:

a plurality of linked expandable segments;

a plurality of rigid panels, wherein each of the plurality of rigid panels is installed partially over one of the plurality of linked expandable segments a biometric sensor inlaid within a first of the plurality of rigid panels, wherein the biometric sensor measures sleeping profiles for a user of a mattress installed over the mattress base;

a first airbox system installed within a second of the plurality of rigid panels, wherein the first airbox system comprises a channel extending from a center towards two sides of a periphery of the mattress base to facilitate airflow exiting the first airbox system, the channel having a cross-section that gradually decreases from a center towards the two sides of the periphery of the mattress base, the channel having a wall that prevents airflow from exiting through peripheral edges of the mattress base;

a second airbox system installed within a third of the plurality of rigid panels, wherein the second airbox system comprises a channel extending from a center towards two sides of a periphery of the mattress base to facilitate airflow exiting the second airbox system, the channel having a cross-section that gradually decreases from a center towards the two sides of the periphery of the mattress base, the channel having a wall that prevents airflow from exiting through the peripheral edges of the mattress base;

wherein each of the plurality of linked expandable segments is flexible with respect to at least one of the adjacent expandable segments.

9. The mattress base as in claim 8, wherein the expandable segments comprise polypropylene.

10. The mattress base as in claim 8, wherein the second of the plurality of rigid panels is in the middle of the mattress base and the third of the plurality of rigid panels is on the edge of the mattress base.

11. The mattress base as in claim 8, wherein each of two adjacent linked expandable segments has a hinge carveout;

and further comprising at least one hinge connecting two linked expandable segments, wherein the at least one hinge has two flanges where each flange is selectively insertable and removable from a hinge carveout.

* * * * *